US011708999B2

(12) United States Patent
Sommerauer

(10) Patent No.: US 11,708,999 B2
(45) Date of Patent: Jul. 25, 2023

(54) BIOMASS HEATING SYSTEM WITH OPTIMIZED FLUE GAS TREATMENT

(71) Applicant: SL-TECHNIK GMBH, St. Pantaleon (AT)

(72) Inventor: Thilo Sommerauer, Gilgenberg am Weilhart (AT)

(73) Assignee: SL-TECHNIK GMBH, St. Pantaleon (AT)

( * ) Notice: Subject to any disclaimer, the term of this patent is extended or adjusted under 35 U.S.C. 154(b) by 0 days.

(21) Appl. No.: 17/753,398

(22) PCT Filed: Sep. 3, 2020

(86) PCT No.: PCT/EP2020/074584
§ 371 (c)(1),
(2) Date: Mar. 2, 2022

(87) PCT Pub. No.: WO2021/043895
PCT Pub. Date: Mar. 11, 2021

(65) Prior Publication Data

US 2022/0333817 A1 Oct. 20, 2022

(30) Foreign Application Priority Data

| | | |
|---|---|---|
| Sep. 3, 2019 | (EP) | 19195118 |
| Nov. 19, 2019 | (EP) | 19210080 |
| Nov. 20, 2019 | (EP) | 19210444 |

(51) Int. Cl.
*F24H 1/00* (2022.01)
*F23B 30/00* (2006.01)
(Continued)

(52) U.S. Cl.
CPC ..... *F24H 1/0063* (2013.01); *B03C 3/10* (2013.01); *B03C 3/76* (2013.01); *F23B 1/24* (2013.01);
(Continued)

(58) Field of Classification Search
CPC .. F23B 5/04; F23B 7/007; F23B 10/02; F23B 2700/018; F23G 2202/103; F23L 1/00;
(Continued)

(56) References Cited

U.S. PATENT DOCUMENTS

| | | | |
|---|---|---|---|
| 36,055 | A | 7/1862 | March |
| 422,472 | A | 3/1890 | Wadsworth |

(Continued)

FOREIGN PATENT DOCUMENTS

| | | | |
|---|---|---|---|
| AT | 408846 | B | 3/2002 |
| AT | 5587 | U1 | 8/2002 |

(Continued)

OTHER PUBLICATIONS

Translation of EP 2787279 A1 (Year: 2014).*

(Continued)

*Primary Examiner* — Steven B McAllister
*Assistant Examiner* — Benjamin W Johnson
(74) *Attorney, Agent, or Firm* — Chiesa, Shahinian & Giantomasi PC

(57) ABSTRACT

A biomass heating system for firing fuel in the form of pellets and/or wood chips is disclosed, comprising: a boiler with a combustion device; a heat exchanger with an inlet and an outlet; wherein the combustion device comprises a combustion chamber with a primary combustion zone and with a secondary combustion zone provided downstream thereof; the combustion device having a rotating grate on which the fuel can be burned; the secondary combustion zone of the combustion chamber being fluidically connected to the inlet of the heat exchanger and the primary combustion zone being laterally enclosed by a plurality of combustion chamber bricks.

6 Claims, 33 Drawing Sheets

(51) Int. Cl.

| | |
|---|---|
| ***F23B 10/02*** | (2011.01) |
| ***F23L 1/00*** | (2006.01) |
| ***F23L 3/00*** | (2006.01) |
| ***F23L 9/00*** | (2006.01) |
| ***F23B 30/02*** | (2006.01) |
| ***F23H 9/00*** | (2021.01) |
| ***F23H 15/00*** | (2006.01) |
| ***F24H 15/104*** | (2022.01) |
| ***F24H 9/28*** | (2022.01) |
| ***F24H 1/18*** | (2022.01) |
| ***B03C 3/10*** | (2006.01) |
| ***B03C 3/76*** | (2006.01) |
| ***F23B 60/02*** | (2006.01) |
| ***F23J 3/02*** | (2006.01) |
| ***F23J 15/02*** | (2006.01) |
| ***F24H 9/00*** | (2022.01) |
| ***F24H 9/20*** | (2022.01) |
| *F24H 15/281* | (2022.01) |

(52) U.S. Cl.

CPC ..... *F23B 5/04* (2013.01); *F23B 7/007* (2013.01); *F23B 10/02* (2013.01); *F23B 30/02* (2013.01); *F23B 60/02* (2013.01); *F23H 9/00* (2013.01); *F23H 15/00* (2013.01); *F23J 3/023* (2013.01); *F23J 15/025* (2013.01); *F23L 1/00* (2013.01); *F23L 3/00* (2013.01); *F23L 9/00* (2013.01); *F24H 1/187* (2013.01); *F24H 9/0031* (2013.01); *F24H 9/2057* (2013.01); *F24H 9/28* (2022.01); *F24H 15/104* (2022.01); *F23B 2700/018* (2013.01); *F23G 2202/103* (2013.01); *F23J 2217/102* (2013.01); *F23M 2700/0053* (2013.01); *F24H 15/281* (2022.01)

(58) Field of Classification Search

CPC .. F23L 3/00; F23L 9/00; F24H 1/0063; F24H 1/187; F24H 9/0031; F24H 9/2057; F27B 1/24

USPC ..... 122/16.1

See application file for complete search history.

(56) References Cited

U.S. PATENT DOCUMENTS

| | | | | |
|---|---|---|---|---|
| 1,371,995 | A | 3/1921 | Nesbit | |
| 1,393,712 | A | 10/1921 | Steere et al. | |
| 2,233,066 | A | 2/1941 | Watson | |
| 2,933,057 | A | 4/1960 | Wilson | |
| 3,010,450 | A | 11/1961 | James | |
| 4,092,134 | A | 5/1978 | Kikuchi | |
| 4,254,715 | A | 3/1981 | Lahaye et al. | |
| 4,258,692 | A | 3/1981 | Mackey | |
| 4,319,555 | A | 3/1982 | Melvin | |
| 4,675,029 | A | 6/1987 | Norman et al. | |
| 4,962,912 | A * | 10/1990 | Stoll | F16K 3/32 251/129.11 |
| 5,241,916 | A * | 9/1993 | Martin | F23B 1/18 110/298 |
| 5,497,824 | A | 3/1996 | Rouf | |
| 5,823,122 | A | 10/1998 | Chronowski et al. | |
| 5,937,772 | A | 8/1999 | Khinkis et al. | |
| 6,004,376 | A | 12/1999 | Frank | |
| 6,158,302 | A | 12/2000 | Becker et al. | |
| 6,485,296 | B1 | 11/2002 | Bender et al. | |
| 6,545,462 | B2 | 4/2003 | Schott et al. | |
| 6,820,511 | B2 | 11/2004 | Mutschler et al. | |
| 7,758,675 | B2 | 7/2010 | Naito et al. | |
| 8,901,921 | B2 | 12/2014 | Sterling | |
| 10,875,634 | B2 | 12/2020 | De Dreuille De Longeville et al. | |
| 2004/0044423 | A1 | 3/2004 | Wintrich | |
| 2006/0112955 | A1 | 6/2006 | Reaves | |
| 2008/0223266 | A1 | 9/2008 | Brazier et al. | |
| 2009/0013985 | A1 | 1/2009 | Little et al. | |
| 2009/0105852 | A1 | 4/2009 | Wintrich et al. | |
| 2009/0199747 | A1 | 8/2009 | Laskowski et al. | |
| 2010/0251973 | A1 | 10/2010 | Dongo et al. | |
| 2011/0209647 | A1 | 9/2011 | Mitchell et al. | |
| 2013/0133560 | A1 | 5/2013 | Laskowski et al. | |
| 2015/0094865 | A1 | 4/2015 | Choi et al. | |
| 2016/0341437 | A1 | 11/2016 | Matsuoka | |
| 2019/0170345 | A1 | 6/2019 | Ozbey et al. | |
| 2020/0191380 | A1 | 6/2020 | Park et al. | |

FOREIGN PATENT DOCUMENTS

| | | | | |
|---|---|---|---|---|
| AT | 6972 | U1 | 6/2004 | |
| AT | 503043 | A4 | 7/2007 | |
| AT | 505295 | B1 | 12/2008 | |
| AT | 506411 | A4 | 9/2009 | |
| AT | 506615 | A1 | 10/2009 | |
| AT | 506970 | A4 | 1/2010 | |
| AT | 509487 | B1 | 9/2011 | |
| AT | 13782 | U1 | 8/2014 | |
| AT | 13825 | U1 | 9/2014 | |
| CH | 40299 | A | 6/1908 | |
| CH | 694645 | A5 | 5/2005 | |
| CN | 202109645 | U | 1/2012 | |
| CN | 203442792 | U | 2/2014 | |
| CN | 206904963 | U | 1/2018 | |
| CN | 207091367 | U | 3/2018 | |
| CN | 108506924 | A | 9/2018 | |
| CN | 108662581 | A | 10/2018 | |
| CN | 108826310 | A | 11/2018 | |
| CN | 109915816 | A | 6/2019 | |
| DE | 277440 | C | 8/1914 | |
| DE | 557091 | C | 8/1932 | |
| DE | 1056052 | B | 4/1959 | |
| DE | 1094912 | B | 12/1960 | |
| DE | 2206056 | A1 | 8/1973 | |
| DE | 2755059 | A1 | 6/1979 | |
| DE | 3136195 | A1 | 3/1983 | |
| DE | 3200727 | A1 | 7/1983 | |
| DE | 3410546 | A | 10/1985 | |
| DE | 3500431 | A1 | 7/1986 | |
| DE | 3842811 | A1 | 6/1990 | |
| DE | 19528422 | C1 | 4/1997 | |
| DE | 19706067 | A1 | 8/1998 | |
| DE | 19825442 | A1 | 10/1999 | |
| DE | 19650585 | C2 | 11/2001 | |
| DE | 20210190 | U1 | 11/2003 | |
| DE | 10219251 | B3 | 1/2004 | |
| DE | 102007010973 | A1 | 9/2008 | |
| DE | 102010061861 | A1 | 9/2011 | |
| EP | 0156363 | A2 | 10/1985 | |
| EP | 0433152 | A1 | 6/1991 | |
| EP | 0677416 | A1 | 10/1995 | |
| EP | 0950833 | A2 | 10/1999 | |
| EP | 0885113 | B1 | 4/2000 | |
| EP | 1353150 | B1 | 9/2006 | |
| EP | 1830130 | A2 | 9/2007 | |
| EP | 1884712 | A2 | 2/2008 | |
| EP | 1967273 | A2 | 9/2008 | |
| EP | 1182461 | B1 | 4/2010 | |
| EP | 2198124 | A1 | 6/2010 | |
| EP | 2587150 | A2 | 5/2013 | |
| EP | 2662539 | A1 | 11/2013 | |
| EP | 2770255 | A2 | 8/2014 | |
| EP | 2787279 | A1 * | 10/2014 | F23B 10/02 |
| EP | 2966349 | A1 | 1/2016 | |
| EP | 3064276 | A2 | 9/2016 | |
| EP | 3414158 | A1 | 12/2018 | |
| EP | 3628851 | A1 | 4/2020 | |
| EP | 3789671 | A1 | 3/2021 | |
| EP | 3789676 | B1 | 6/2021 | |
| GB | 273032 | A | 6/1927 | |
| GB | 323186 | A | 12/1929 | |
| GB | 371779 | A | 4/1932 | |
| GB | 376143 | A | 7/1932 | |
| GB | 671597 | A | 5/1952 | |

(56) References Cited

FOREIGN PATENT DOCUMENTS

| | | | |
|---|---|---|---|
| GB | 1588057 | A | 4/1981 |
| GB | 2542678 | A | 3/2017 |
| JP | 2007255821 | A | 4/2007 |
| JP | 2008002782 | A | 1/2008 |
| JP | 2012137250 | A | 7/2012 |
| JP | 2016223758 | A | 12/2016 |
| KR | 101149359 | B1 | 5/2012 |
| KR | 20180076519 | A | 7/2018 |
| RU | 2066816 | C1 | 9/1996 |
| RU | 2518772 | C1 | 6/2014 |
| RU | 2015141253 | A | 4/2017 |
| SE | 443798 | B * | 3/1986 |
| SU | 1755005 | A1 | 8/1992 |
| WO | 8603141 | A1 | 6/1986 |
| WO | 2005105315 | A1 | 11/2005 |
| WO | 2009050126 | A1 | 4/2009 |
| WO | 2017205884 | A2 | 12/2017 |
| WO | 2019145854 | A1 | 8/2019 |

OTHER PUBLICATIONS

Translation of SE 443798 B (Year: 1986).*

European Search Report dated Apr. 24, 2020, in connection with European Patent Application No. 19195118.5, filed Sep. 3, 2019, 8 pgs (including translation).

European Search Report dated Apr. 22, 2020, in connection with European Patent Application No. 19210080.8, filed Nov. 19, 2019, 8 pgs (including translation).

European Search Report dated Jun. 23, 2020, in connection with European Patent Application No. 19210444.6, filed Nov. 20, 2019, 8 pgs (including translation).

Decision to Grant dated May 28, 2021, in connection with European Patent Application No. 19210080.8, filed Nov. 19, 2019, 3 pgs. (including translation).

Communication pursuant to Article 94 (3) EPC dated Februay 9,2021, in connection with European Patent Application No. 20194307.3, filed Sep. 3, 2020, 6 pgs. (including translation).

European Search Report dated Jan. 28, 2021, in connection with European Patent Application No. 20194307.3, filed Sep. 3, 2020, 8 pgs. (including translation).

Communication pursuant to Article 94 (3) EPC dated Mar. 11, 2021, in connection with European Patent Application No. 19210080.8, filed Nov. 19, 2019, 8 pgs. (including translation).

Communication pursuant to Article 94 (3) EPC dated Jun. 8, 2021, in connection with European Patent Application No. 19210080.8, filed Nov. 19, 2019, 8 pgs. (including translation).

English translation of First folder of ETA Heiztechnik GmbH, "ETA HACK bis 200 kW" (The benchmark for safe fuel delivery), www.eta.co.at, 20 pgs, previously disclosed in Information Disclosure Statement filed Mar. 2, 2022.

English translation of Second folder of ETA Heiztechnik GmbH, "ETA HACK bis 200 kW" (The benchmark for safe fuel delivery), www.eta.co.at, 20 pgs, previously disclosed in Information Disclosure Statement filed Mar. 2, 2022.

English translation of Excerpt of German dictionary "DUDEN", 7th edition to "Einheit" ("unit"), 3 pgs, previously disclosed in Information Disclosure Statement filed Mar. 2, 2022.

European Search Report dated Jun. 2, 2022 in connection with European Patent Application No. 21218434.5, 4 pgs (including translation).

International Search Report and Written Opinion dated Nov. 27, 2020, in connection with International Patent Application No. PCT/EP2020/074596, filed Sep. 3, 2020, 15 pgs. (including translation).

Excerpt of German dictionary "DUDEN", 7th edition to "Einheit" ("unit"), 3 pgs. (Translation unavailable at this time).

First folder of ETA Heiztechnik GmbH, "ETA HACK 20 bis 200 kW" (The benchmark for safe fuel delivery), www.eta.co.at, 20 pgs. (translation not available at this time).

Second folder of ETA Heiztechnik GmbH, "ETA HACK 20 bis 200 kW" (The benchmark for safe fuel delivery), www.eta.co.at, 20 pgs. (translation not available at this time).

International Search Report and Written Opinion dated Dec. 2, 2020, in connection with International Patent Application No. PCT/EP2020/074584, filed Sep. 3, 2020, 10 pgs. (including translation).

International Search Report and Written Opinion dated Dec. 2, 2020, in connection with International Patent Application No. PCT/EP2020/074583, filed Sep. 3, 2020, 12 pgs. (including translation).

International Search Report and Written Opinion dated Dec. 2, 2020, in connection with International Patent Application No. PCT/EP2020/074587, filed Sep. 3, 2020, 12 pgs. (including translation).

Oswald et al., "Advanced control with economic—ecological optimization for biomass-fired boilers", Proceedings of the 15th International Carpathian Control Conference, 2014, pp. 407-412.

European Search Repod dated Aug. 1, 2022, in connection with European Patent Application No. 21218435.2, 14 pgs. (including translation).

Notification of Grant and Search Report dated Jul. 26, 2022, in connection with Russian Patent Application No. 2022105851/12, 22 pgs (including translation).

Notification of Reasons for Rejection dated Jul. 26, 2022 in connection with Japanese Patent Application No. 2022-528202, 11 pgs. (including translation).

Notification of Reasons for Rejection dated Jul. 26, 2022 in connection with Japanese Patent Application No. 2022-528203, 10 pgs. (including translation).

Notice of Allowance and Issue Fee(s) due dated Jan. 4, 2023 in connection with U.S. Appl. No. 17/753,433, filed Mar. 2, 2022, 11 pgs.

Notification of Reasons for Rejection dated Nov. 1, 2022 in connection with Japanese Patent Application No. 2022-528202, 12 pgs. (including translation).

Non-Final Office Action dated Oct. 26, 2022 in connection with U.S. Appl. No. 17/753,397, filed Mar. 2, 2022, 46 pgs.

First Office Action dated Sep. 30, 2022 in connection with Chinese Patent Application No. 2020800746538, 10 pgs. (including translation).

Office Action dated Oct. 17, 2022 in connection with Russian Patent Application No. 2022105850, filed Sep. 3, 2020, 10 pgs. (including translation).

Office Action dated Jan. 24, 2023 in connection with U.S. Appl. No. 17/753,430, filed Mar. 2, 2022, 11 pages.

Non-Final Office Action dated Mar. 16, 2023 in connection with U.S. Appl. No. 17/753,397, filed Mar. 2, 2022, 36 pgs.

* cited by examiner

BIOMASS HEATING SYSTEM WITH OPTIMIZED FLUE GAS TREATMENT

CROSS-REFERENCE TO RELATED APPLICATIONS

This application is a national stage of International Patent Application Serial No. PCT/EP2020/074584, filed Sep. 3, 2020, which claims priority to European Patent Application No. 19195118.5, filed Sep. 3, 2019; European Patent Application No. 19210080.8, filed Nov. 19, 2019; and European Patent Application No. 19210444.6, filed Nov. 20, 2019, the disclosures of all are incorporated herein by reference in their entirety.

TECHNICAL FIELD

The invention relates to a biomass heating system with optimized flue gas treatment.

In particular, the invention relates to a recirculation device for a biomass heating system with at least one mixing chamber, as well as a flue gas condenser and a transition screw.

STATE OF THE ART

Biomass heating systems, especially biomass boilers, in a power range from 20 to 500 kW are known. Biomass can be considered a cheap, domestic, crisis-proof and environmentally friendly fuel. Combustible biomass or biogenic solid fuels include wood chips or pellets.

The pellets are usually made of wood chips, sawdust, biomass or other materials that have been compressed into small discs or cylinders with a diameter of approximately 3 to 15 mm and a length of 5 to 30 mm. Wood chips (also referred to as wood shavings, wood chips or wood chips) is wood shredded with cutting tools.

Biomass heating systems for fuels in the form of pellets and wood chips essentially feature a boiler with a combustion chamber (the combustion chamber) and with a heat exchange device connected to it. Due to stricter legal regulations in many countries, some biomass heating systems also feature a fine dust filter. Other various accessories are usually present, such as fuel delivery devices, control devices, probes, safety thermostats, pressure switches, a flue gas or exhaust gas recirculation system, a boiler cleaning system, and a separate fuel tank.

The combustion chamber regularly includes a device for supplying fuel, a device for supplying air and an ignition device for the fuel. The device for supplying the air, in turn, usually features a low-pressure blower to advantageously influence the thermodynamic factors during combustion in the combustion chamber. A device for feeding fuel can be provided, for example, with a lateral insertion (so-called cross-insertion firing). In this process, the fuel is fed into the combustion chamber from the side via a screw or piston.

The combustion chamber of a fixed-bed furnace further typically includes a combustion grate on which fuel is substantially continuously fed and burned. This combustion grate stores the fuel for combustion and has openings, such as slots, that allow passage of a portion of the combustion air as primary air to the fuel. Furthermore, the grate can be unmovable or movable. In addition, there are grate furnaces, where the combustion air is supplied not through the grate, but only from the side.

When the primary air flows through the grate, the grate is also cooled, among other things, which protects the material.

In addition, slag may form on the grate if the air supply is inadequate. In particular, furnaces that are to be fed with different fuels, with which the present disclosure is particularly concerned, have the inherent problem that the different fuels have different ash melting points, water contents and different combustion behavior. This makes it problematic to provide a heating system that is equally well suited for different fuels. The combustion chamber can be further regularly divided into a primary combustion zone (immediate combustion of the fuel on the grate as well as in the gas space above it before a further supply of combustion air) and a secondary combustion zone (post-combustion zone of the flue gas after a further supply of air). In the combustion chamber, drying, pyrolytic decomposition and gasification of the fuel and charcoal burnout take place. In order to completely burn the resulting combustible gases, additional combustion air is also introduced in one or more stages (secondary air or tertiary air) at the start of the secondary combustion zone.

After drying, the combustion of the pellets or wood chips has two main phases. In the first phase, the fuel is pyrolytically decomposed and converted into gas by high temperatures and air, which can be injected into the combustion chamber, and at least partially. In the second phase, combustion of the (in)part converted into gas occurs, as well as combustion of any remaining solids (for example, charcoal). In this respect, the fuel outgasses, and the resulting gas and the charcoal present in it are co-combusted.

Pyrolysis is the thermal decomposition of a solid substance in the absence of oxygen. Pyrolysis can be divided into primary and secondary pyrolysis. The products of primary pyrolysis are pyrolysis coke and pyrolysis gases, and pyrolysis gases can be divided into gases that can be condensed at room temperature and gases that cannot be condensed. Primary pyrolysis takes place at roughly 250-450° C. and secondary pyrolysis at about 450-600° C. The secondary pyrolysis that occurs subsequently is based on the further reaction of the pyrolysis products formed primarily. Drying and pyrolysis take place at least largely without the use of air, since volatile CH compounds escape from the particle and therefore no air reaches the particle surface. Gasification can be seen as part of oxidation; it is the solid, liquid and gaseous products formed during pyrolytic decomposition that are brought into reaction by further application of heat. This is done by adding a gasification agent such as air, oxygen, water vapor, or even carbon dioxide. The lambda value during gasification is greater than zero and less than one. Gasification takes place at around 300 to 850° C. or even up to 1,200° C. Complete oxidation with excess air (lambda greater than 1) takes place subsequently by further addition of air to these processes. The reaction end products are essentially carbon dioxide, water vapor and ash. In all phases, the boundaries are not rigid but fluid. The combustion process can be advantageously controlled by means of a lambda probe provided at the exhaust gas outlet of the boiler.

In general terms, the efficiency of combustion is increased by converting the pellets into gas, because gaseous fuel is better mixed with the combustion air and thus more completely converted, and a lower emission of pollutants, less unburned particles and ash (fly ash or dust particles) are produced.

The combustion of biomass produces gaseous or airborne combustion products whose main components are carbon, hydrogen and oxygen. These can be divided into emissions from complete oxidation, from incomplete oxidation and substances from trace elements or impurities. Emissions from complete oxidation are mainly carbon dioxide (cot) and water vapor (H2O). The formation of carbon dioxide from the carbon of biomass is the goal of combustion, as this allows the energy released to be used more fully. The release of carbon dioxide (cot) is largely proportional to the carbon content of the amount of fuel burned; thus, the carbon dioxide is also dependent on the useful energy to be provided. A reduction can essentially only be achieved by improving efficiency. Combustion residues, such as ash or slag, are also produced.

However, the complex combustion processes described above are not easy to control. In general terms, there is a need for improvement in the combustion processes in biomass heating systems.

In addition to the air supply to the combustion chamber, flue gas or exhaust gas recirculation devices are also known which return exhaust gas from the boiler to the combustion chamber for cooling and recombustion. In the prior art, there are usually openings in the combustion chamber for the supply of primary air through a primary air duct feeding the combustion chamber, and there are also circumferential openings in the combustion chamber for the supply of secondary air from a secondary air duct or possibly of fresh air. Flue gas recirculation can take place under or above the grate. In addition, the flue gas recirculation can be mixed with the combustion air or performed separately.

The flue gas or exhaust gas from combustion in the combustion chamber is fed to the heat exchanger so that the hot combustion gases flow through the heat exchanger to transfer heat to a heat exchange medium, which is usually water at about 80° C. (usually between 70° C. and 110° C.). The boiler usually has a radiation section integrated into the combustion chamber and a convection section/radiation part (the heat exchanger connected to it).

The ignition device is usually a hot air device or an annealing device. In the first case, combustion is initiated by supplying hot air to the combustion chamber, with the hot air being heated by an electrical resistor. In the second case, the ignition device has a glow plug/glow rod or multiple glow plugs to heat the pellets or wood chips by direct contact until combustion begins. The glow plugs may also be equipped with a motor to remain in contact with the pellets or wood chips during the ignition phase, and then retract so as not to remain exposed to the flames. This solution is prone to wear and is costly.

Basically, the problems with conventional biomass heating systems are that the gaseous or solid emissions are too high, the efficiency is too low, and the dust emissions are too high. Another problem is the varying quality of the fuel, due to the varying water content and the lumpiness of the fuel, which makes it difficult to burn the fuel evenly with low emissions. Especially for biomass heating systems, which are supposed to be suitable for different types of biological or biogenic fuel, the varying quality and consistency of the fuel makes it difficult to maintain a consistently high efficiency of the biomass heating system. There is considerable need for optimization in this respect.

A disadvantage of conventional biomass heating systems for pellets may be that pellets falling into the combustion chamber may roll or slide out of the grate or off the grate, or may land next to the grate and enter an area of the combustion chamber where the temperature is lower or where the air supply is poor, or they may even fall into the bottom chamber of the boiler or the ash chute. Pellets that do not remain on the grate or grate burn incompletely, causing poor efficiency, excessive ash and a certain amount of unburned pollutant particles. This applies to pellets as well as wood chips.

For this reason, the known biomass heating systems for pellets have baffle plates, for example, in the vicinity of the grate or grate and/or the outlet of the combustion gas, in order to retain fuel elements in certain locations. Some boilers have heels on the inside of the combustion chamber to prevent pellets from falling into the ash removal/ash discharge or/and the bottom chamber of the boiler. However, combustion residues can in turn become trapped in these baffles and offsets, which makes cleaning more difficult and can impede air flows in the combustion chamber, which in turn reduces efficiency. In addition, these baffle plates require their own manufacturing and assembly effort. This applies to pellets as well as wood chips.

Biomass heating systems for pellets or wood chips have the following additional disadvantages and problems.

One problem is that incomplete combustion, as a result of non-uniform distribution of fuel from the grate and as a result of non-optimal mixing of air and fuel, favors the accumulation and falling of unburned ash through the air inlet openings leading directly onto the combustion grate or from the grate end into the air ducts or air supply area.

This is particularly disruptive and causes frequent interruptions to perform maintenance tasks such as cleaning. For all these reasons, a large excess of air is normally maintained in the combustion chamber, but this decreases the flame temperature and combustion efficiency, and results in increased emissions of unburned gases (e.g. CO, CyHy), NOx and dust (e.g. due to increased swirling).

The use of a blower with a low pressure head does not provide a suitable vortex flow of air in the combustion chamber and therefore does not allow an optimal mixing of air and fuel. In general, it is difficult to form an optimum vortex flow in conventional combustion chambers.

Another problem with the known burners without air staging is that the two phases, conversion of the pellets into gas and combustion, take place simultaneously in the entire combustion chamber by means of the same amount of air, which reduces efficiency.

Furthermore, there is a particular need for optimization of the heat exchangers of state-of-the-art biomass heating systems, i.e. their efficiency could be increased. There is also a need for improvement regarding the often cumbersome and inefficient cleaning of conventional heat exchangers.

The same applies to the usual electrostatic precipitators/filters of biomass heating systems. Their spray and also separator electrodes regularly get clogged with combustion residues, which worsens the formation of the electric field for filtration and reduces the efficiency of filtration.

It can be a task of the invention to provide a biomass heating system in hybrid technology, which is low in emissions (especially with regard to fine dust, CO, hydrocarbons, NOx), which can be operated with wood chips and pellets in a fuel-flexible manner, and which has a high efficiency, and which possibly has an optimized flue gas treatment.

In accordance with the invention and in addition, the following considerations may play a role:

The hybrid technology should allow the use of both pellets and wood chips with water contents between 8 and 35 percent by weight.

The lowest possible gaseous emissions (less than 50 or 100 mg/Nm$^3$ based on dry flue gas and 13 volume percent O2) are to be achieved.

Very low dust emissions of less than 15 mg/Nm$^3$ without and less than 5 mg/Nm$^3$ with electrostatic precipitator operation are targeted.

A high efficiency of up to 98% (based on the supplied fuel energy (calorific value) is to be achieved.

Further, one can take into account that the operation of the system should be optimized. For example, it should allow easy ash removal/discharge, easy cleaning, or easy maintenance.

In addition, there should be a high level of system availability.

In this context, the above-mentioned task(s) or potential individual problems can also relate to individual sub-aspects of the overall system, for example to the combustion chamber, the heat exchanger or the flue gas condenser.

Optimized flue gas treatment refers to all those measures that improve the flue gas or combustion. This may include, for example, measures that make the biomass heating system less emission-intensive, more energy-efficient, or less costly, and that involve fluidic and/or physical treatment of the flue gas. The generic term flue gas treatment also includes, for example, flue gas condensation, which is explained later, or flue gas recirculation, which is also explained later.

The above-mentioned task(s) is/are solved by the objects of the independent claims. Further aspects and advantageous further embodiments are the subject of the dependent claims.

According to an aspect of the present disclosure, a biomass heating system is provided for firing fuel in the form of pellets and/or wood chips, the plant comprising: a boiler having a combustion device; a heat exchanger having an inlet and an outlet; the combustion device comprising a combustion chamber having a primary combustion zone and a secondary combustion zone provided downstream thereof; the combustion device comprising a rotating grate on which the fuel can be fired; the secondary combustion zone of the combustion chamber being fluidly connected to the inlet of the heat exchanger; the primary combustion zone being laterally enclosed by a plurality of combustion chamber bricks.

The advantages of this configuration and also of the following aspects will be apparent from the following description of the associated embodiments.

According to a further development of the preceding aspect, there is provided a biomass heating system further comprising: a recirculation device for recirculating a flue gas generated upon combustion of the fuel in the combustion device; wherein the recirculation device comprises: a recirculation inlet provided downstream of and fluidly connected to the outlet of the heat exchanger; and a primary air passage for supplying primary air; a primary mixing unit having a primary mixing chamber and a primary mixing passage, the primary mixing chamber being provided downstream of and fluidly connected to the recirculation inlet and the primary air passage; and at least two air valves provided on the inlet side of the primary mixing chamber; and a primary passage into the primary combustion zone provided downstream to the primary mixing duct and fluidically connected thereto; wherein the primary passage is provided upstream to the rotating grate; wherein the primary mixing unit is adapted to mix the flue gas from the recirculation inlet with the primary air from the primary air duct by means of the at least two air valves of the primary mixing chamber.

According to a further aspect of the preceding aspect, a biomass heating system is provided, wherein the primary mixing duct is directly connected to a primary mixing chamber outlet of the primary mixing chamber, and the primary mixing duct is provided downstream to the primary mixing chamber.

According to a further embodiment of the preceding aspect, a biomass heating system is provided wherein the primary mixing duct extends in a straight line and has a minimum length of 700 mm from beginning to end.

According to a further embodiment of the preceding aspect, a biomass heating system is provided, wherein the air valves of the primary mixing chamber are gate valves.

According to a further aspect of the preceding aspect, biomass heating system is provided further comprising the following: the primary mixing chamber has a primary mixing chamber outlet on the outlet side and; the primary mixing chamber has at least two valve passage openings on the inlet side; and the primary mixing chamber is arranged such that the at least two valve passage openings and the primary mixing chamber outlet do not face each other through the primary mixing chamber, so that the flows entering the primary mixing chamber through the at least two valve passage openings are deflected or redirected in the primary mixing chamber.

According to a further aspect of the preceding aspect, a biomass heating system is provided, wherein the recirculation device further comprises the following: a secondary air duct for supplying secondary air; a secondary mixing unit having a secondary mixing chamber and a secondary mixing duct, the secondary mixing chamber being provided downstream of and fluidically connected to the recirculation inlet and the secondary air duct; and at least two air valves provided upstream of the secondary mixing chamber; and secondary air nozzles which are provided in the combustion chamber bricks and which are directed laterally into the primary combustion zone, and which are provided downstream of and fluidically connected to the secondary mixing duct; the secondary mixing unit being arranged to mix the flue gas from the recirculation inlet with the secondary air from the secondary air duct by means of the at least two air valves of the secondary mixing chamber.

According to a further development of the preceding aspect, a biomass heating system is provided, the recirculation device further comprising: a secondary air duct for supplying secondary air; a secondary tempering duct, the secondary tempering duct being provided downstream of and fluidly connected to the secondary air duct; and at least one air valve provided upstream of the secondary tempering duct between the secondary tempering duct and the secondary air duct; and secondary air nozzles provided in the combustion chamber bricks and directed laterally into the combustion chamber, and provided downstream of and fluidly connected to the secondary tempering duct; wherein the secondary tempering duct is adapted to heat the flue gas before it enters the combustion chamber.

According to a further development of the preceding aspect, there is provided a biomass heating system further comprising: an electrostatic filter means for filtering the flue gas; a flue gas condenser provided downstream of and fluidly connected to the electrostatic filter means; wherein: the flue gas condenser has a first fluid port and a second fluid port for flowing a heat exchange medium to the flue gas condenser; and the flue gas condenser has a plurality of U-shaped heat exchange tubes, the plurality of U-shaped heat exchange tubes being arranged in groups parallel to each other in a first direction; wherein said groups of said heat exchanger tubes are arranged in parallel with each other in a second direction; wherein said groups of said heat exchanger tubes are fluidically connected to each other in series between said fluid port and said second fluid port; said plurality of said U-shaped heat exchanger tubes are arranged to form a cross-counterflow configuration with respect to the flow of said flue gas through said plurality of heat exchanger tubes.

According to a further development of the preceding aspect, a biomass heating system is provided, wherein the plurality of U-shaped heat exchanger tubes are arranged such that they form fluidically continuous lanes in the second direction for the flue gas to flow therethrough, the lanes having a minimum width SP2 (in the first direction) of 6.0 mm+−2 mm.

According to a further aspect of the preceding aspect, a biomass heating system is provided, wherein: the ends of all U-shaped heat exchanger tubes are arranged accommodated in a plate-shaped tube sheet member; and a number of from 7 to 12, preferably from 8 to 10, heat exchanger tubes 493 are each arranged as a group in the first direction; a number of from 8 to 14, preferably from 10 to 12, groups of heat exchanger tubes 493 are arranged in the second direction.

According to a further development of the preceding aspect, a biomass heating system is provided, wherein the U-shaped heat exchanger tubes have a maximum length of 421 mm+−50 mm; and/or are made of the material 1.4462 (in the version of the definition of this material valid on the filing date of this application).

According to a further aspect of the preceding aspect, there is provided a biomass heating system further comprising: an ash discharge screw for conveying combustion residues out of the boiler; wherein the ash discharge screw comprises a transition screw rotatably received in a transition screw housing and having a counter-rotation.

According to a further embodiment of the preceding aspect, a biomass heating system is provided wherein the combustion residues in the transition screw housing are compacted upon rotation of the ash discharge screw such that the combustion residues between the combustion chamber and the outlet of the heat exchanger are at least substantially separated or sealed in a gas-tight manner with respect to the flue gas.

According to a further embodiment of the preceding aspect, a biomass heating system is provided, wherein the transition screw housing has an upwardly open opening that is encompassed/enclosed by a hopper element, and the counter-rotation of the transition screw is arranged such that the combustion residues are discharged upwardly from the opening upon rotation of the ash discharge screw.

According to a further embodiment of the preceding aspect, a biomass heating system is provided wherein the ash discharge screw has a larger diameter on one side of the transition screw than on the other side of the transition screw.

"Horizontal" in this context may refer to a flat orientation of an axis or a cross-section on the assumption that the boiler is also installed horizontally, whereby the ground level may be the reference, for example. Alternatively, "horizontal" as used herein may mean "parallel" to the base plane of the boiler as this is commonly defined. Further alternatively, especially in the absence of a reference plane, "horizontal" may be understood to mean merely "parallel" to the combustion plane of the grate.

Although all of the foregoing individual features and details of an aspect of the invention and embodiments of that aspect are described in connection with the biomass heating system and the recirculation device, those individual features and details are also disclosed as such independently of the biomass heating system.

In particular, a flue gas recirculation device, a transition screw, a primary mixing unit, a secondary mixing unit, and a flue gas condenser are described independently of the biomass heating system and can be claimed independently accordingly.

In this respect, a recirculation device for recirculating a flue gas generated upon combustion of the fuel in a combustion device is additionally disclosed, the recirculation device comprising the following: a recirculation inlet adapted to be provided downstream of and fluidly connected to the outlet of the heat exchanger; and a primary air passage for supplying primary air; a primary mixing unit having a primary mixing chamber and a primary mixing passage, the primary mixing chamber being provided downstream of and fluidly connected to the recirculation inlet and the primary air passage; and at least two air valves provided at the inlet side of the primary mixing chamber; and a primary passage into the primary combustion zone provided downstream of and fluidically connected to the primary mixing duct; wherein the primary mixing unit is adapted to mix the flue gas from the recirculation inlet with the primary air from the primary air duct by means of the at least two air valves of the primary mixing chamber.

This recirculation device may be combined with other aspects and individual features of the present disclosure disclosed herein as the skilled person deems technically feasible.

The option of flue gas recirculation can be either only as flue gas recirculation under grate with the primary air or also as flue gas recirculation under and above grate (i.e., with primary and secondary air). Flue gas recirculation via grate serves for improved mixing and temperature control in the combustion chamber and combustion chamber bricks. The flue gas recirculation under grate is also used for temperature control (but here for fuel bed temperature control) and can influence the burn-up time of the fuel bed, which can compensate or reduce differences between e.g. wood chips and pellets.

There is further disclosed a flue gas condenser connectable to an exhaust gas outlet of a boiler; wherein: said flue gas condenser having a first fluid port and a second fluid port for flowing a heat exchange medium to said flue gas condenser; and said flue gas condenser having a plurality of U-shaped heat exchange tubes, said plurality of U-shaped heat exchange tubes being arranged in groups parallel to each other in a first direction; wherein said groups of said heat exchanger tubes are arranged in parallel with each other in a second direction; wherein said groups of said heat exchanger tubes are fluidically connected to each other in series between said fluid port and said second fluid port; said plurality of said U-shaped heat exchanger tubes are arranged to form a cross-counterflow configuration with respect to the flow of said flue gas through said plurality of heat exchanger tubes.

This flue gas condenser may be combined with other aspects and individual features disclosed herein as the skilled person deems technically feasible. In particular, an advantageous combination of flue gas condenser and electrical filter device is disclosed.

Further disclosed is an ash discharge screw for conveying combustion residues from a boiler of a biomass heating system; said ash discharge screw comprising a transition screw rotatably received in a transition screw housing and having a counter-rotation.

This ash discharge screw may be combined with other aspects and individual features disclosed herein as the skilled person deems technically feasible.

BRIEF DESCRIPTION OF THE DRAWINGS

The biomass heating system according to the invention is explained in more detail below in embodiment examples and individual aspects based on the figures in the drawing.

DESCRIPTION OF EXEMPLARY EMBODIMENTS

Figure 1:
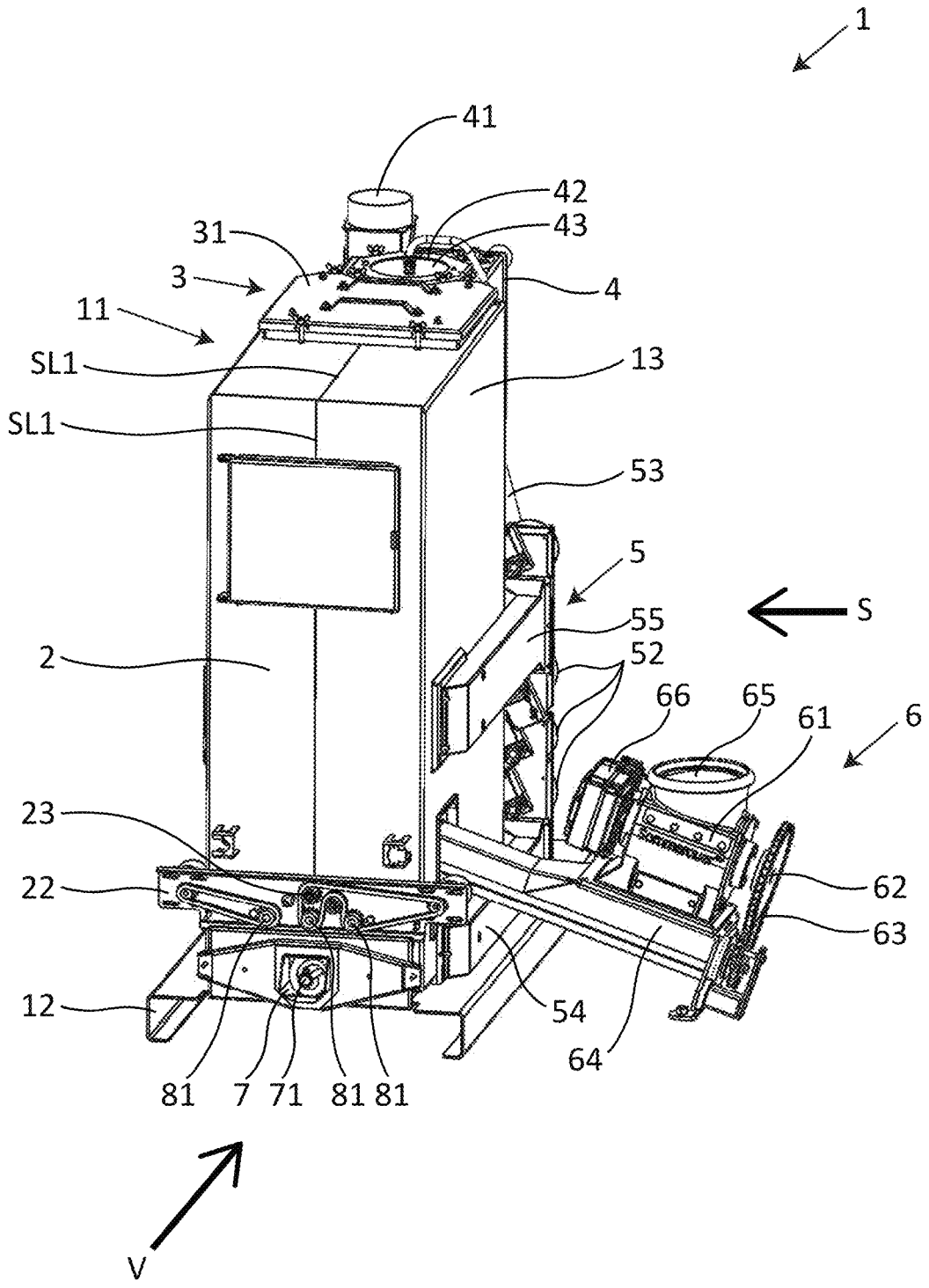
FIG. 1 shows a three-dimensional overview view of a biomass heating system according to one embodiment of the invention.

In the following, various embodiments of the present disclosure are disclosed with reference to the accompanying drawings by way of example only. However, embodiments and terms used therein are not intended to limit the present disclosure to particular embodiments and should be construed to include various modifications, equivalents, and/or alternatives in accordance with embodiments of the present disclosure.

Should more general terms be used in the description for features or elements shown in the figures, it is intended that for the person skilled in the art not only the specific feature or element is disclosed in the figures, but also the more general technical teaching.

With reference to the description of the figures the same reference signs may be used in each figure to refer to similar or technically corresponding elements. Furthermore, for the sake of clarity, more elements or features can be shown with reference signs in individual detail or section views than in the overview views. It can be assumed that these elements or features are also disclosed accordingly in the overview presentations, even if they are not explicitly listed there.

It should be understood that a singular form of a noun corresponding to an object may include one or more of the things, unless the context in question clearly indicates otherwise.

In the present disclosure, an expression such as "A or B", "at least one of" A or/and B", or "one or more of A or/and B" may include all possible combinations of features listed together. Expressions such as "first," "second," "primary," or "secondary" used herein may represent different elements regardless of their order and/or meaning and do not limit corresponding elements. When an element (e.g., a first element) is described as being "operably" or "communicatively" coupled or connected to another element (e.g., a second element), the element may be directly connected to the other element or may be connected to the other element via another element (e.g., a third element).

For example, a term "configured to" (or "set up") used in the present disclosure may be replaced with "suitable for," "adapted to," "made to," "capable of," or "designed to," as technically possible. Alternatively, in a particular situation, an expression "device configured to" or "set up to" may mean that the device can operate in conjunction with another device or component, or perform a corresponding function.

All size specifications, which are given in "mm", are to be understood as a size range of +−1 mm around the specified value, unless another tolerance or other ranges are explicitly specified.

It should be noted that the present individual aspects, for example, the rotating grate, the combustion chamber, or the filter device are disclosed separately from or apart from the biomass heating system herein as individual parts or individual devices. It is thus clear to the person skilled in the art that individual aspects or system parts are also disclosed herein even in isolation. In the present case, the individual aspects or parts of the system are disclosed in particular in the subchapters marked by brackets. It is envisaged that these individual aspects can also be claimed separately.

Further, for the sake of clarity, not all features and elements are individually designated in the figures, especially if they are repeated. Rather, the elements and features are each designated by way of example. Analog or equal elements are then to be understood as such. This applies, for example, to the insertion direction of FIG. 16*a*.

(Biomass Heating System)

FIG. 1 shows a three-dimensional overview view of the biomass heating system 1 according to one embodiment of the invention.

In the figures, the arrow V denotes the front view of the system 1, and the arrow S denotes the side view of the system 1 in the figures.

The biomass heating system 1 has a boiler 11 supported on a boiler base 12. The boiler 11 has a boiler housing 13, for example made of sheet steel.

In the front part of the boiler 11 there is a combustion device 2 (not shown), which can be reached via a first maintenance opening with a shutter 21. A rotary mechanism mount 22 for a rotating grate 25 (not shown) supports a rotary mechanism 23, which can be used to transmit drive forces to bearing axles 81 of the rotating grate 25.

In the central part of the boiler 11 there is a heat exchanger 3 (not shown), which can be reached from above via a second maintenance opening with a shutter 31.

In the rear of the boiler 11 is an optional filter device 4 (not shown) with an electrode 44 (not shown) suspended by an insulating electrode support/holder 43, which is energized by an electrode supply line 42. The exhaust gas of the biomass heating system 1 is discharged via an exhaust gas outlet 41, which is arranged (fluidically) downstream of the filter device 4. A fan may be provided here.

A recirculation device 5 is provided downstream of boiler 11 to recirculate a portion of the flue or exhaust gas through recirculation ducts 51, 53 and 54 and flaps 52 for cooling the combustion process and reuse in the combustion process. This recirculation device 5 will be explained in detail later with reference to FIGS. 12 to 17.

Further, the biomass heating system 1 has a fuel supply 6 by which the fuel is conveyed in a controlled manner to the combustion device 2 in the primary combustion zone 26 from the side onto the rotating grate 25. The fuel supply 6 has a rotary valve 61 with a fuel supply opening/port 65, the rotary valve 61 having a drive motor 66 with control electronics. An axle 62 driven by the drive motor 66 drives a translation mechanism 63, which can drive a fuel feed screw 67 (not shown) so that fuel is fed to the combustion device 2 in a fuel feed duct 64.

In the lower part of the biomass heating system 1, an ash removal/discharge device 7 is provided, which has an ash discharge screw 71 in an ash discharge duct operated by a motor 72.

Figure 2:
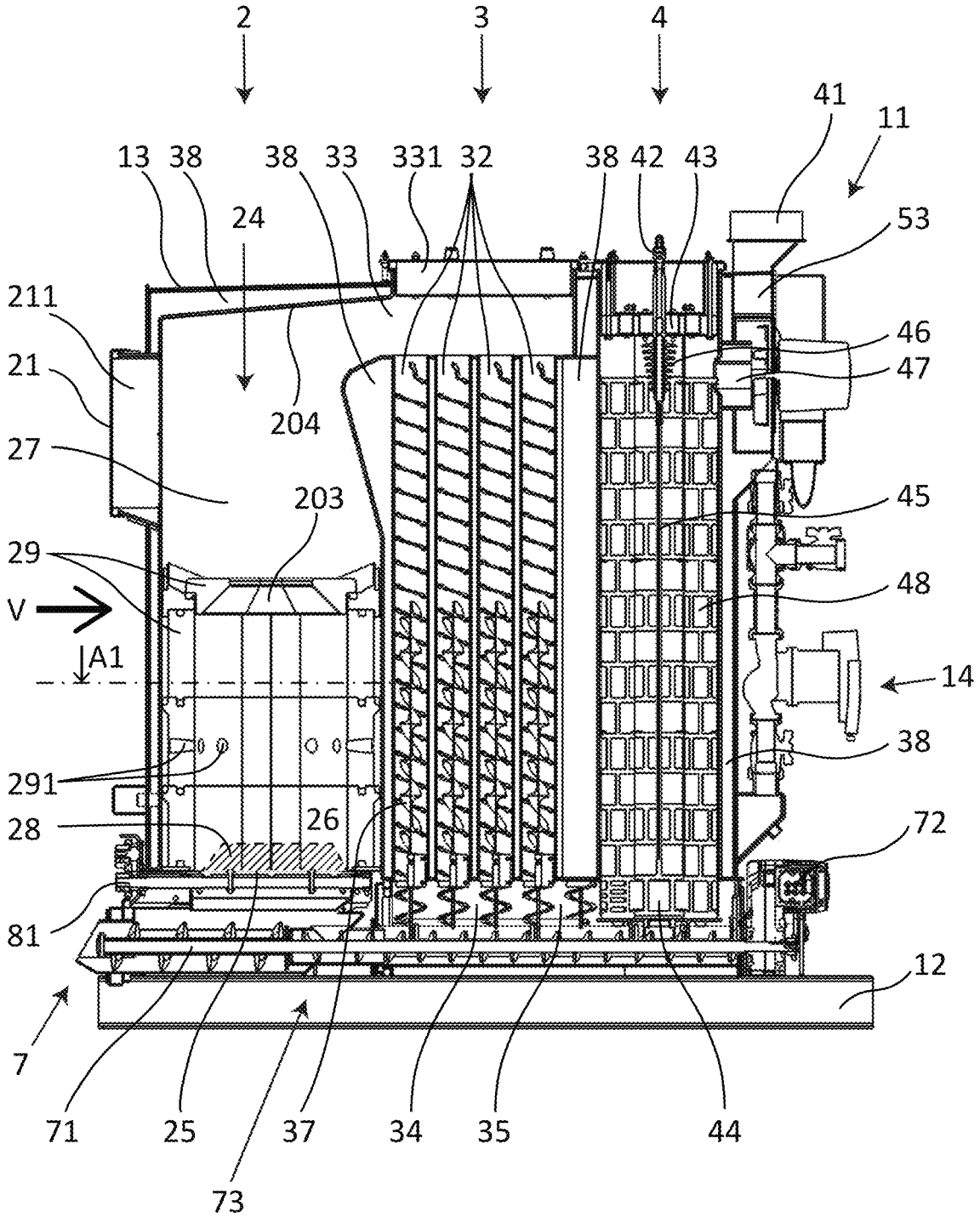
FIG. 2 shows a cross-sectional view through the biomass heating system of FIG. 1, which was made along a section line SL1 and which is shown as viewed from the side view S.

FIG. 2 now shows a cross-sectional view through the biomass heating system 1 of FIG. 1, which has been made along a section line SL1 and which is shown as viewed from the side view S. In the corresponding FIG. 3, which shows the same section as FIG. 2, the flows of the flue gas, and fluidic cross-sections are shown schematically for clarity. With regard to FIG. 3, it should be noted that individual areas are shown dimmed in comparison to FIG. 2. This is only for clarity of FIG. 3 and visibility of flow arrows S5, S6 and S7.

From left to right, FIG. 2 shows the combustion device 2, the heat exchanger 3 and an (optional) filter device 4 of the boiler 11. The boiler 11 is supported on the boiler base/foot 12, and has a multi-walled boiler housing 13 in which water or other fluid heat exchange medium can circulate. A water circulation device 14 with pump, valves, pipes, tubes, etc. is provided for supplying and discharging the heat exchange medium.

The combustion device 2 has a combustion chamber 24 in which the combustion process of the fuel takes place in the core. The combustion chamber 24 has a multi-piece rotating grate 25, explained in more detail later, on which the fuel bed 28 rests. The multi-part rotating grate 25 is rotatably mounted by means of a plurality of bearing axles 81.

Further referring to FIG. 2, the primary combustion zone 26 of the combustion chamber 24 is enclosed by (a plurality of) combustion chamber brick(s) 29, whereby the combustion chamber bricks 29 define the geometry of the primary combustion zone 26. The cross-section of the primary combustion zone 26 (for example) along the horizontal section line A1 is substantially oval (for example 380 mm+−60 mm×320 mm+−60 mm; it should be noted that some of the above size combinations may also result in a circular cross-section). The arrow S1 schematically represents the flow from the secondary air nozzle 291, this flow (this is purely schematic) having a swirl induced by the secondary air nozzles 291 to improve the mixing of the flue gas.

The secondary air nozzles 291 are designed in such a way that they introduce the secondary air (preheated by the combustion chamber bricks 29) tangentially into the combustion chamber 24 with its oval cross-section. This creates a vortex or swirl-like flow S1, which runs roughly upwards in a spiral or helix shape. In other words, a spiral flow is formed that runs upward and rotates about a vertical axis.

The secondary air nozzles 291 are thus oriented in such a way that they introduce the secondary air—viewed in the horizontal plane—tangentially into the combustion chamber 24. In other words, the secondary air nozzles 291 are each provided as an inlet for secondary air not directed toward the center of the combustion chamber. Incidentally, such a tangential inlet can also be used with a circular combustion chamber geometry.

Here, all secondary air nozzles 291 are oriented such that they each provide either a clockwise flow or a counterclockwise flow. In this respect, each secondary air nozzle 291 may contribute to the creation of the vortex flows, with each secondary air nozzle 291 having a similar orientation. With respect to the foregoing, it should be noted that in exceptional cases individual secondary air nozzles 291 may also be arranged in a neutral orientation (with orientation toward the center) or in an opposite orientation (with opposite orientation), although this may worsen the fluidic efficiency of the arrangement.

The combustion chamber bricks 29 form the inner lining of the primary combustion zone 26, store heat and are directly exposed to the fire. Thus, the combustion chamber bricks 29 also protect the other material of the combustion chamber 24, such as cast iron, from direct flame exposure in the combustion chamber 24. The combustion chamber bricks 29 are preferably adapted to the shape of the grate 25. The combustion chamber bricks 29 further include secondary air or recirculation nozzles 291 that recirculate the flue gas into the primary combustion zone 26 for renewed participation in the combustion process and, in particular, for cooling as needed. In this regard, the secondary air nozzles 291 are not oriented toward the center of the primary combustion zone 26, but are oriented off-center to create a swirl of flow in the primary combustion zone 26 (i.e., a swirl and vortex flow, which will be discussed in more detail later). The combustion chamber bricks 29 will be discussed in more detail later. Insulation 311 is provided at the boiler tube inlet. The oval cross-sectional shape of the primary combustion zone 26 (and nozzle) and the length and location of the secondary air nozzles 291 advantageously promote the formation and maintenance of a vortex flow preferably to the ceiling of the combustion chamber 24.

Figure 3:
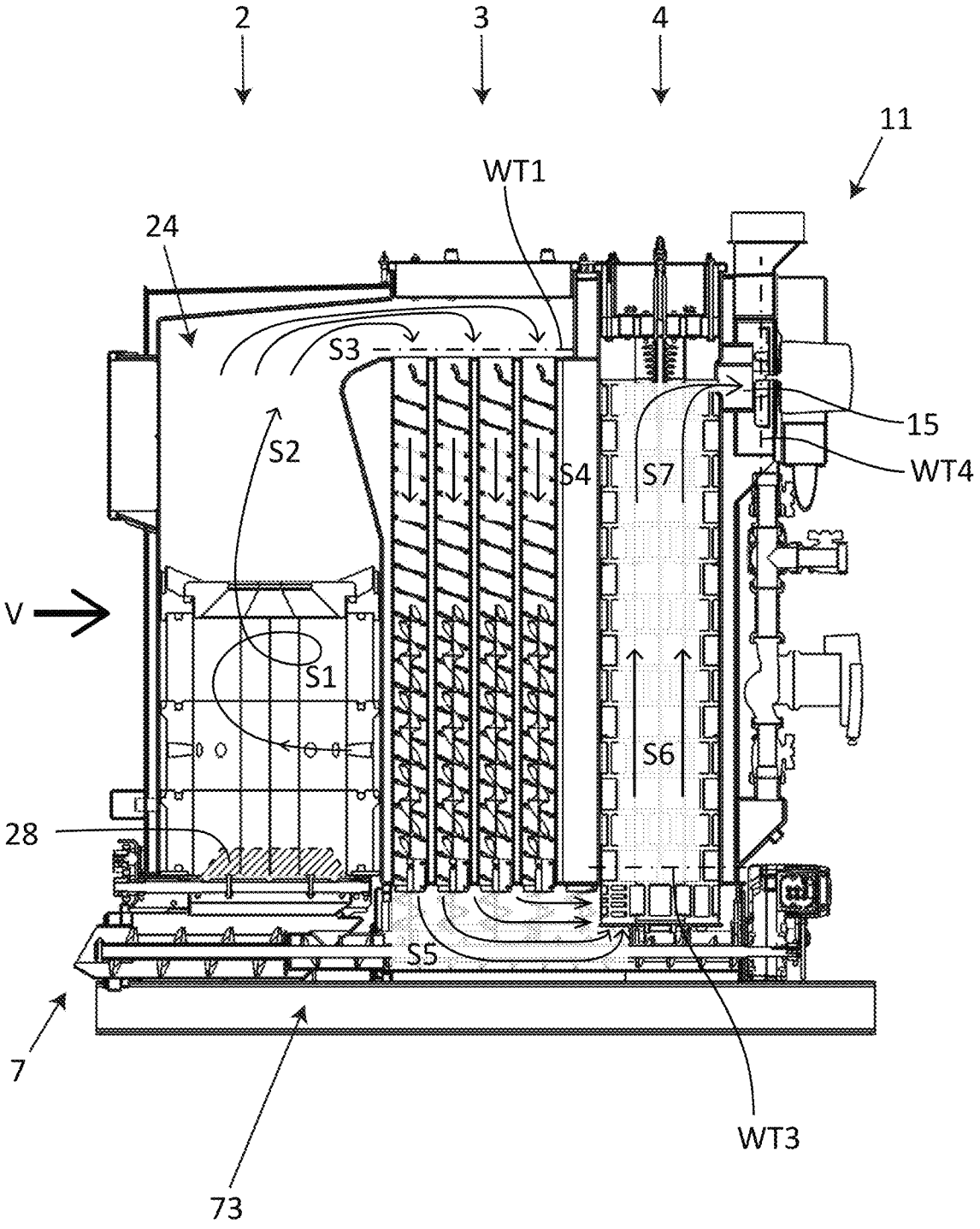
FIG. 3 also shows a cross-sectional view through the biomass heating system of FIG. 1 with a representation of the flow course, the cross-sectional view having been made along a section line SL1 and being shown as viewed from the side view S.

A secondary combustion zone 27 joins, either at the level of the combustion chamber nozzles 291 (considered functionally or combustion-wise) or at the level of the combustion chamber nozzle 203 (considered purely structurally or construction-wise), the primary combustion zone 26 of the combustion chamber 26 and defines the radiation part of the combustion chamber 26. In the radiation section/convection part, the flue gas produced during combustion gives off its thermal energy mainly by thermal radiation, in particular to the heat exchange medium, which is located in the two left chambers for the heat exchange medium 38. The corresponding flue gas flows are indicated in FIG. 3 by arrows S2 and S3 purely as examples. These vortex flows will possibly also include slight backflows or further turbulence, which are not represented by the purely schematic arrows S2 and S3. However, the basic principle of the flow characteristics in the combustion chamber 24 is clear or calculable to the person skilled in the art based on the arrows S2 and S3.

The secondary air injection causes pronounced swirl or rotation or vortex flows to form in the isolated or confined combustion chamber 24. In particular, the oval combustion chamber geometry 24 helps to ensure that the vortex flow can develop undisturbed or optimally.

After exiting the nozzle 203, which again concentrates these vortex flows, candle flame-shaped rotational flows S2 appear, which can advantageously extend to the combustion chamber ceiling 204, thus making better use of the available space of the combustion chamber 24. In this case, the vortex flows are concentrated on the combustion chamber center A2 and make ideal use of the volume of the secondary combustion zone 27. Further, the constriction that combustion chamber nozzle 203 presents to the vortex flows mitigates the rotational flows, thereby creating turbulence to improve the mixing of the air-flue gas mixture. Thus, cross-mixing occurs due to the constriction or narrowing by the combustion chamber nozzle 203. However, the rotational momentum of the flows is maintained, at least in part, above the combustion chamber nozzle 203, which maintains the propagation of these flows to the combustion chamber ceiling 204.

Figure 20:
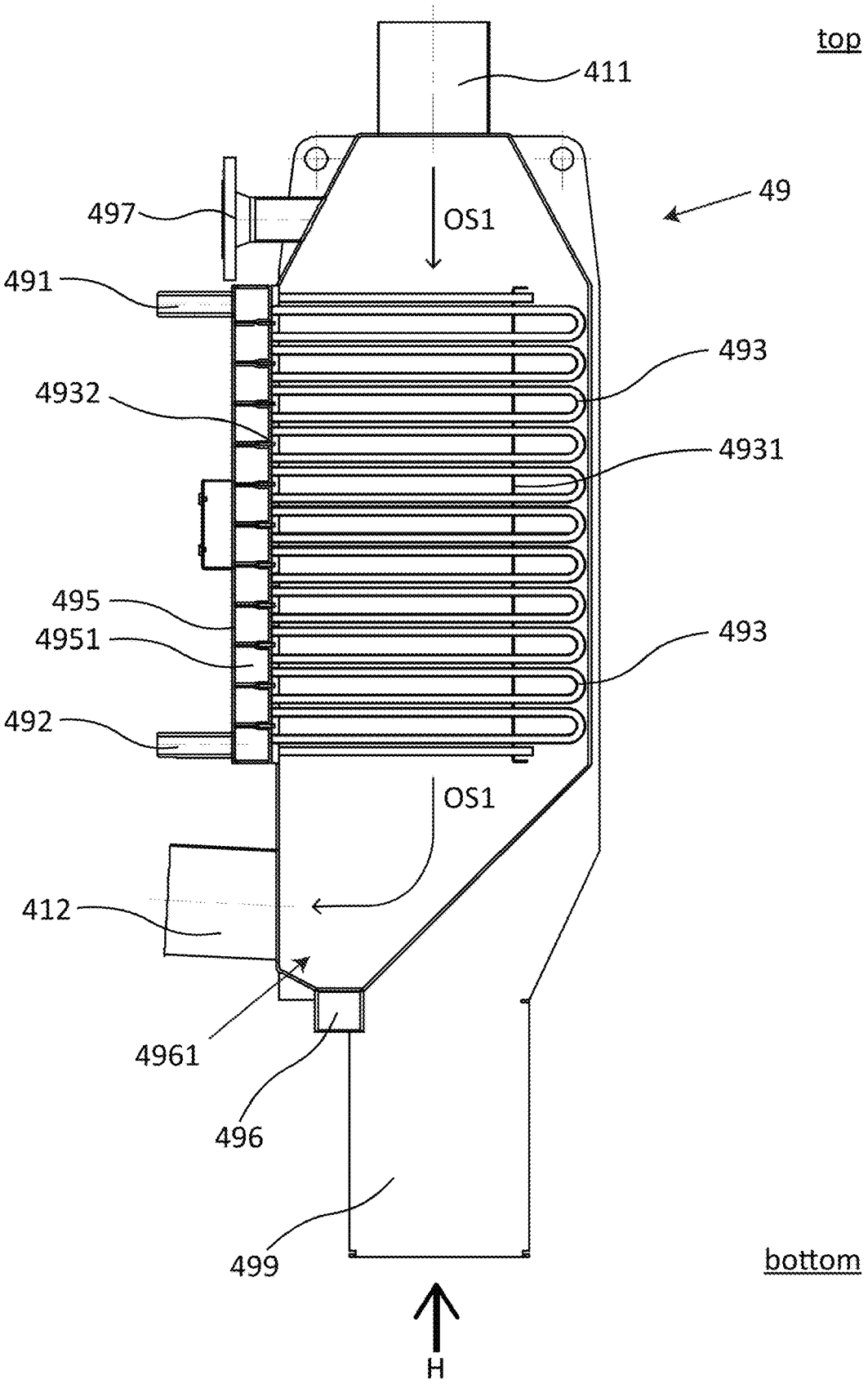
FIG. 20 shows an interior view of the flue gas condenser of FIG. 19*a* and FIG. 18.
Figure 21:
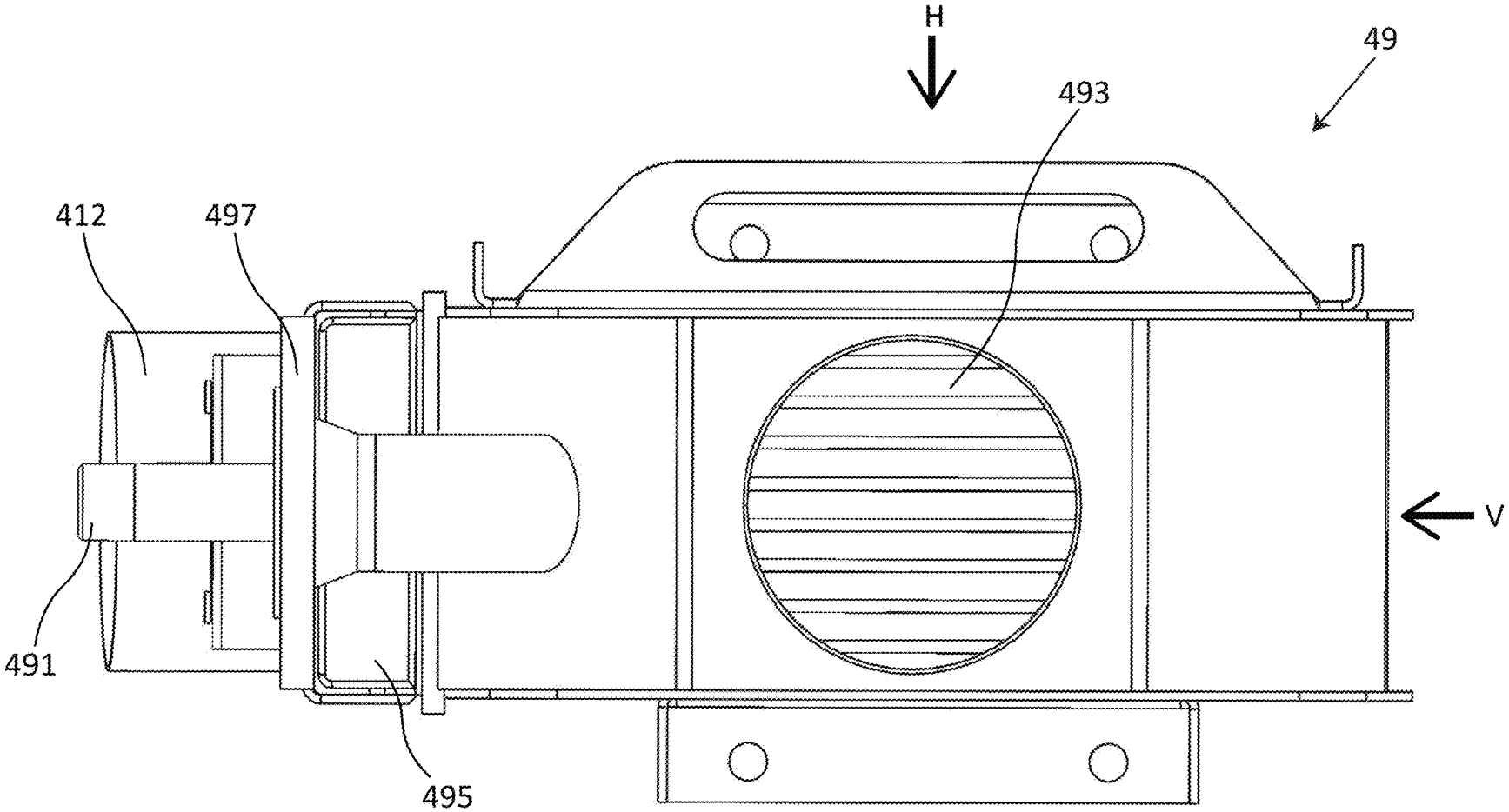
FIG. 21 shows the flue gas condenser from a top view with a view into the opening for the flue gas supply line of the flue gas condenser.

The secondary air nozzles 291 are thus integrated into the elliptical or oval cross-section of the combustion chamber 24 in such a way that, due to their length and orientation, they induce vortex flows which cause the flue gas-secondary air mixture to rotate, thereby enabling (again enhanced by in combination with the combustion chamber nozzle 203 positioned above) complete combustion with minimum excess air and thus maximum efficiency. This is also illustrated in FIGS. 19 to 21.

The secondary air supply is designed in such a way that it cools the hot combustion chamber bricks 29 by flowing around them and the secondary air itself is preheated in return, thus accelerating the burnout rate of the flue gases and ensuring the completeness of the burnout even at extreme partial loads (e.g. 30% of the nominal load).

The first maintenance opening 21 is insulated with an insulation material, for example Vermiculite™. The present secondary combustion zone 27 is arranged to ensure burnout of the flue gas. The specific geometric design of the secondary combustion zone 27 will be discussed in more detail later.

After the secondary combustion zone 27, the flue gas flows into the heat exchange device 3, which has a bundle of boiler tubes 32 provided parallel to each other. The flue gas now flows downward in the boiler tubes 32, as indicated by arrows S4 in FIG. 3. This part of the flow can also be referred to as the convection part, since the heat dissipation of the flue gas essentially occurs at the boiler tube walls via forced convection. Due to the temperature gradients caused in the boiler 11 in the heat exchange medium, for example in the water, a natural convection of the water is established, which favors a mixing of the boiler water.

Spring turbulators 36 and spiral or band turbulators 37 are arranged in the boiler tubes 32 to improve the efficiency of the heat exchange device 4. This will be explained in more detail later.

The outlet of the boiler tubes 32 opens via the reversing/turning chamber inlet 34 resp.-inlet into the turning chamber 35. In this case, the turning chamber 35 is sealed from the combustion chamber 24 in such a way that no flue gas can flow from the turning chamber 35 directly back into the combustion chamber 24. However, a common (discharge) transport path is still provided for the combustion residues that may be generated throughout the flow area of the boiler 11. If the filter device 4 is not provided, the flue gas is discharged upwards again in the boiler 11. The other case of the optional filter device 4 is shown in FIGS. 2 and 3. After the turning chamber 35, the flue gas is fed back upwards into the filter device 4 (see arrows S5), which in this example is an electrostatic filter device 4. Flow baffles can be provided at the inlet 44 of the filter device 4, which even out the flow of the flue gas into the filter.

Electrostatic dust collectors, or electrostatic precipitators, are devices for separating particles from gases based on the electrostatic principle. These filter devices are used in particular for the electrical cleaning of exhaust gases. In electrostatic precipitators, dust particles are electrically charged by a corona discharge of a spray electrode and drawn to the oppositely charged electrode (collecting electrode). The corona discharge takes place on a charged high-voltage electrode (also known as a spray electrode) inside the electrostatic precipitator that is suitable for this purpose. The (spray) electrode is preferably designed with protruding tips and possibly sharp edges, because the density of the field lines and thus also the electric field strength is greatest there and thus corona discharge is favored. The opposed electrode (precipitation electrode) usually consists of a grounded exhaust tube section supported around the electrode. The separation efficiency of an electrostatic precipitator depends in particular on the residence time of the exhaust gases in the filter system and the voltage between the spray electrode and the separation electrode. The rectified high voltage required for this is provided by a high-voltage generation device (not shown). The high-voltage generation system and the holder for the electrode must be protected from dust and contamination to prevent unwanted leakage currents and to extend the service life of system 1.

Figure 15:
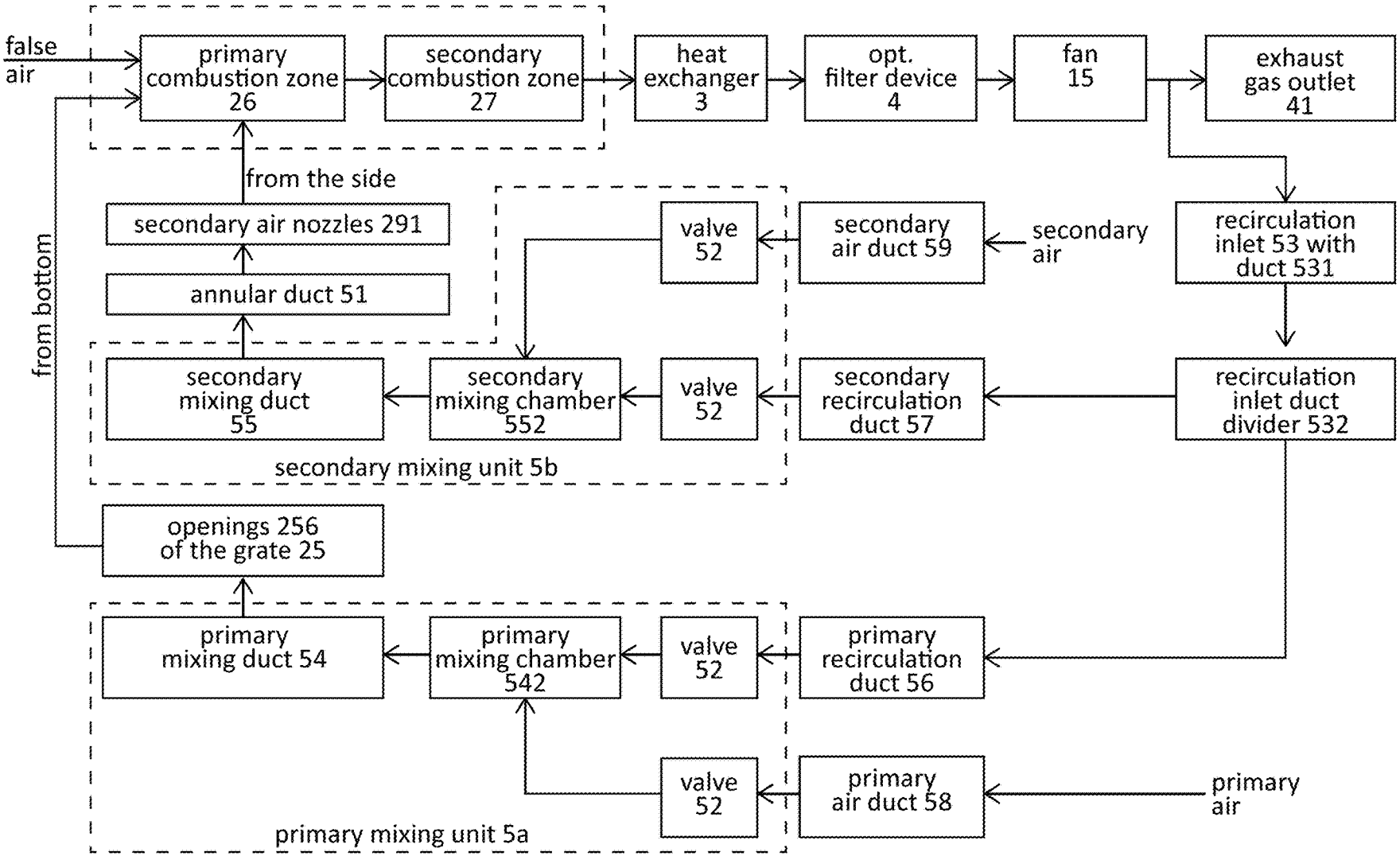
FIG. 15 shows a schematic block diagram showing the flow pattern in the respective individual components of the biomass heating system and the recirculation device of FIGS. 12 to 14.

As shown in FIG. 2, a rod-shaped electrode 45 (which is preferably shaped like an elongated, plate-shaped steel spring, cf. FIG. 15) is supported approximately centrally in an approximately chimney-shaped interior of the filter device 4. The electrode 45 is at least substantially made of a high quality spring steel or chromium steel and is supported by an electrode support 43/electrode holder 43 via a high voltage insulator, i.e., electrode insulation 46.

The (spray) electrode 45 hangs downward into the interior of the filter device 4 in a manner capable of oscillating. For example, the electrode 45 may oscillate back and forth transverse to the longitudinal axis of the electrode 45.

A cage 48 serves simultaneously as a counter electrode and a cleaning mechanism for the filter device 4. The cage 48 is connected to the ground or earth potential. Due to the prevailing potential difference, the flue gas or exhaust gas flowing in the filter device 4, cf. the arrows S6, is filtered as explained above. In the case of cleaning the filter device 4, the electrode 45 is de-energized. The cage 48 preferably has an octagonal regular cross-sectional profile, as can be seen, for example, in the view of FIG. 13. The cage 48 can preferably be laser cut during manufacture.

After leaving the heat exchanger 3 (from its outlet), the flue gas flows through the turning chamber 34 into the inlet 44 of the filter device 4.

Here, the (optional) filter device 4 is optionally provided fully integrated in the boiler 11, whereby the wall surface facing the heat exchanger 3 and flushed by the heat exchange medium is also used for heat exchange from the direction of the filter device 4, thus further improving the efficiency of the system 1. Thus, at least a part of the wall the filter device 4 can be flushed with the heat exchange medium, whereby at least a part of this wall is cooled with boiler water.

At filter outlet 47, the cleaned exhaust gas flows out of filter device 4 as indicated by arrows S7. After exiting the filter, a portion of the exhaust gas is returned to the primary combustion zone 26 via the recirculation device 5. This will also be explained in more detail later. This exhaust gas or flue gas intended for recirculation can also be referred to as "rezi" or "rezi gas" for short. The remaining part of the exhaust gas is led out of the boiler 11 via the exhaust gas outlet 41.

An ash removal 7/ash discharge 7 is arranged in the lower part of the boiler 11. Via an ash discharge screw 71, the ash separated and falling out, for example, from the combustion chamber 24, the boiler tubes 32 and the filter device 4 is discharged laterally from the boiler 11.

The combustion chamber 24 and boiler 11 of this embodiment were calculated using CFD simulations. Further, field experiments were conducted to confirm the CFD simulations. The starting point for the considerations were calculations for a 100 kW boiler, but a power range from 20 to 500 kW was taken into account.

A CFD simulation (CFD=Computational Fluid Dynamics) is the spatially and temporally resolved simulation of flow and heat conduction processes. The flow processes may be laminar and/or turbulent, may occur accompanied by chemical reactions, or may be a multiphase system. CFD simulations are thus well suited as a design and optimization tool. In the present invention, CFD simulations were used to optimize the fluidic parameters in such a way as to solve the above tasks of the invention. In particular, as a result, the mechanical design and dimensioning of the boiler 11, the combustion chamber 24, the secondary air nozzles 291 and the combustion chamber nozzle 203 were largely defined by the CFD simulation and also by associated practical experiments. The simulation results are based on a flow simulation with consideration of heat transfer.

The above components of the biomass heating system 1 and boiler 11, which are results of the CFD simulations, are described in more detail below.

(Combustion Chamber)

The design of the combustion chamber shape is of importance in order to be able to comply with the task-specific requirements. The combustion chamber shape or geometry is intended to achieve the best possible turbulent mixing and homogenization of the flow over the cross-section of the flue gas duct, a minimization of the firing volume, as well as a reduction of the excess air and the recirculation ratio (efficiency, operating costs), a reduction of CO and CxHx emissions, NOx emissions, dust emissions, a reduction of local temperature peaks (fouling and slagging), and a reduction of local flue gas velocity peaks (material stress and erosion).

Figure 4:
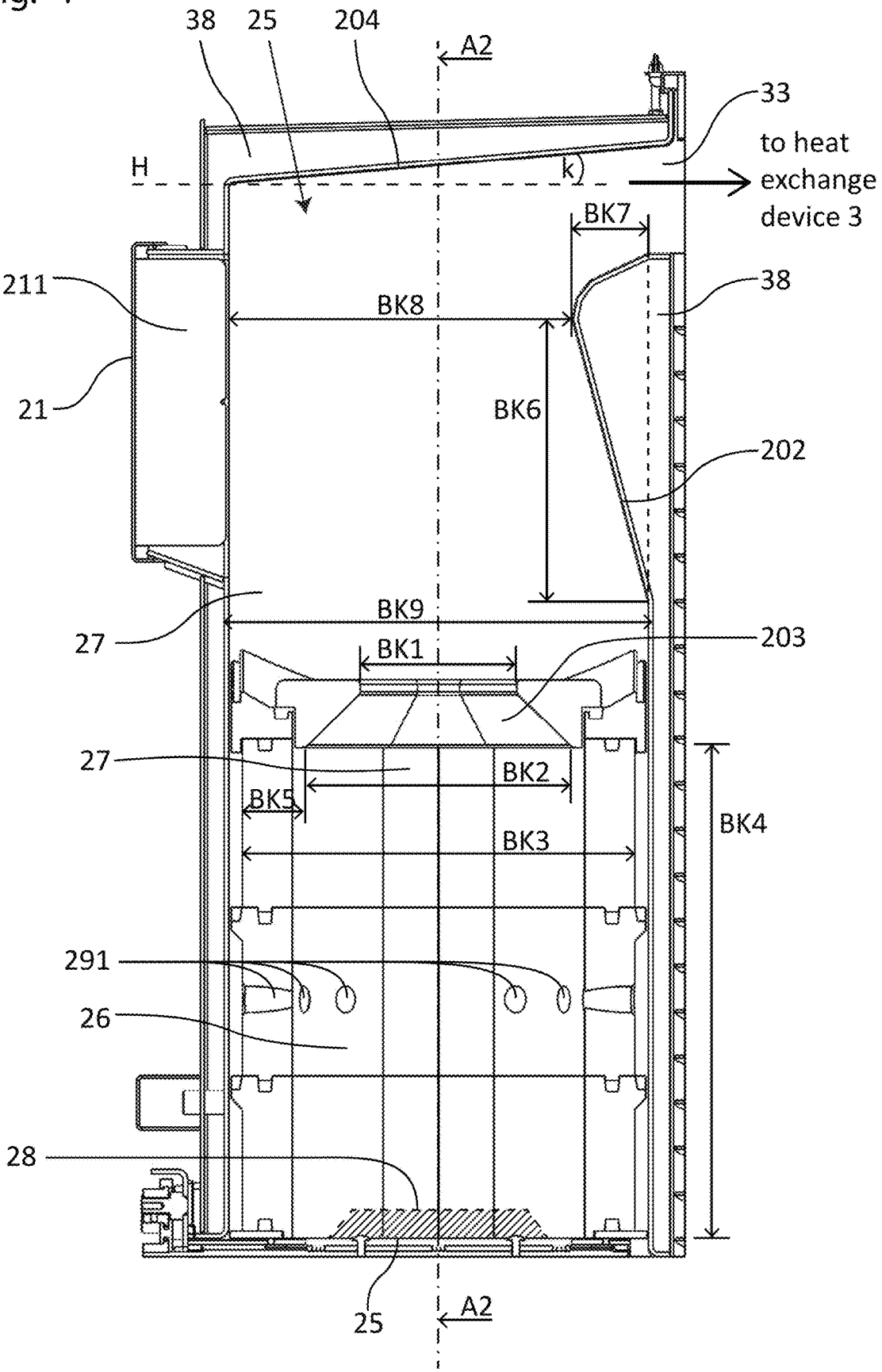
FIG. 4 shows a partial view of FIG. 2, depicting a combustion chamber geometry of the boiler of FIG. 2 and FIG. 3.
Figure 5:
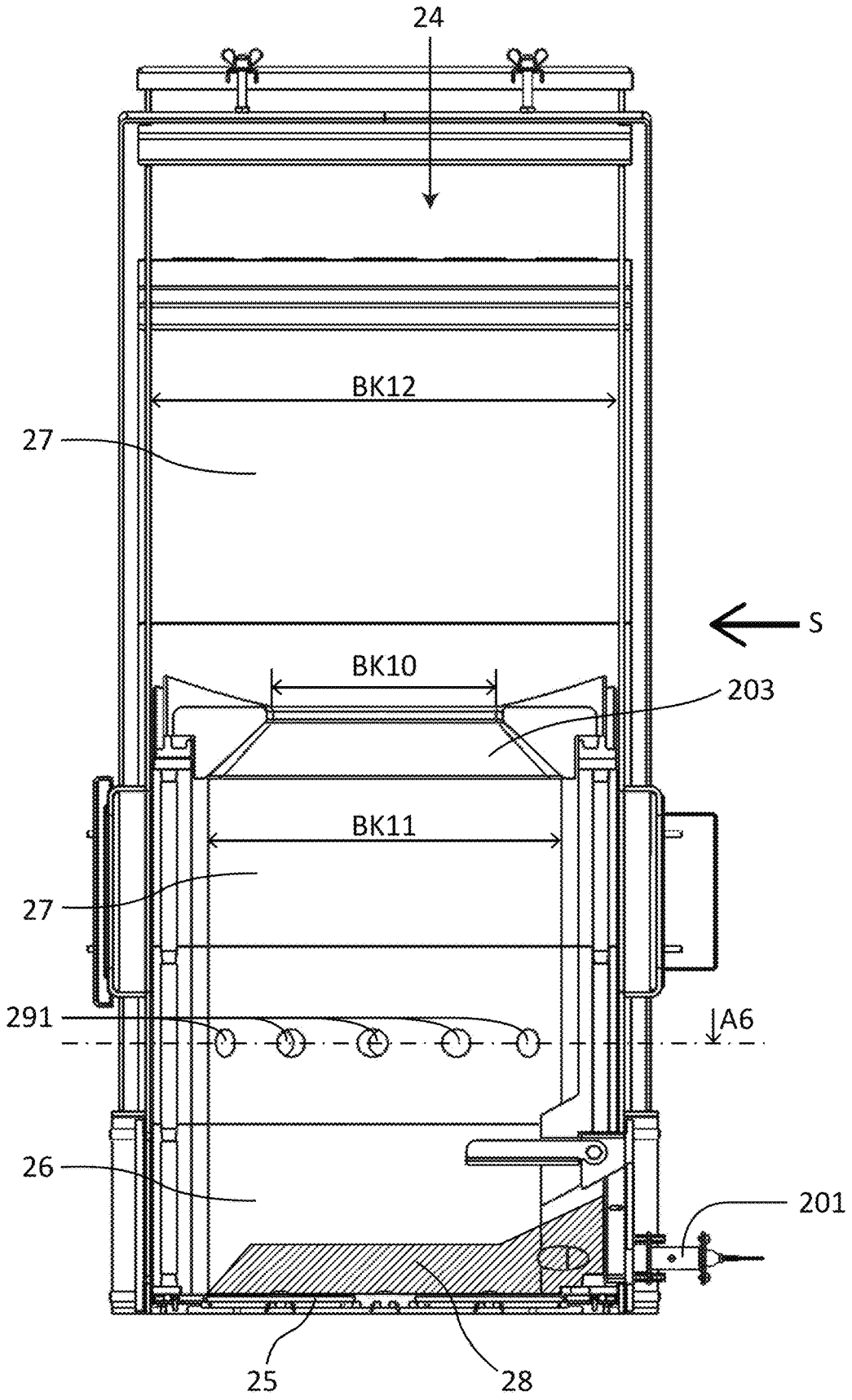
FIG. 5 shows a sectional view through the boiler or the combustion chamber of the boiler along the vertical section line A2 of FIG. 4.

FIG. 4, which is a partial view of FIG. 2, and FIG. 5, which is a sectional view through boiler 11 along vertical section line A2, depict a combustion chamber geometry that meets the aforementioned requirements for biomass heating systems over a wide power range of, for example, 20 to 500 kW. Moreover, the vertical section line A2 can also be understood as the center or central axis of the oval combustion chamber 24.

The dimensions given in FIGS. 3 and 4 and determined via CFD calculations and practical experiments for an exemplary boiler with approx. 100 kW are in detail as follows:

BK1=172 mm+−40 mm, preferably +−17 mm;
BK2=300 mm+−50 mm, preferably +−30 mm;
BK3=430 mm+−80 mm, preferably +−40 mm;
BK4=538 mm+−80 mm, preferably +−50 mm;
BK5=(BK3−BK2)/2=e.g. 65 mm+−30 mm, preferably +−20 mm;
BK6=307 mm+−50 mm, preferably +−20 mm;
BK7=82 mm+−20 mm, preferably +−20 mm;
BK8=379 mm+−40 mm, preferably +−20 mm;
BK9=470 mm+−50 mm, preferably +−20 mm;
BK10=232 mm+−40 mm, preferably +−20 mm;
BK11=380 mm+−60 mm, preferably +−30 mm;
BK12=460 mm+−80 mm, preferably +−30 mm.

All dimensions and sizes are to be understood as examples only.

With these values, both the geometries of the primary combustion zone 26 and the secondary combustion zone 27 of the combustion chamber 24 are optimized in the present case. The specified size ranges are ranges with which the requirements are just as (approximately) fulfilled as with the specified exact values.

Preferably, a chamber geometry of the primary combustion zone 26 and the combustion chamber 24 (or an internal volume of the primary combustion zone 26 of the combustion chamber 24) can be defined based on the following basic parameters:

A volume having an oval horizontal base with dimensions of 380 mm+−60 mm (preferably +−30 mm)×320 mm+−60 mm (preferably +−30 mm), and a height of 538 mm+−80 mm (preferably +−50 mm).

The above size data can also be applied to boilers of other output classes (e.g. 50 kW or 200 kW) scaled in relation to each other.

As a further embodiment thereof, the volume defined above may include an upper opening in the form of a combustion chamber nozzle 203 provided in the secondary combustion zone 27 of the combustion chamber 24, which includes a combustion chamber slope 202 projecting into the secondary combustion zone 27, which preferably includes the heat exchange medium 38. The combustion chamber slope 202 reduces the cross-sectional area of the secondary combustion zone 27. Here, the combustion chamber slope 202 is provided by an angle k of at least 5%, preferably by an angle k of at least 15% and even more preferably by at least an angle k of 19% with respect to a fictitious horizontal or straight provided combustion chamber ceiling H (cf. the dashed horizontal line H in FIG. 4).

In addition, a combustion chamber ceiling 204 is also provided sloping upwardly in the direction of the inlet 33. Thus, the combustion chamber 24 in the secondary combustion zone 27 has the combustion chamber ceiling 204, which is provided inclined upward in the direction of the inlet 33 of the heat exchanger 3. This combustion chamber ceiling 204 extends at least substantially straight or straight and inclined in the section of FIG. 2. The angle of inclination of the straight or flat combustion chamber ceiling 204 relative to the (notional) horizontal can preferably be 4 to 15 degrees.

With the combustion chamber ceiling 204, another (ceiling) slope is provided in the combustion chamber 24 in front of the inlet 33, which together with the combustion chamber slope 202 forms a funnel. This funnel turns the upward swirl or vortex flow to the side and redirects this flow approximately to the horizontal. Due to the already turbulent upward flow and the funnel shape before the inlet 33, it is ensured that all heat exchanger tubes 32 or boiler tubes 32 are flowed through evenly, thus ensuring an evenly distributed flow of the flue gas in all boiler tubes 32. This optimizes the heat transfer in the heat exchanger 3 quite considerably.

In particular, the combination of the vertical and horizontal slopes 203, 204 in the secondary combustion zone in combination as the inlet geometry in the convective boiler can achieve a uniform distribution of the flue gas to the convective boiler tubes.

The combustion chamber slope 202 serves to homogenize the flow S3 in the direction of the heat exchanger 3 and thus the flow into the boiler tubes 32. This ensures that the flue gas is distributed as evenly as possible to the individual boiler tubes in order to optimize heat transfer there.

Specifically, the combination of the slopes with the inlet cross-section of the boiler rotates the flue gas flow in such a way that the flue gas flow or flow rate is distributed as evenly as possible to the respective boiler tubes 32.

In the prior art, there are often combustion chambers with rectangular or polygonal combustion chamber and nozzle, however, the irregular shape of the combustion chamber and nozzle and their interaction are another obstacle to uniform air distribution and good mixing of air and fuel and thus good burnout, as recognized presently. In particular, with an angular geometry of the combustion chamber, flow threads or preferential flows are created, which disadvantageously lead to an uneven flow in the heat exchanger tubes 32.

Therefore, in the present case, combustion chamber 24 is provided without dead corners or dead edges.

Thus, it was recognized that the geometry of the combustion chamber (and of the entire flow path in the boiler) plays a significant role in the considerations for optimizing the biomass heating system 1. Therefore, the basic oval or round geometry without dead corners described herein was chosen (in departure from the usual rectangular or polygonal or purely cylindrical shapes). In addition, this basic geometry of the combustion chamber and its design with the dimensions/dimensional ranges given above have also been optimized for a 100 kW boiler. These dimensions/range of dimensions are selected in such a way that, in particular, different fuels (wood chips and pellets) with different quality (for example, with different water content) can be burned with very high efficiency. This is what the field tests and CFD simulations have shown.

In particular, the primary combustion zone 26 of the combustion chamber 24 may comprise a volume that preferably has an oval or approximately circular horizontal cross-section in its outer periphery (such a cross-section is exemplified by A1 in FIG. 2). This horizontal cross-section may further preferably represent the footprint of the primary combustion zone 26 of the combustion chamber 24. Over the height indicated by the double arrow BK4, the combustion chamber 24 may have an approximately constant cross-section. In this respect, the primary combustion zone 24 may have an approximately oval-cylindrical volume. Preferably, the side walls and the base surface (grate) of the primary combustion zone 26 may be perpendicular to each other. In this case, the slopes 203, 204 described above can be provided integrally as walls of the combustion chamber 24, with the slopes 203, 204 forming a funnel that opens into the inlet 33 of the heat exchanger 33, where it has the smallest cross-section.

The term "approximate" is used above because individual notches, deviations due to design or small asymmetries may of course be present, for example at the transitions of the individual combustion chamber bricks 29 to one another. However, these minor deviations play only a minor role in terms of flow.

The horizontal cross-section of the combustion chamber 24 and, in particular, of the primary combustion zone 26 of the combustion chamber 24 may likewise preferably be of regular design. Further, the horizontal cross-section of the combustion chamber 24 and in particular the primary combustion zone 26 of the combustion chamber 24 may preferably be a regular (and/or symmetrical) ellipse.

In addition, the horizontal cross-section (the outer perimeter) of the primary combustion zone 26 can be designed to be constant over a predetermined height, (for example 20 cm).

Thus, in the present case, an oval-cylindrical primary combustion zone 26 of the combustion chamber 24 is provided, which, according to CFD calculations, enables a much more uniform and better air distribution in the combustion chamber 24 than in rectangular combustion chambers of the prior art. The lack of dead spaces also avoids zones in the combustion chamber with poor air flow, which increases efficiency and reduces slag formation.

Similarly, nozzle 203 in combustion chamber 24 is configured as an oval or approximately circular constriction to further optimize flow conditions. The swirl of the flow in the primary combustion zone 26 explained above, which is caused by the specially designed secondary air nozzles 291 according to the invention, results in a roughly helical or spiral flow pattern directed upward, whereby an equally oval or approximately circular nozzle favors this flow pattern, and does not interfere with it as do conventional rectangular nozzles. This optimized nozzle 203 concentrates the flue gas-air mixture flowing upwards in a rotating manner and ensures better mixing, preservation of the vortex flows in the secondary combustion zone 27 and thus complete combustion. This also minimizes the required excess air. This improves the combustion process and increases efficiency.

Thus, in particular, the combination of the secondary air nozzles 291 explained above and the vortex flows induced thereby with the optimized nozzle 203 serves to concentrate the upwardly rotating flue gas/air mixture. This provides at least near complete combustion in the secondary combustion zone 27.

Thus, a swirling flow through the nozzle 203 is focused and directed upward, extending this flow further upward than is common in the prior art. This is caused by the reduction of the swirling distance of the airflow to the rotation or swirl central axis forced by the nozzle 203 (cf. analogously the physics of the pirouette effect), as is evident to the skilled person from the laws of physics concerning angular momentum.

In addition, the flow pattern in the secondary combustion zone 27 and from the secondary combustion zone 27 to the boiler tubes 32 is optimized in the present case, as explained in more detail below.

According to CFD calculations, the combustion chamber slope 202 of FIG. 4, which can also be seen without reference signs in FIGS. 2 and 3 and at which the combustion chamber 25 (or its cross-section) tapers at least approximately linearly from the bottom to the top, ensures a uniformity of the flue gas flow in the direction of the heat exchanger 4, which can improve its efficiency. Here, the horizontal cross-sectional area of the combustion chamber 25 preferably tapers by at least 5% from the beginning to the end of the combustion chamber slope 202. In this case, the combustion chamber slope 202 is provided on the side of the combustion chamber 25 facing the heat exchange device 4, and is provided rounded at the point of maximum taper. In the state of the art, parallel or straight combustion chamber walls without a taper (so as not to obstruct the flow of flue gas) are common. In addition, individually or in combination, the combustion chamber ceiling 204, which extends obliquely upward to the horizontal in the direction of the inlet 33, deflects the vortex flows in the secondary combustion zone 27 laterally, thereby equalizing them in their flow velocity distribution.

The inflow or deflection of the flue gas flow upstream of the shell-and-tube heat exchanger is designed in such a way that an uneven inflow to the tubes is avoided as far as possible, which means that temperature peaks in individual boiler tubes 32 can be kept low and thus the heat transfer in the heat exchanger 4 can be improved (best possible utilization of the heat exchanger surfaces). As a result, the efficiency of the heat exchange device 4 is improved.

In detail, the gaseous volume flow of the flue gas is guided through the inclined combustion chamber wall 203 at a uniform velocity (even in the case of different combustion conditions) to the heat exchanger tubes or the boiler tubes 32. The sloped combustion chamber ceiling 204 further enhances this effect, creating a funnel effect. The result is a uniform heat distribution of the individual boiler tubes 32 heat exchanger surfaces concerned and thus an improved utilization of the heat exchanger surfaces. The exhaust gas temperature is thus lowered and the efficiency increased. The flow distribution, in particular at the indicator line WT1 shown in FIG. 3, is significantly more uniform than in the prior art. The line WT1 represents an inlet surface for the heat exchanger 3. The indicator line WT3 indicates an exemplary cross-sectional line through the filter device 4 in which the flow is set up as homogeneously as possible or is approximately equally distributed over the cross-section of the boiler tubes 32 (due, among other things, to flow baffles at the inlet to the filter device 4 and due to the geometry of the turning chamber 35). A uniform flow through the filter device 3 or the last boiler pass minimizes stranding and thereby also optimizes the separation efficiency of the filter device 4 and the heat transfer in the biomass heating system 1.

Further, an ignition device 201 is provided in the lower part of the combustion chamber 25 at the fuel bed 28. This can cause initial ignition or re-ignition of the fuel. It can be the ignition device 201 a glow igniter. The ignition device is advantageously stationary and horizontally offset to the side of the place where the fuel is introduced.

Furthermore, a lambda probe (not shown) can (optionally) be provided after the outlet of the flue gas (i.e., after S7) from the filter device. The lambda sensor enables a controller (not shown) to detect the respective heating value. The lambda sensor can thus ensure the ideal mixing ratio between the fuels and the oxygen supply. Despite different fuel qualities, high efficiency and higher efficiency are achieved as a result.

The fuel bed 28 shown in FIG. 5 shows a rough fuel distribution based on the fuel being fed from the right side of FIG. 5. This fuel bed 28 is flowed from below with a flue gas/fresh air mixture provided by the recirculation device 5. This flue gas/fresh air mixture is advantageously pre-tempered and has the ideal quantity (mass flow) and the ideal mixing ratio, as controlled by a system controller not shown in more detail on the basis of various measured values detected by sensors and associated air valves 52.

Further shown in FIGS. 4 and 5 is a combustion chamber nozzle 203 in which a secondary combustion zone 27 is provided and which accelerates and focuses the flue gas flow. As a result, the flue gas flow is better mixed and can burn more efficiently in the post-combustion zone 27 or secondary combustion zone 27. The area ratio of the combustion chamber nozzle 203 is in the range of 25% to 45%, but is preferably 30% to 40%, and is, for example for a 100 kW biomass heating system 1, ideally 36%+−1% (ratio of the measured input area to the measured output area of the nozzle 203).

Consequently, the foregoing details of the combustion chamber geometry of the primary combustion zone 26 together with the geometry of the secondary air nozzles 291 and the nozzle 203 constitute an advantageous further embodiment of the present disclosure.

(Combustion Chamber Bricks)

Figure 6:
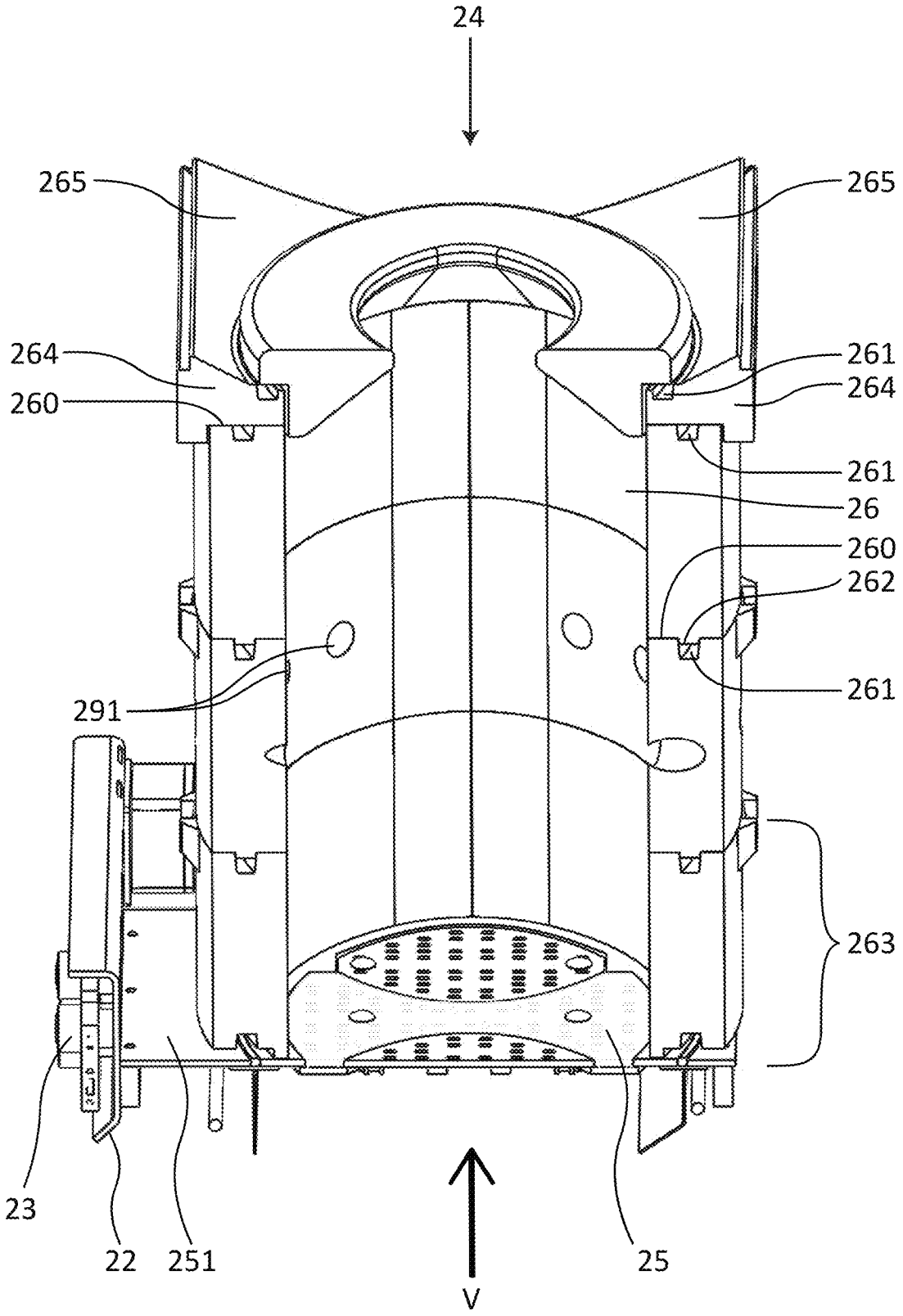
FIG. 6 shows a three-dimensional sectional view of the primary combustion zone of the combustion chamber with the rotating grate of FIG. 4.
Figure 7:
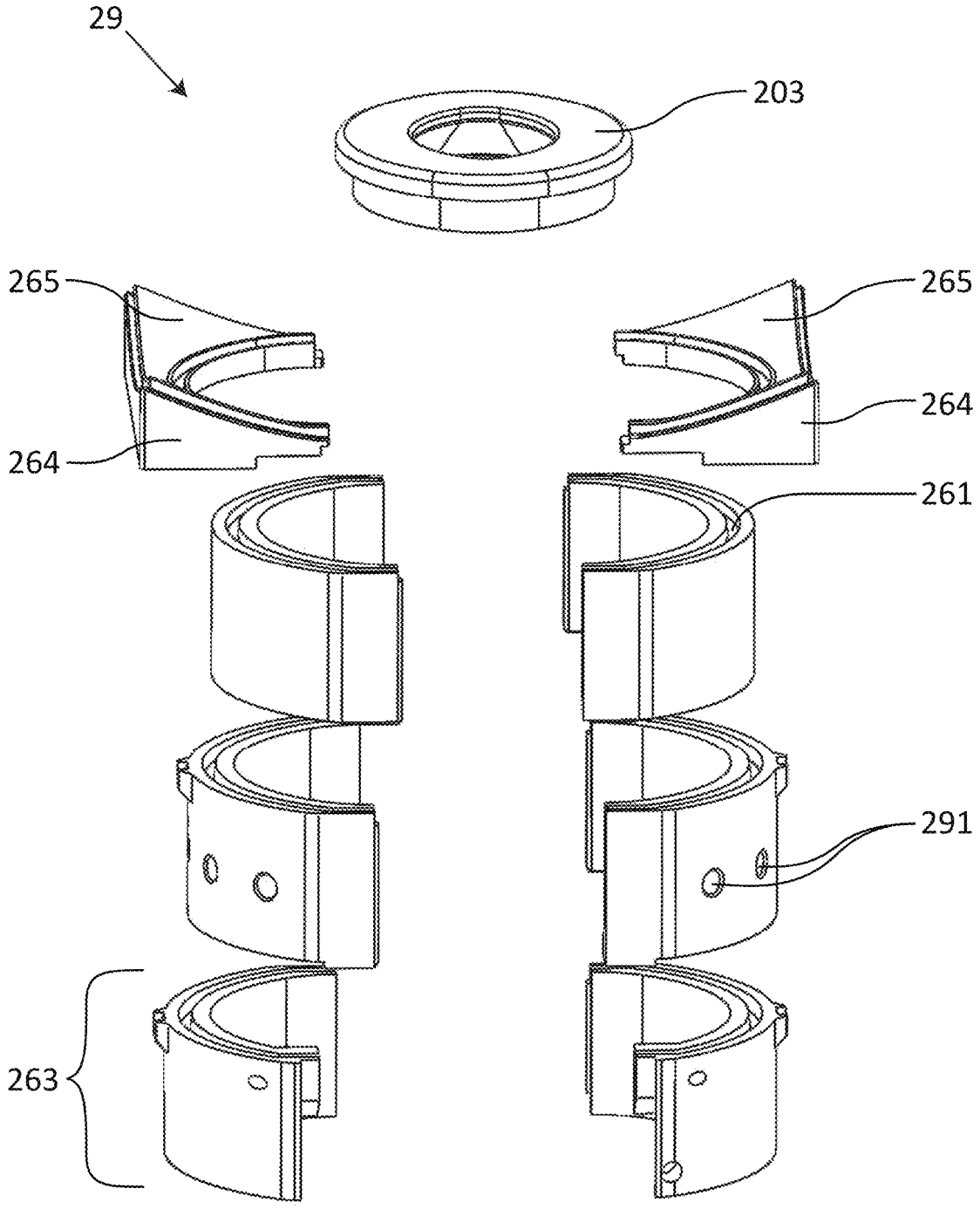
FIG. 7 shows an exploded view of the combustion chamber bricks as in FIG. 6.

FIG. 6 shows a three-dimensional sectional view (from diagonally above) of the primary combustion zone 26 as well as the isolated part of the secondary combustion zone 27 of the combustion chamber 24 with the rotating grate 25, and in particular of the special design of the combustion chamber bricks 29. FIG. 7 shows an exploded view of the combustion chamber bricks 29 corresponding to FIG. 6. The views of FIGS. 6 and 7 can preferably be designed with the dimensions of FIGS. 4 and 5 listed above. However, this is not necessarily the case.

The chamber wall of the primary combustion zone 26 of the combustion chamber 24 is provided with a plurality of combustion chamber bricks 29 in a modular construction, which facilitates, among other things, fabrication and maintenance. Maintenance is facilitated in particular by the possibility of removing individual combustion chamber bricks 29.

Positive-locking grooves 261 and projections 262 (in FIG. 6, to avoid redundancy, only a few of these are designated in each of the figures by way of example) are provided on the bearing surfaces/support surfaces 260 of the combustion chamber bricks 29 to create a mechanical and largely airtight connection, again to prevent the ingress of disruptive foreign air. Preferably, two at least largely symmetrical combustion chamber bricks each (with the possible exception of the openings for the secondary air or the recirculated flue gas) form a complete ring. Further, three rings are preferably stacked on top of each other to form the oval-cylindrical or alternatively at least approximately circular (the latter is not shown) primary combustion zone 26 of the combustion chamber 24.

Three further combustion chamber bricks 29 are provided as the upper end, with the annular nozzle 203 being supported by two retaining bricks 264, which are positively fitted onto the upper ring 263. Grooves 261 are provided on all support surfaces 260 either for suitable projections 262 and/or for insertion of suitable sealing material.

The mounting blocks 264, which are preferably symmetrical, may preferably have an inwardly inclined slope 265 to facilitate sweeping of fly ash onto the rotating grate 25.

The lower ring 263 of the combustion chamber bricks 29 rests on a bottom plate 251 of the rotating grate 25. Ash is increasingly deposited on the inner edge between this lower ring 263 of the combustion chamber bricks 29, which thus advantageously seals this transition independently and advantageously during operation of the biomass heating system 1.

The (optional) openings for the recirculation nozzles 291 or secondary air nozzles 291 are provided in the center ring of the combustion chamber bricks 29. In this case, the secondary air nozzles 291 are provided at least approximately at the same (horizontal) height of the combustion chamber 24 in the combustion chamber bricks 29.

Presently, three rings of combustion chamber bricks 29 are provided as this is the most efficient way of manufacturing and also maintenance. Alternatively, 2, 4 or 5 such rings may be provided.

The combustion chamber bricks 29 are preferably made of high-temperature silicon carbide, which makes them highly wear-resistant.

The combustion chamber bricks 29 are provided as shaped bricks. The combustion chamber bricks 29 are shaped in such a way that the inner volume of the primary combustion zone 26 of the combustion chamber 24 has an oval horizontal cross-section, thus avoiding dead spots or dead spaces through which the flue gas-air mixture does not normally flow optimally, as a result of which the fuel present there is not optimally burned, by means of an ergonomic shape. Because of the present shape of the combustion chamber bricks 29, the flow of primary air through the grate 25, which also fits the distribution of the fuel over the grate 25, and the possibility of unobstructed vortex flows is improved; and consequently, the efficiency of the combustion is improved.

The oval horizontal cross-section of the primary combustion zone 26 of the combustion chamber 24 is preferably a point-symmetrical and/or regular oval with the smallest inner diameter BK3 and the largest inner diameter BK11. These dimensions were the result of optimizing the primary combustion zone 26 of the combustion chamber 24 using CFD simulation and practical tests.

(Rotating Grate)

Figure 8:
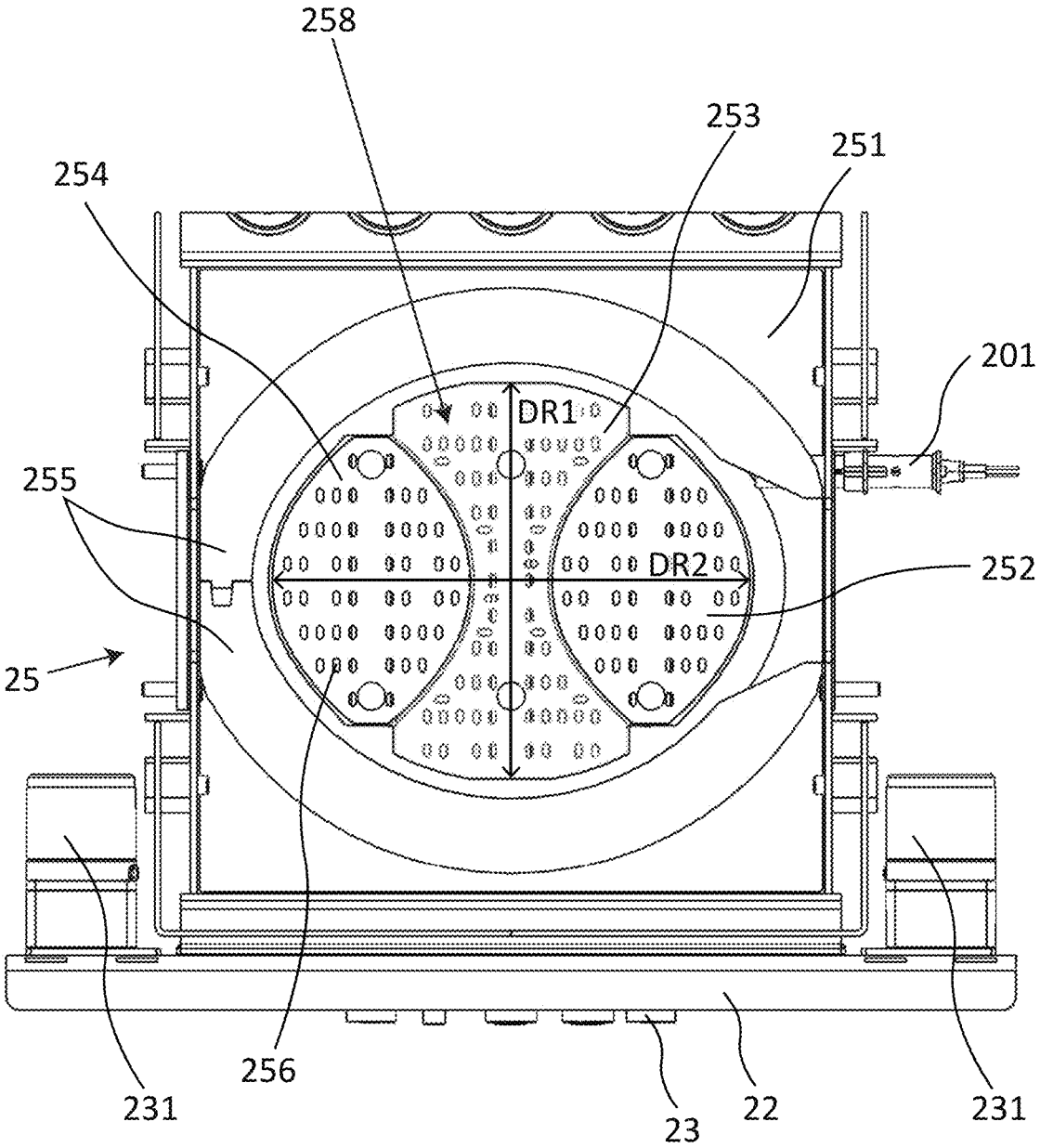
FIG. 8 shows a top view of the rotating grate with rotating grate elements as seen from section line A1 of FIG. 2.

FIG. 8 shows a top view of the rotating grate 25 as seen from section line A1 of FIG. 2.

The top view of FIG. 8 can preferably be designed with the dimensions listed above. However, this is not necessarily the case.

The rotating grate 25 has the bottom plate 251 as a base element. A transition element 255 is provided in a roughly oval-shaped opening of the bottom plate 251 to bridge a gap between a first rotating grate element 252, a second rotating grate element 253, and a third rotating grate element 254, which are rotatably supported. Thus, the rotating grate 25 is provided as a rotating grate with three individual elements, i.e., this can also be referred to as a 3-fold rotating grate. Air holes are provided in the rotating grate elements 252, 253 and 254 for primary air to flow through.

The rotating grate elements 252, 253 and 254 are flat and heat-resistant metal plates, for example made of a metal casting, which have an at least largely flat configured surface on their upper side and are connected on their underside to the bearing axles 81, for example via intermediate support elements. When viewed from above, the rotating grate elements 252, 253, and 254 have curved and complementary sides or outlines.

In particular, the rotating grate elements 252, 253, 254 may have mutually complementary and curved sides, preferably the second rotating grate element 253 having respective sides concave to the adjacent first and third rotating grate elements 252, 254, and preferably the first and third rotating grate elements 252, 254 having respective sides convex to the second rotating grate element 253. This improves the crushing function of the rotating grate elements, since the length of the fracture is increased and the forces acting for crushing (similar to scissors) act in a more targeted manner.

The rotating grate elements 252, 253 and 254 (as well as their enclosure in the form of the transition element 255) have an approximately oval outer shape when viewed together in plan view, which again avoids dead corners or dead spaces here in which less than optimal combustion could take place or ash could accumulate undesirably. The optimum dimensions of this outer shape of the rotating grate elements 252, 253 and 254 are indicated by the double arrows DR1 and DR2 in FIG. 8. Preferably, but not exclusively, DR1 and DR2 are defined as follows:

DR1=288 mm+−40 mm, preferably +−20 mm

DR2=350 mm+−60 mm, preferably +−20 mm

These values turned out to be the optimum values (ranges) during the CFD simulations and the following practical test. These dimensions correspond to those of FIGS. 4 and 5. These dimensions are particularly advantageous for the combustion of different fuels or the fuel types wood chips and pellets (hybrid firing) in a power range from 20 to 200 kW.

In this case, the rotating grate 25 has an oval combustion area, which is more favorable for fuel distribution, fuel air flow, and fuel burnup than a conventional rectangular combustion area. The combustion area 258 is formed in the core by the surfaces of the rotating grate elements 252, 253 and 254 (in the horizontal state). Thus, the combustion area is the upward facing surface of the rotating grate elements 252, 253, and 254. This oval combustion area advantageously corresponds to the fuel support surface when this is applied or pushed onto the side of the rotating grate 25 (cf. the arrow E of FIGS. 9, 10 and 11). In particular, fuel may be supplied from a direction parallel to a longer central axis (major axis) of the oval combustion area of the rotating grate 25.

The first rotating grate element 252 and the third rotating grate element 254 may preferably be identical in their combustion areas 258. Further, the first rotating grate element 252 and the third rotating grate element 254 may be identical or identical in construction to each other. This can be seen, for example, in FIG. 9, where the first rotating grate element 252 and the third rotating grate element 254 have the same shape.

Further, the second rotating grate element 253 is disposed between the first rotating grate element 252 and the third rotating grate element 254.

Preferably, the rotating grate 25 is provided with an approximately point-symmetrical oval combustion area 258.

Similarly, the rotating grate 25 may form an approximately elliptical combustion area 258, where DR2 is the dimensions of its major axis and DR1 is the dimensions of its minor axis.

Further, the rotating grate 25 may have an approximately oval combustion area 258 that is axisymmetric with respect to a central axis of the combustion area 258.

Further, the rotating grate 25 may have an approximately circular combustion area 258, although this entails minor disadvantages in fuel feed and distribution.

Further, two motors or drives 231 of the rotating mechanism 23 are provided to rotate the rotating grate elements 252, 253 and 254 accordingly. More details of the particular function and advantages of the present rotating grate 25 will be described later with reference to FIGS. 9, 10 and 11.

Particularly in pellet and wood chip heating systems (and especially in hybrid biomass heating systems), failures can increasingly occur due to slag formation in the combustion chamber 24, especially on the rotating grate 25. Slag is formed during a combustion process whenever temperatures above the ash melting point are reached in the embers. The ash then softens, sticks together, and after cooling forms solid, and often dark-colored, slag. This process, also known as sintering, is undesirable in the biomass heating system 1 because the accumulation of slag in the combustion chamber 24 can cause it to malfunction: it shuts down. The combustion chamber 24 must usually be opened and the slag must be removed.

The ash melting range (this extends from the sintering point to the yield point) depends quite significantly on the fuel material used. Spruce wood, for example, has a critical temperature of about 1,200° C. But the ash melting range of a fuel can also be subject to strong fluctuations. Depending on the amount and composition of the minerals contained in the wood, the behavior of the ash in the combustion process changes.

Another factor that can influence the formation of slag is the transport and storage of the wood pellets or chips. These should namely enter the combustion chamber 24 as undamaged as possible. If the wood pellets are already crumbled when they enter the combustion process, this increases the density of the glow bed. Greater slag formation is the result. In particular, the transport from the storage room to the combustion chamber 24 is of importance here. Particularly long paths, as well as bends and angles, lead to damage or abrasion of the wood pellets.

Another factor concerns the management of the combustion process. Until now, the aim has been to keep temperatures rather high in order to achieve the best possible burnout and low emissions. By optimizing the combustion chamber geometry and the geometry of the combustion zone 258 of the rotating grate 25, it is possible to keep the combustion temperature lower at the grate and high in the area of the secondary air nozzles 291, thus reducing slag formation at the grate.

In addition, resulting slag (and also ash) can be advantageously removed due to the particular shape and functionality of the present rotating grate 25. This will now be explained in more detail with reference to FIGS. 9, 10 and 11.

Figure 9:
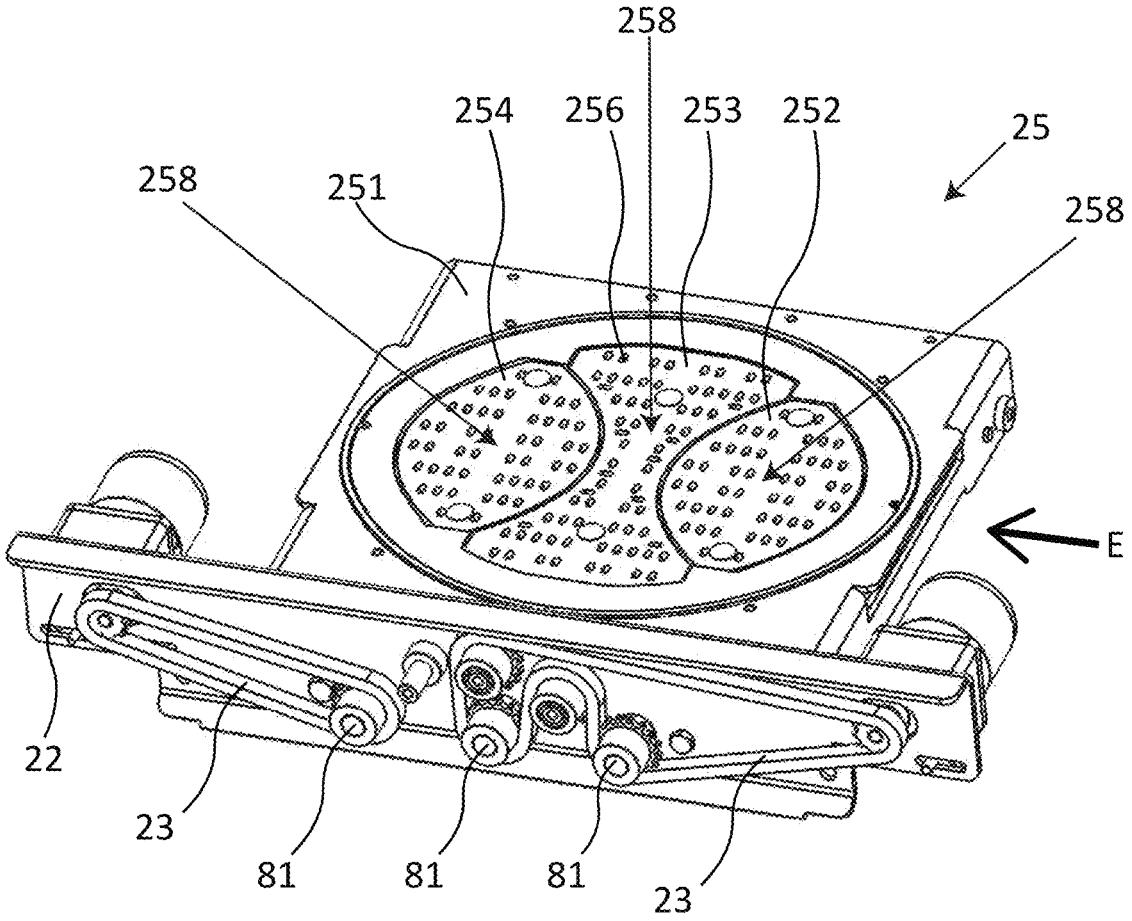
FIG. 9 shows the rotating grate of FIG. 2 in closed position, with all rotating grate elements horizontally aligned or closed.
Figure 10:
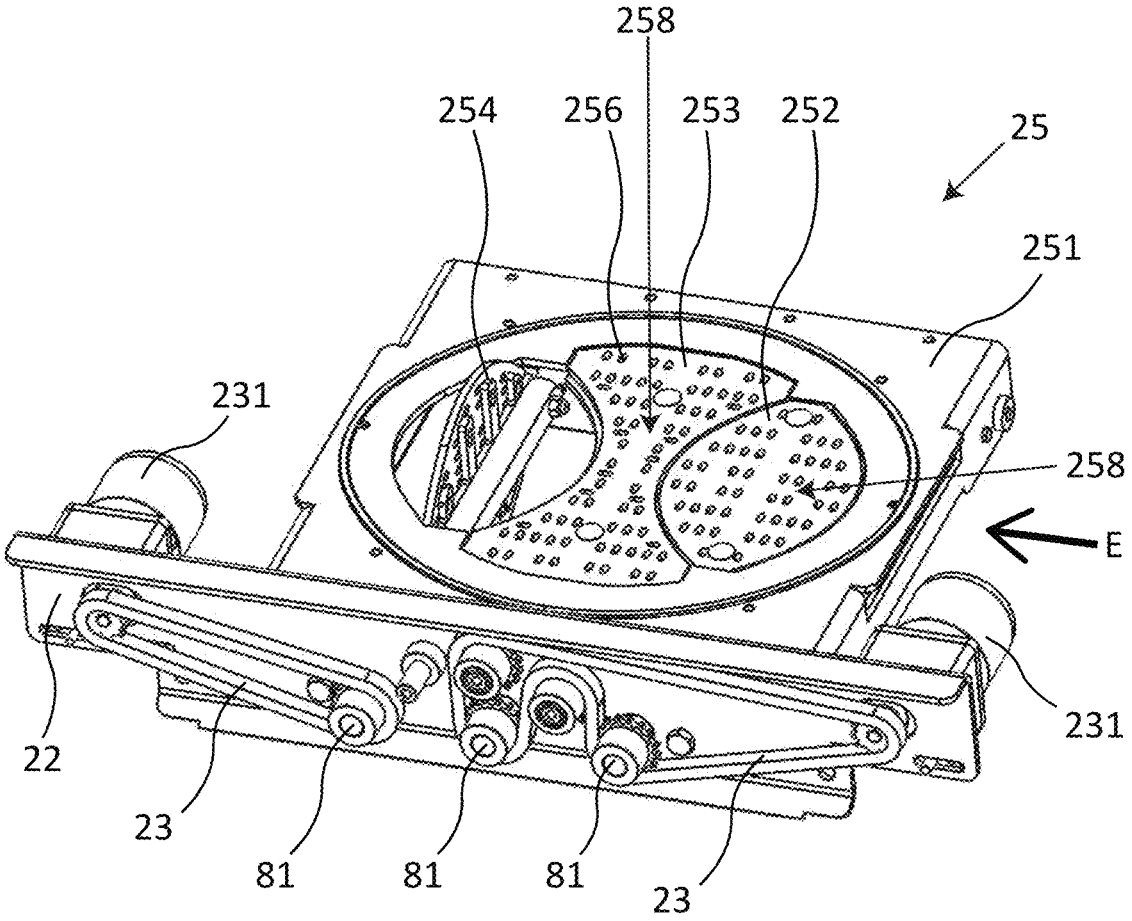
FIG. 10 shows the rotating grate of FIG. 9 in the state of partial cleaning of the rotating grate in glow maintenance mode.
Figure 11:
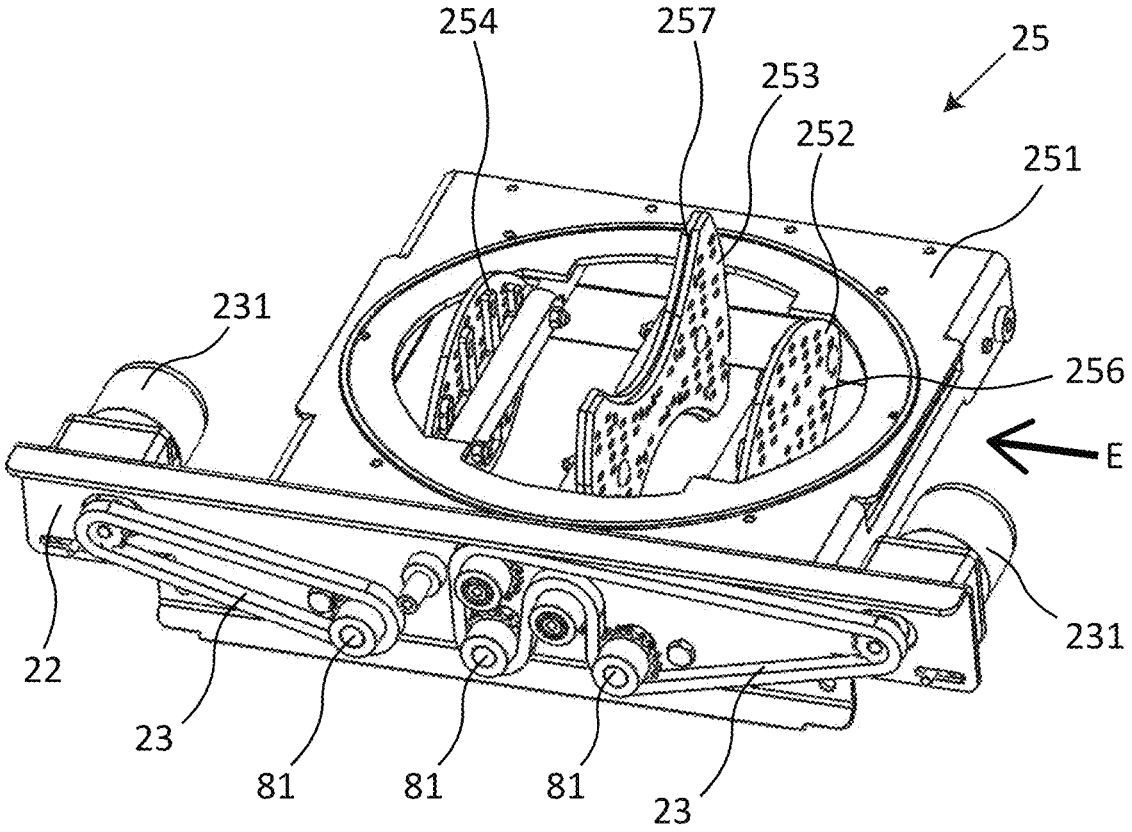
FIG. 11 shows the rotating grate of FIG. 9 in the state of universal cleaning, which is preferably carried out during a system shutdown.

FIGS. 9, 10, and 11 show a three-dimensional view of the rotating grate 25 including the bottom plate 251, the first rotating grate element 252, the second rotating grate element 253, and the third rotating grate element 254. The views of FIGS. 9, 10 and 11 can preferably correspond to the dimensions given above. However, this is not necessarily the case.

This view shows the rotating grate 25 as an exposed slide-in component with rotating grate mechanism 23 and drive(s) 231. The rotating grate 25 is mechanically provided in such a way that it can be individually prefabricated in the manner of a modular system, and can be inserted and installed as a slide-in part in a provided elongated opening of the boiler 11. This also facilitates the maintenance of this wear-prone part. In this way, the rotating grate 25 can preferably be of modular design, whereby it can be quickly and efficiently removed and reinserted as a complete part with rotating grate mechanism 23 and drive 231. The modularized rotating grate 25 can thus also be assembled and disassembled by means of quick-release fasteners. In contrast, state of the art rotating grates are regularly fixed, and thus difficult to maintain or install.

The drive 231 may include two separately controllable electric motors. These are preferably provided on the side of the rotating grate mechanism 23. The electric motors can have reduction gears. Further, end stop switches may be provided to provide end stops respectively for the end positions of the rotating grate elements 252, 253 and 254.

The individual components of the rotating grate mechanism 23 are designed to be interchangeable. For example, the gears are designed to be attachable. This facilitates maintenance and also a side change of the mechanics during assembly, if necessary.

The aforementioned openings 256 are provided in the rotating grate elements 252, 253 and 254 of the rotating grate 25. The rotating grate elements 252, 253 and 254 can be rotated about the respective bearing or rotation axis 81 by at least 90 degrees, preferably by at least 120 degrees, even more preferably by 170 degrees, via their respective bearing axes 81, which are driven via the rotary mechanism 23 by the drive 231, presently the two motors 231. Here, the maximum angle of rotation may be 180 degrees, or slightly less than 180 degrees, as permitted by the grate lips 257. In this regard, the rotating mechanism 23 is arranged such that the third rotating grate element 254 can be rotated individually and independently of the first rotating grate element 252 and the second rotating grate element 243, and such that the first rotating grate element 252 and the second rotating grate element 243 can be rotated together and independently of the third rotating grate element 254. The rotating mechanism 23 may be provided accordingly, for example, by means of impellers, toothed or drive belts, and/or gears.

The rotating grate elements 252, 253 and 254 can preferably be manufactured as a cast grate with a laser cut to ensure accurate shape retention. This is particularly in order to define the airflow through the fuel bed 28 as precisely as possible, and to avoid disturbing airflows, for example air strands at the edges of the rotating grate elements 252, 253 and 254.

The openings 256 in the rotating grate elements 252, 253, and 254 are arranged to be small enough for the usual pellet material and/or wood chips not to fall through, and large enough for the fuel to flow well with air. In addition, the openings 256 are large enough to be blocked by ash particles or impurities (e.g., no stones in the fuel).

FIG. 9 now shows the rotating grate 25 in closed position, with all rotating grate elements 252, 253 and 254 horizontally aligned or closed. This is the position in control mode. The uniform arrangement of the plurality of openings 256 ensures a uniform flow of fuel through the fuel bed 28 (which is not shown in FIG. 9) on the rotating grate 25. In this respect, the optimum combustion condition can be produced here. The fuel is applied to the rotating grate 25 from the direction of arrow E; in this respect, the fuel is pushed up onto the rotating grate 25 from the right side of FIG. 9.

During operation, ash and or slag accumulates on the rotating grate 25 and in particular on the rotating grate elements 252, 253 and 254. The present rotating grate 25 can be used to efficiently clean the rotating grate 25.

FIG. 10 shows the rotating grate in the state of a partial cleaning of the rotating grate 25 in the ember maintenance mode. For this purpose, only the third rotating grate element 254 is rotated. By rotating only one of the three rotating grate elements, the embers are maintained on the first and second rotating grate elements 252, 253, while at the same time the ash and slag are allowed to fall downwardly out of the combustion chamber 24. As a result, no external ignition is required to resume operation (this saves up to 90% ignition energy). Another consequence is a reduction in wear of the ignition device (for example, of an ignition rod) and a saving in electricity. Further, ash cleaning can advantageously be performed during operation of the biomass heating system 1.

FIG. 10 also shows a condition of annealing during (often already sufficient) partial cleaning. Thus, the operation of the system 1 can advantageously be more continuous, which means that, in contrast to the usual full cleaning of a conventional grate, there is no need for a lengthy full ignition, which can take several tens of minutes.

In addition, potential slag formation or accumulation at the two outer edges of the third rotating grate element 254 is (broken up) during rotation thereof, wherein, due to the curved outer edges of the third rotating grate element 254, shearing not only occurs over a greater overall length than in conventional rectangular elements of the prior art, but also occurs with an uneven distribution of movement with respect to the outer edge (greater movement occurs at the center than at the lower and upper edges). Thus, the crushing function of the rotating grate 25 is significantly enhanced.

In FIG. 10, grate lips 257 (on both sides) of the second rotating grate element 253 are visible. These grate lips 257 are arranged in such a way that the first rotating grate element 252 and the third rotating grate element 254 rest on the upper side of the grate lips 257 in the closed state thereof, and thus the rotating grate elements 252, 253 and 254 are provided without a gap to one another and are thus provided in a sealing manner. This prevents air strands and unwanted uneven primary air flows through the glow bed. Advantageously, this improves the efficiency of combustion.

FIG. 11 shows the rotating grate 25 in the state of universal cleaning, which is preferably carried out during a system shutdown. In this case, all three rotating grate elements 252, 253 and 254 are rotated, with the first and second rotating grate elements 252, 253 preferably being rotated in the opposite direction to the third rotating grate element 254. On the one hand, this realizes a complete emptying of the rotating grate 25, and on the other hand, the ash and slag is now broken up at four odd outer edges. In other words, an advantageous 4-fold crushing function is realized. What has been explained above with regard to FIG. 9 concerning the geometry of the outer edges also applies with regard to FIG. 10.

In summary, the present rotating grate 25 advantageously realizes two different types of cleaning (cf. FIGS. 10 and 11) in addition to normal operation (cf. FIG. 9), with partial cleaning allowing cleaning during operation of the system 1.

In comparison, commercially available rotating grate systems are not ergonomic and, due to their rectangular geometry, have disadvantageous dead corners in which the primary air cannot optimally flow through the fuel, which can result in air strand formation. Slagging also occurs at these corners. These points provide poorer combustion with poorer efficiency.

The present simple mechanical design of the rotating grate 25 makes it robust, reliable and durable.

(Recirculation Device)

CFD simulations, further considerations and practical tests were again carried out to optimize the recirculation device 5 briefly mentioned above. This included the flue gas recirculation described below for a biomass heating system.

In the calculations, for example, a 100 kW boiler was simulated in the nominal load operating case with a load range of 20 to 500 kW with different fuels (for example, wood chips with 30% water content). In the present case, light soiling or fouling (so-called fouling with a thickness of 1 mm) was also taken into account for all surfaces in contact with flue gas. The emissivity of such a fouling layer was assumed to be 0.6.

Figure 12:
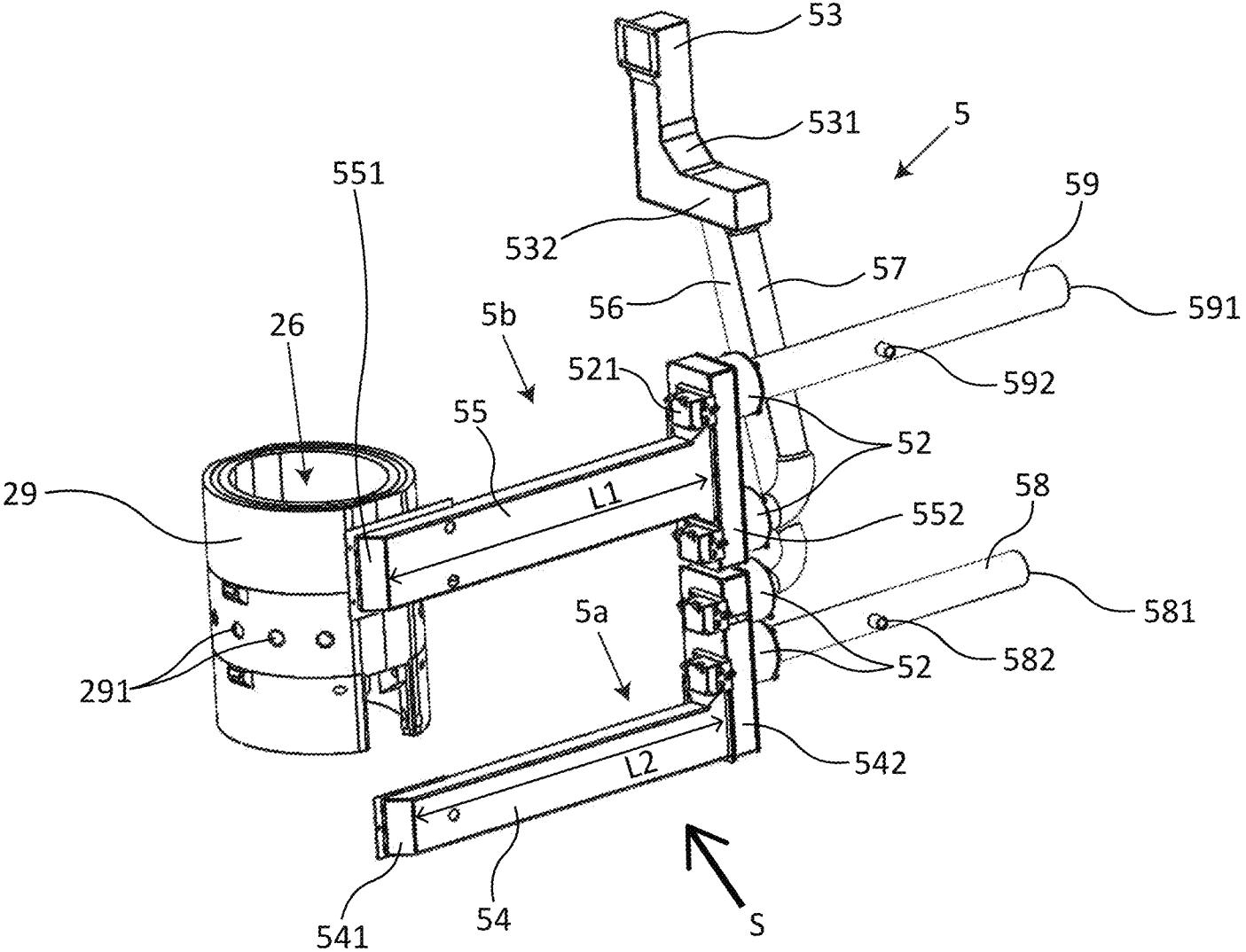
FIG. 12 shows a highlighted oblique view of an exemplary recirculation device with combustion chamber bricks surrounding a primary combustion zone.
Figure 13:
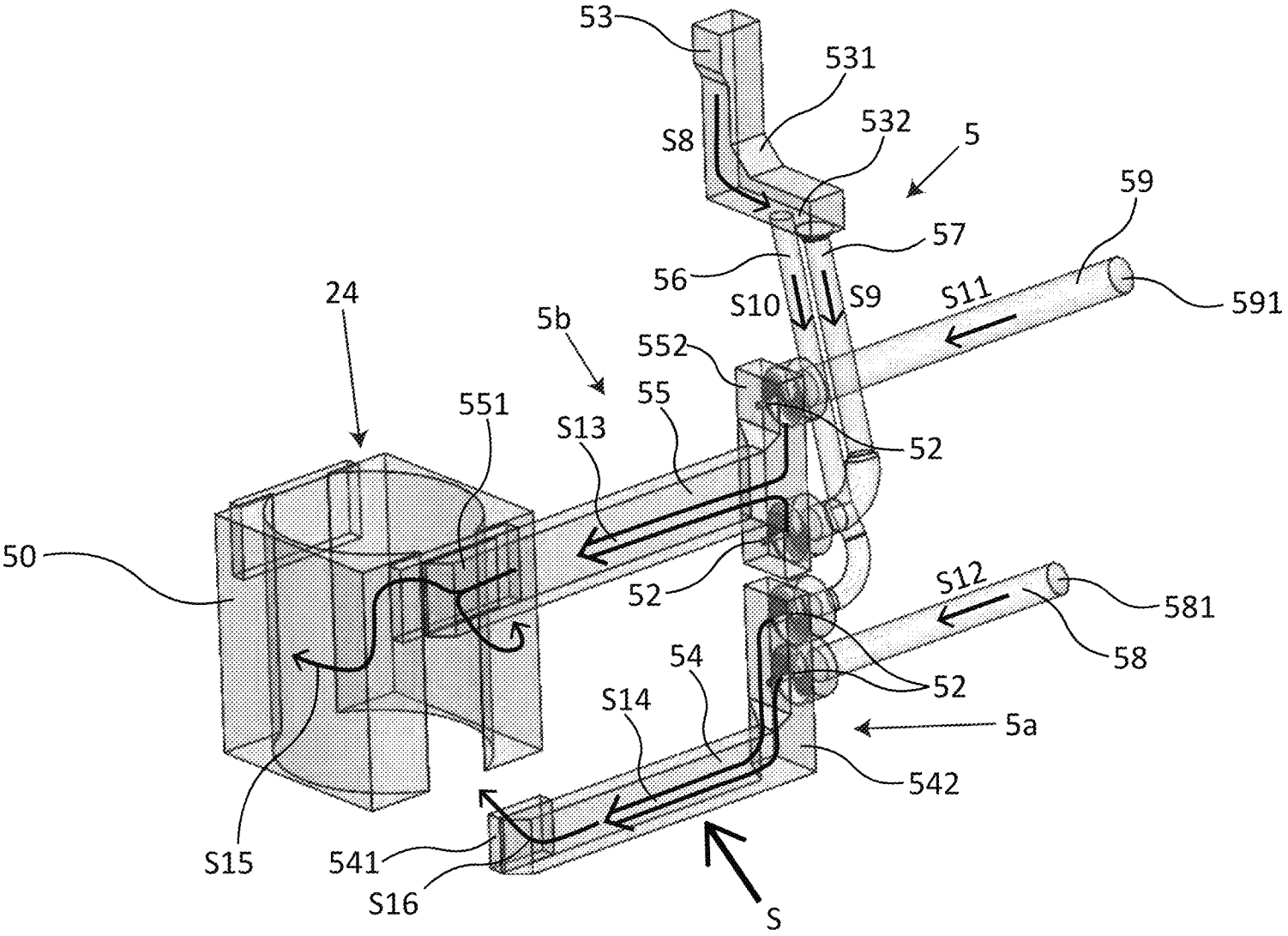
FIG. 13 shows a highlighted semi-transparent oblique view of the recirculation device of FIG. 12.
Figure 14:
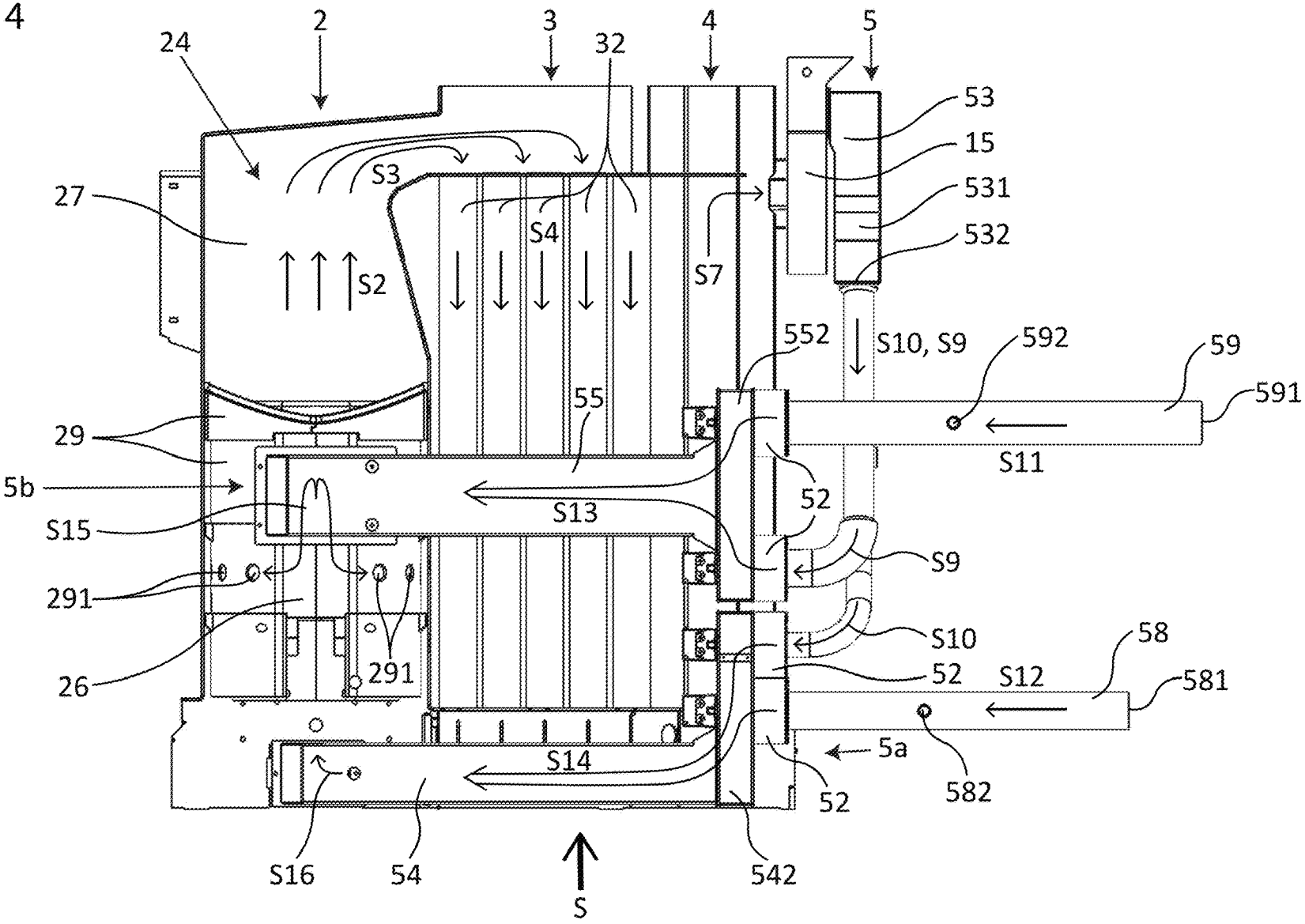
FIG. 14 shows a side view of the recirculation device 5 of FIGS. 12 and 13.

The result of this optimization and the accompanying considerations is shown in FIGS. 12 to 17. FIGS. 12 to 14 show different views of the recirculation device 5, which can be seen in FIGS. 1 to 3.

FIG. 12 shows a highlighted oblique view of the recirculation device 5 with the combustion chamber bricks 29 surrounding the primary combustion zone 26. FIG. 13 shows a highlighted semi-transparent oblique view of the recirculation device 5 of FIG. 12. FIG. 14 shows a side view of the recirculation device 5 of FIGS. 12 and 13. In each case, the arrow S of FIGS. 12 to 14 corresponds to the arrow S of FIG. 1, which indicates the direction of the side view of the biomass heating system 1.

The recirculation device 5 is described in more detail below with reference to FIGS. 12, 13, 14 and 15.

The recirculation device 5 has a recirculation inlet 53 with a recirculation inlet duct 531 and a recirculation inlet duct divider 532. The recirculation inlet 53 and the recirculation inlet duct 531 are provided downstream of a blower 15 (cf. FIG. 3) at the flue gas outlet of the biomass heating system 1 after the heat exchanger 3 or after the (optional) filter device 4. The recirculation inlet duct divider 532 may branch the flue gas or rezi gas to be recirculated into a primary recirculation duct 56 and an optional secondary recirculation duct 57. If there is no secondary recirculation, no recirculation inlet duct divider 532 is required.

The primary recirculation duct 56 opens into a primary mixing chamber 542 via an air valve 52, exemplarily a rotary valve 52. In addition, a primary air duct 58 opens into the primary mixing chamber 542 via a further air valve 52, in this case exemplarily a rotary slide valve 52, which in turn has a primary air inlet 581 for, for example, room air or fresh air, correspondingly referred to as primary fresh air. The primary air duct 58 may include a primary air sensor 582

(for example, for sensing the temperature and/or oxygen content of the primary fresh air).

Unmixed primary air, i.e., fresh air or ambient air, enters primary mixing chamber 542 via primary air inlet 581 and primary air duct 58 and air valve 52, where the ambient air is mixed with the recirculated flue gas from primary recirculation duct 56 according to the valve position of air valves 52. Downstream of the primary mixing chamber 542, a primary mixing duct 54 is provided in which the mixture of primary (fresh) air and flue gas is further mixed. The primary mixing chamber 542 with its valves 52 and the primary mixing duct 54 together form a primary mixing unit 5*a*.

The secondary recirculation duct 57 opens into a secondary mixing chamber 552 via an air valve 52, exemplarily a rotary slide valve 52. A secondary air duct 59, which in turn has a secondary air inlet 591 for secondary fresh air, also opens into the secondary mixing chamber 552 via a further air valve 52, in this example a rotary slide valve 52. The secondary air duct 59 may include a secondary air sensor 592 (for example, for sensing the temperature and/or oxygen content of the secondary air).

Secondary fresh air, i.e. ambient air, enters secondary mixing chamber 552 via secondary air inlet 591 and secondary air duct 59 and air valve 52, where the ambient air is mixed with the recirculated flue gas from secondary recirculation duct 57 according to the valve position of air valves 52. Downstream of the secondary mixing chamber 552, a secondary mixing duct 55 is provided in which the mixture of secondary fresh air and flue gas is further mixed. The secondary mixing chamber 552 with its valves 52 and the secondary mixing duct 55 form the secondary mixing unit 5*b*.

The position of each of the four air valves 52 is adjusted by means of a valve actuator 521, which may be an electric motor, for example. In FIG. 12, only one of the four valve actuators 521 is designated for clarity.

The primary mixing duct 54 has a minimum length L1. For example, the minimum length L1 is at least 700 mm from the beginning of the primary mixing duct 54 at the passage from the primary mixing chamber 542 to the end of the primary mixing duct 54. It has been shown that the length L1 of the primary mixing duct 54, for good mixing should also be longer, preferably at least 800 mm, ideally 1200 mm. The length L1 should also preferably not exceed, for example, 2000 mm for design and printing reasons. The primary mixing duct 54 may have an inlet funnel at its upstream beginning that tapers toward the end of the primary mixing duct 54. This concentrates the flow at the upstream beginning of the duct 54 into the center, and mixes it even better, since stranding can occur, especially at the upper side of the duct 54, due to thermal differences. This strand formation is advantageously counteracted by means of the tapering of the primary mixing duct 54 at its beginning.

The (optional) secondary mixing duct 55 has a minimum length L2. For example, the minimum length L2 is at least 500 mm from the beginning of the secondary mixing duct 55 at the passage from the secondary mixing chamber 552 to the end of the secondary mixing duct 55. It has been shown that the length L2 of the secondary mixing duct 55, for good mixing should also be longer, preferably at least 600 mm, ideally 1200 mm. Furthermore, the length L2 should not exceed 2000 mm, for example, for design and printing reasons. The secondary mixing duct 55 may also have an inlet funnel at its upstream beginning, which tapers toward the downstream end of the secondary mixing duct 55.

The primary mixing duct 54 and the (optional) secondary mixing duct 55 can be designed with a rectangular cross-section with a respective internal width of 160 mm+−30 mm (vertical)/120 mm+−30 mm (vertical) and an internal thickness (horizontal) of 50 mm+−15 mm. Due to this design of the primary mixing duct 54 and the secondary mixing duct 55 each as a long, flat duct adjacent to the heat exchanger 3 and the combustion device, several advantageous effects are achieved. First, the mixture of flue gas and primary (fresh) air/secondary (fresh) air is advantageously preheated before it reaches combustion. For example, a mixture having a temperature of +25 degrees Celsius downstream of primary mixing chamber 542 may have a temperature 15 degrees Celsius higher at the downstream end of primary mixing duct 54 in the nominal load case. On the other hand, the cross-section and the longitudinal extension are chosen to be large enough to continue the mixing even after the mixing chambers 542, 552, thus causing an improvement in the homogenization of the flow. This provides the flow with sufficient path to further mix the flow that is already turbulent at the beginning of the path.

In other words, the elongated primary mixing duct 54 provides a pathway for further mixing downstream of the primary mixing chamber 542, wherein the primary mixing chamber 542 is purposefully provided to create substantial turbulence at the beginning of the pathway. The optional feed hopper of ducts 54, 55 can also contribute to this.

Preferably, the two lengths L1 and L2 can match within a certain tolerance (+−10 mm).

The recirculated flue gas, which has previously been well mixed with "fresh" primary air, is fed from below to the rotating grate 25 via a primary passage 541. Through its openings 256, this mixture of recirculated flue gas and primary fresh air (i.e., the primary air for the combustion chamber 24) enters the primary combustion zone 26 of the combustion chamber 24. In this respect, the primary recirculation for recirculating the flue gas-primary fresh air mixture is provided such that it enters the primary combustion zone 26 from below.

Via an (optional) secondary passage 551 and a subsequent annular duct 50 (cf. FIG. 13) around the combustion chamber bricks 29, the recirculated flue gas, which has been previously well mixed with "fresh" secondary air, i.e., secondary fresh air (or, if secondary recirculation is omitted, with primary (fresh) air), is fed to the (likewise optional) recirculation or secondary air nozzles 291. In this regard, as explained, the secondary air nozzles 291 are not aligned with the center of the primary combustion zone 26, but rather these are oriented off-center to cause a swirl of flow extending upwardly from the primary combustion zone 26 into the secondary combustion zone 27 (i.e., an upwardly directed swirling flow with a vertical swirl axis). In this respect, the secondary recirculation may be provided to recirculate the flue gas-secondary fresh air mixture at least partially into the secondary combustion zone 27.

FIGS. 13 and 14 show, corresponding to FIG. 12, the course of the flows of the air, the recirculated flue gas and the flue gas-air mixtures in the recirculation device 5 by means of the (schematic) flow arrows S8 to S16. Arrows S1 to S16 indicate the fluidic configuration, i.e., the course of the flow of the various gases or moving masses in the biomass heating system 1. Many of the present components or features are fluidically connected in this regard, and this can be done indirectly (i.e., via other components) or directly.

As can be seen in FIG. 13 and FIG. 14, respectively, the flue gas that flows out of the heat exchanger 3 and out of the optional filter device 4 after the heat exchange enters the recirculation inlet 5 through the recirculation inlet 531 of the recirculation device 5 (cf. arrow S8). After an (optional) splitting of the flue gas flow by an (optional) recirculation inlet duct divider 532, the flue gas of the primary recirculation flows through the primary recirculation duct 56 (cf. arrow S10), depending on the position of one of the adjustable air valves 52, into the primary mixing chamber 541, where the flue gas is mixed with the primary fresh air, which also flows into the primary mixing chamber 541 through the primary air duct 58, depending on the position of another of the adjustable air valves 52 (cf. arrow S12).

As a result, a mixed flow (cf. arrow S14) is created in the primary mixing duct 54 from flue gas and primary fresh air, in which these two components mix advantageously due to the turbulence and the length of the primary mixing duct 54. At the end of the primary mixing duct 54, a homogeneous mixture of flue gas and primary fresh air has been created, which flows through the primary passage 541 to the primary combustion zone 26 (see arrow S16).

If a secondary recirculation (fluidically similar to the primary recirculation) is provided, the flue gas, after being split in the recirculation inlet duct divider 532, flows through the secondary recirculation duct 57 via a further adjustable air valve 52 into the secondary mixing chamber 552 (cf. arrow S9), in which the flue gas is mixed with the secondary fresh air (cf. arrow S11) likewise flowing into the secondary mixing chamber 552 via the secondary air duct 59 and a further adjustable valve 52. This mixing of the flue gas and the secondary fresh air continues in the secondary mixing duct (see arrow S13), thus improving the mixing of both components. The resulting advantageously homogeneous mixture flows through the secondary passage 551 into the annular duct 50 around the combustion chamber bricks 29 and through the recirculation nozzles 291 into the combustion chamber 24 (see arrow S15).

The schematic block diagram of FIG. 15 shows the flow pattern explained above with reference to FIGS. 12 to 14 in the respective individual components of the recirculation device 5, as well as that of the biomass heating system 1. In the block diagram of FIG. 15, both the primary recirculation and the optional secondary recirculation are shown as a complete circuit. The recirculation device 5 can also have only a primary recirculation.

By means of recirculation of the flue gas, it is in principle mixed with fresh air after combustion, in particular increasing the oxygen content, and fed to renewed combustion. This means that combustible residues in the flue gas, which would otherwise be discharged unused through the chimney, can now make a contribution to combustion after all.

The respective valves 52 with the primary mixing chamber 541 and the primary mixing duct 54 (which preferably extends approximately horizontally) form the primary mixing unit 5*a*. The respective valves 52 with the secondary mixing chamber 552 and the secondary mixing duct 55 may form the secondary mixing unit 5*b*. Regarding the parts of the flow guide hidden in FIG. 14, please refer to FIG. 3 and the associated explanations.

FIG. 15 also shows the so-called false air intake, which has been taken into account as a disturbance factor in the present case. In this case, false air from the environment enters the combustion chamber 24 via leaks and, in particular, also the fuel supply, whereby this represents an additional source of air for combustion which must be taken into account when adjusting the mixing ratio of the mixture or mixtures. Therefore, the biomass heating system 1 is preferably set up in the present case in such a way that the false air intake in the nominal load operating case is limited to less than 6%, preferably less than 4%, of the air volume of the mixture of primary fresh air and recirculated flue gas (and, if secondary recirculation is present, of the air volume of the mixture of secondary fresh air and recirculated flue gas and of the mixture of primary fresh air and recirculated flue gas).

Incidentally, false air could also disadvantageously enter the combustion chamber 24 from the further flow path of the flue gas after combustion, for example via the usual ash discharge. A solution to this problem is provided by the transition screw 73, described in more detail later, whereby this can improve flue gas recirculation 5 and thus flue gas treatment.

(Primary and Secondary Mixing Chamber with Valves)

Figure 16:
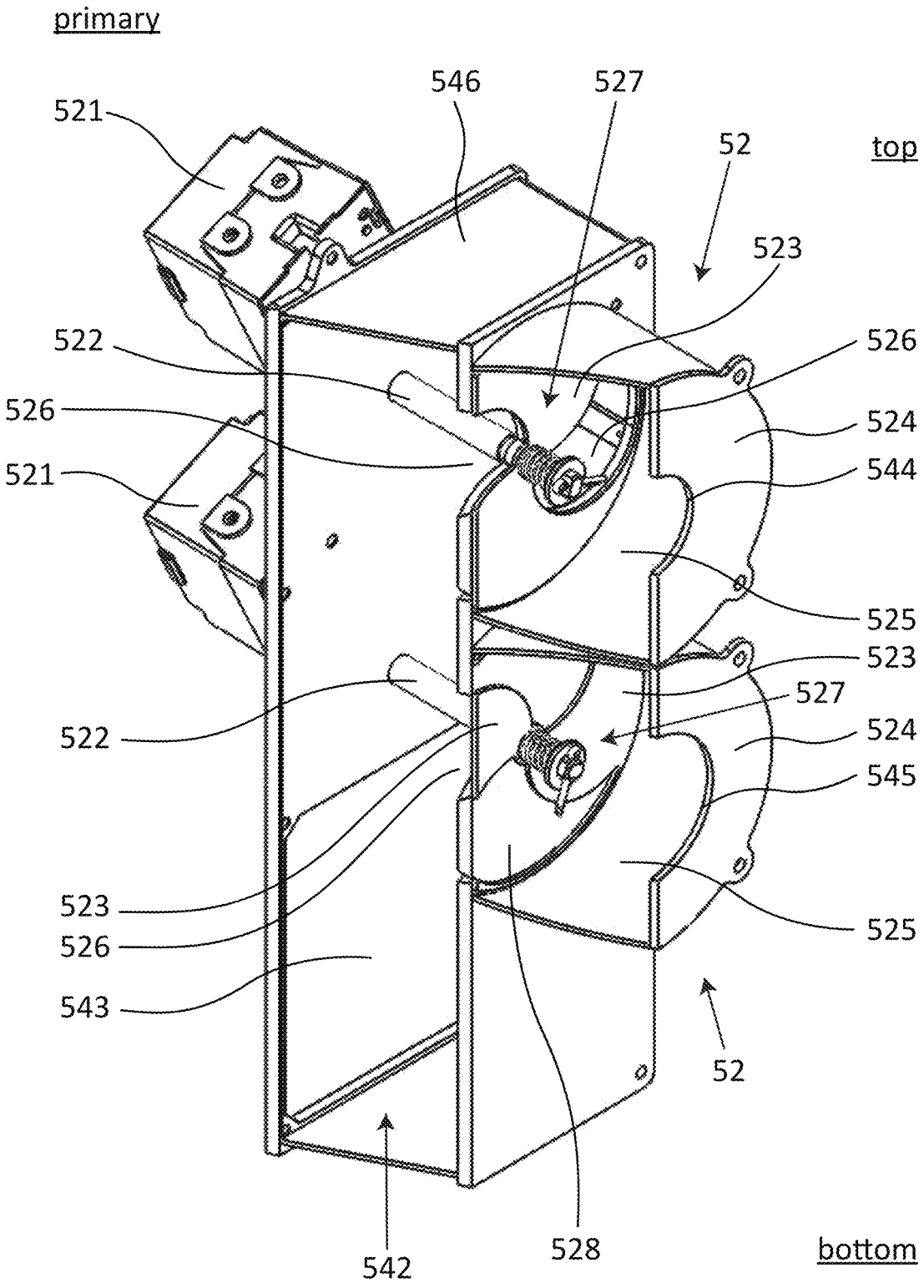
FIG. 16 shows, corresponding to the external views of FIG. 12 and FIG. 13, a sectional view of an exemplary primary mixing chamber, as well as of two inlet-side (primary) air valves 52 with their (primary) valve ant-/prechambers 525 from an oblique viewing angle.

FIG. 16 shows a sectional view of the primary mixing chamber 542, as well as the two inlet-side (primary) air valves 52 with their (primary) valve prechambers 525 from an oblique viewing angle (cf. in the external view correspondingly FIG. 12 and FIG. 13).

The recirculated flue gas flows via the tubular primary recirculation duct 56 through a primary recirculation valve inlet 544 into the optionally provided and, in the present case, only exemplarily arranged (primary) valve prechamber 525 at the top, which is enclosed by a valve housing 524 of the upper (primary) air valve 52. Instead of the valve prechamber 525, for example, the primary recirculation duct 56 can also be set up in such a way that its cross-section continuously widens towards the air valve 52, which could eliminate the need for a separate prechamber.

Via the primary air duct 58, primary fresh air flows through a primary air inlet 545 into an optionally provided and presently only exemplarily lower (primary) valve chamber 525, which is enclosed by a further valve housing 524/valve body 524 of the lower (primary) air valve 52.

Alternatively, the recirculated flue gas may be supplied to the lower valve prechamber 525, while the primary fresh air may be supplied to the upper valve prechamber.

The (primary) valve prechambers 525 of the (primary) air valves 52 are approximately frustoconical or cylindrical in shape, and expand the cross-sectional area of the, present exemplary upper, air valve 52 for the flow of the flue gas compared to the cross-section of the primary recirculation duct 56. Thus, on the one hand, material and space can be saved since the primary recirculation duct 56 can be provided with a smaller cross-section, and on the other hand, a larger effective valve area can be provided for controlling (or regulating) the flow through the air valve 52. Such a larger valve area has the particular advantages that it is less sensitive to contamination (including sooting) and has a lower pressure loss in the open state due to the larger cross-section.

In this example, the air valves 52 are rotary vane valves 52.

The upper and lower (primary) air valves 52 may be of matching design.

The two air valves 52, as rotary slide valves 52, each include a valve actuator 521, such as an electric motor capable of rotating a rotatably mounted valve actuating shaft 522, and a valve body 527 mounted on the valve actuating shaft 522 and including an actuating shaft mounting member and at least one valve leaf 523. The at least one valve leaf 523 of the valve body 527 of the respective air valve 52 is provided at the downstream end of the valve prechamber 525. The valve actuator axis 522 passes through the primary mixing chamber 542. Thus, the valve actuator 521 of the respective air valve 52 is provided on one side of the primary mixing chamber 542, and the valve body 527 is provided on the opposite side of the primary mixing chamber 542 from the valve actuator 521.

The at least one valve leaf 523 is arranged to be moved or rotated to at least two different positions to adjust the permeability of the air valve 52.

For example, in a first of the positions, at least a portion of at least one valve port 526 is fluidically blocked by means of a blocking surface provided by the valve leaf 523, such that the flue gas cannot flow through the portion of the at least one valve port 526 into the primary mixing chamber 542. In the second of the positions, the barrier surface at least partially clears the subregion to allow the flue gas to flow through the subregion.

It may be preferred that, in the first position, the air valve 52 is fully closed, with the blocking surface of the at least one valve leaf 523 fully covering the passage surface of the corresponding at least one valve aperture 526. In FIG. 16, this closed valve position is exemplified by the lower air valve 52.

Figure 17:
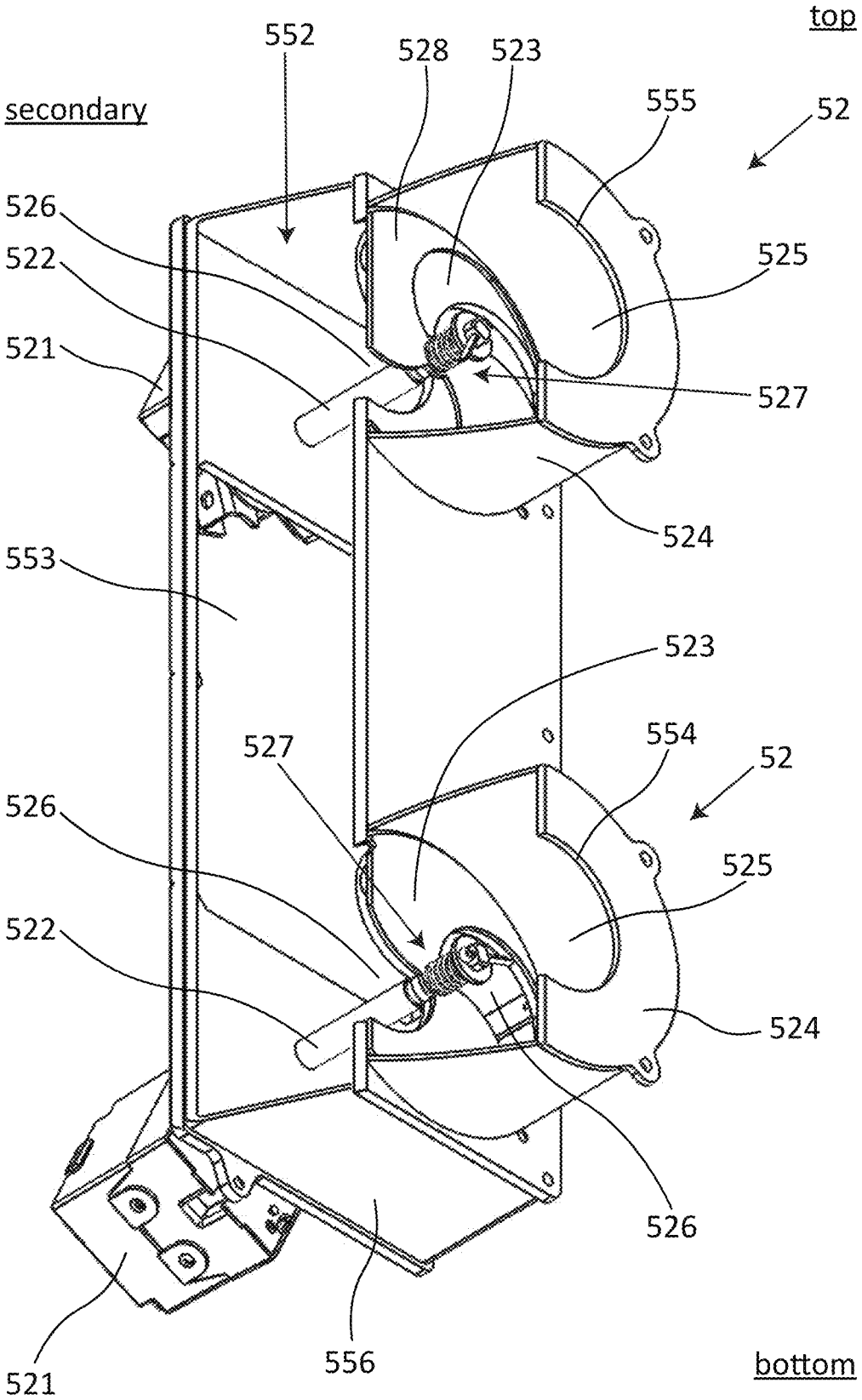
FIG. 17 shows, corresponding to the external views of FIG. 12 and FIG. 13, regarding the optional secondary recirculation, a sectional view of an exemplary secondary mixing chamber, as well as of two inlet-side (secondary) air valves with their (secondary) valve prechambers from a further oblique viewing angle.

Further, in the second position, the air valve 52 may preferably be fully open, with the blocking surface of the at least one valve leaf 523 fully clearing the passage surface of the corresponding at least one valve aperture 526. In FIG. 17, this open valve position is exemplified by the upper air valve 52. In the fully open state, the passage area of the air valve can be, for example, 5300 $mm^2$+−500 $mm^2$. Preferably, the air valve 52 can be freely adjusted between the fully open state and the fully closed state.

In the present example, two valve leafs 523 are provided in each air valve 52, each having two valve passage openings 526 into the primary mixing chamber 542 (i.e., the valve body forms a fan valve). However, only one or even a plurality of valve leafs and a corresponding number of valve apertures 526 may be provided.

Further, FIG. 16 shows a valve area 528 in which the valve passage openings 526 are provided and which is formed by the primary mixing chamber housing 546. Preferably, the valve wings 523 may rest on or contact the valve area 528 in any position of the valve body 527.

Preferably, the air valve 52 is configured such that the opening area of the valve passage 526 is larger than the cross-sectional area of the primary recirculating valve inlet 544 (and the primary air (valve) inlet 545) to optimize the pressure drop through the valve.

The two valve blades 523 are provided in mirror symmetry (point symmetry) with respect to the center axis of the valve actuation axis 522. Further, the two valve leafs 523 are crescent-shaped. Accordingly, the two corresponding valve apertures 526 may be similarly crescent-shaped. The crescent shape can, for example, be provided in such a way that it tapers to a point at the outer end of the crescent.

This crescent shape of the at least one valve leaf 523 causes the flow passing through the at least one valve orifice 526 to have an even more irregular cross-sectional profile, but without increasing the pressure drop too much. This improves mixing in the primary mixing chamber 542.

The above design of the air valve 52 as a rotary slide valve is furthermore relevant in a so-called low-load operation or also a switch-on operation of the biomass heating system 1, i.e. when it is only operated at low temperatures. Due to the low temperatures, the conventional flap valves/flaps can become particularly dirty due to soot in the flue gas. As a result of this contamination, the usual valves can only be operated with difficulty, which increases their load and consequently the wear to a disadvantage. The present embodiment of the air valve 52 reduces this problem.

By means of the (exemplarily upper) air valve 52, in this case also exemplarily the rotary slide valve 52, it is possible to adjust the quantity of the recirculated flue gas as required before mixing it with (fresh) primary air. Accordingly, the further air valve 52 for the primary fresh air enables the quantity of the supplied primary fresh air to be controlled. This allows the mixing ratio of primary fresh air and recirculated flue gas to be advantageously adjusted. Thus, the mixing ratio can be adapted to different operating points or the optimum operating point of the combustion.

The upper rotary valve 52 may also be referred to as a primary flue gas recirculation valve.

The lower rotary slide valve 52 may also be referred to as a primary fresh air supply valve.

Instead of rotary slide valves 52, other types of valves can be used, for example, sliding slide valves, liner slide valves or ball valves.

The primary mixing chamber 542, which is arranged downstream of the two air valves 52 in terms of flow, is used to combine the recirculated flue gas with primary fresh air, which is provided for the primary combustion zone 26 of the combustion chamber 24. The primary mixing chamber 542 and the two (primary) valves 52 are part of the primary mixing unit 5*a* and are used for adjustable mixing of flue gas with primary fresh air.

The primary mixing chamber 542 is formed by a primary mixing chamber housing 546. The primary mixing chamber housing 546 is provided in a generally cuboidal or box-like shape and includes a primary mixing chamber outlet 543. The primary mixing chamber outlet 543 is provided downstream of the two valve passages 526/valve apertures 526. The primary mixing chamber outlet 543 is further provided on a side of the primary mixing chamber housing 546 opposite the side of the two valve passage openings 526.

The primary mixing chamber housing 546 with its valve apertures 526 and the primary mixing chamber outlet 543 may be arranged such that they do not directly face each other through the chamber volume. In other words, the inlet ports 526 of the primary mixing chamber 542 and the outlet port 543 from the primary mixing chamber 542 are provided such that the combining flows of the flue gas and the primary fresh air can mix better as the flows are combined.

For example, in the primary mixing chamber 542 of FIG. 16, the (total) flow of flue gas is forcefully deflected downward by the upper air valve 52 directly before the primary fresh air enters the primary mixing chamber 542. This brings the two flows together advantageously and allows them to mix better.

In addition, both the flow of flue gas through the upper air valve 52 and the flow of primary fresh air through the lower air valve 52 (which are directed to the left in FIG. 16, for example) impinge against a wall of the primary mixing chamber housing 546, forcing them to form air turbulence even at low flow velocities. This promotes uniform mixing of the flue gas with the primary fresh air.

In addition, the inlet flows of primary fresh air and flue gas into the primary mixing chamber 542 are crescent-shaped, providing an additional element that creates turbulence even as they enter the primary mixing chamber 542.

Good or homogeneous mixing of the recirculated flue gas with the primary fresh air is important, as otherwise stranding (i.e. permanent inhomogeneities) can occur in the air supplied to the combustion, which has a detrimental effect on the combustion process. For example, the pollutant output of the biomass heating system 1 increases when there is an inhomogeneous mixture of primary (fresh) air and recirculated flue gas.

As a result, the above configuration advantageously improves the mixing of the flue gas with the primary fresh air with a simple structure.

FIG. 17 shows, regarding the secondary recirculation, a sectional view of the secondary mixing chamber 552, as well as of the two inlet-side (secondary) air valves 52 with their (secondary) valve prechambers 525 from an oblique viewing angle (cf. in the external view correspondingly FIG. 12 and FIG. 13). Identical or similar features of FIG. 17 correspond structurally and functionally to those of FIG. 16, so to avoid repetition, reference is made to the foregoing discussion of the largely analogous FIG. 16.

The recirculated flue gas flows via the tubular secondary recirculation duct 57 through a secondary recirculation valve inlet 554 into the optionally provided and, in the present example, lower (secondary) valve prechamber 525, which is enclosed by a valve housing 524 of the upper (secondary) air valve 52.

Via the secondary air duct 58, secondary fresh air (fresh air) flows through a secondary air (valve) inlet 555 into an optionally provided and, in the present exemplary case, upper (secondary) valve prechamber 525, which is enclosed by a further valve housing 524/valve body 524 of the lower (secondary) air valve 52.

In the present case, the position of the inlets of the recirculation ducts 56, 57 into the valve prechambers 525 (and thus the position of the valves 52 provided for the flue gas) was arranged in such a way that the recirculation ducts 56, 57 can be guided in parallel over as long a distance as possible. Thus, a common insulation of the recirculation ducts 56, 57 can be provided and the thermal loss over the distance of the recirculation ducts 56, 57 can be advantageously reduced.

Alternatively, the recirculated flue gas may be supplied to the upper (secondary) valve chamber 525 while the secondary fresh air is supplied to the lower (secondary) valve chamber 525.

The secondary mixing chamber 552 includes a secondary mixing chamber housing 556 having a mixing chamber volume and a secondary mixing chamber outlet 553 similar to the primary mixing chamber 542.

The two air valves 52 of FIG. 17 are also designed as rotary slide valves, as in FIG. 16. The upper and lower (secondary) air valves 52 may be of matching design.

The lower rotary valve 52 may also be referred to as a secondary flue gas recirculation valve. The lower rotary valve 52 of FIG. 17 is shown in a fully open condition.

The upper rotary slide valve 52 may also be referred to as a secondary fresh air supply valve. The upper rotary valve 52 of FIG. 17 is shown in an only partially open condition.

The two secondary rotary spool valves 52 are provided in an approximately identical manner to the two primary rotary spool valves 52 of FIG. 16. This is particularly true of the crescent shape of the valve leafs 523.

The secondary mixing chamber 552, located downstream of the two air valves 52, is used to combine the recirculated flue gas with primary fresh air, which is provided for the primary combustion zone 26 of the combustion chamber 24. The primary mixing chamber 542 and the two (primary) valves 52 are part of the primary mixing unit 5*a* and are used for adjustable mixing of flue gas with primary fresh air.

The secondary mixing chamber 552 is formed by a secondary mixing chamber housing 556. The secondary mixing chamber housing 556 is provided in a generally cuboidal or box-like shape and includes a secondary mixing chamber outlet 553. The secondary mixing chamber outlet 553 is provided downstream of the two valve passages 526. The secondary mixing chamber outlet 553 is further provided on a side of the secondary mixing chamber housing 556 opposite the side of the two valve passage openings 526.

The secondary mixing chamber housing 556, with its valve apertures 526 and secondary mixing chamber outlet 553, may further be configured such that they do not directly face each other through the chamber volume. In other words, the inlet ports 526 of the secondary mixing chamber 552 and the outlet port 553 from the secondary mixing chamber 552 are provided such that the combining flows of the flue gas and the primary fresh air can mix better as the flows are combined.

In contrast to the configuration of the primary mixing chamber 542 of FIG. 16, the secondary mixing chamber 552 shows an alternative configuration of the inlet ports 526 of the secondary mixing chamber 552 and the outlet port 553 from the secondary mixing chamber 552. Here, the outlet opening 553 is located between the two inlet openings 526 (or the valve passage openings 526). Thus, the secondary fresh air flow from the upper inlet opening 526 and the flue gas flow from the lower inlet opening 526 are deflected in such a way that they meet approximately in the middle of the secondary mixing chamber 552, mix there with vortex formation and exit as a common flow from the outlet opening 553. By changing direction several times and combining the two flows in this way, homogeneous mixing of the secondary fresh air and the primary fresh air can be advantageously achieved, just as in the case of the primary mixing chamber 542.

Thus, the effects of the configuration of the secondary mixing chamber 552 of FIG. 17 are analogous to those of the configuration of the primary mixing chamber 542 of FIG. 16, to which reference is made.

Good (homogeneous) mixing of the primary fresh air or secondary fresh air with the recirculated flue gas makes an important contribution to optimizing the combustion processes in the biomass heating system 1. For example, the primary fresh air and the secondary fresh air usually have an oxygen content of about 21%, and the recirculated flue gas has an oxygen content of only about 4 to 5% in the nominal load operating case. If inhomogeneous mixing were now to occur during recirculation, the fuel bed 28 would be inhomogeneously supplied with oxygen from below and also the primary combustion zone 26. In the worst case, if there were a lot of stranding during recirculation, air with only a very small amount of oxygen would be added to some of the fuel for combustion. The combustion process of this part would thus be significantly deteriorated.

However, by means of the primary mixing unit 5*a* and the (optional) secondary mixing unit 5*b*, a homogeneous mixing of the primary fresh air and the secondary fresh air, respectively, with the recirculated flue gas is provided. Other advantages of homogeneous mixing are the reduction of temperature peaks (which can cause fouling and slagging), and the reduction of flue gas velocity peaks (which increase material stress and erosion of the equipment).

In the present case, the design of the secondary air or recirculation nozzles 291 for secondary recirculation was based on the same aspects as set out above.

The secondary air or recirculation nozzles 291 are arranged to provide turbulent mixing and homogenization of the flow across the cross-section of the combustion chamber 24. In particular, the secondary air or recirculation nozzles 291 are arranged and oriented such that they can induce a swirling flow in the combustion chamber 24.

In particular, the design of the secondary air nozzles 291 explained above leads to a minimization of the combustion volume as well as to a reduction of emissions.

If only primary recirculation is provided, both the mass flow (kg/h) and the mixing ratio of the mixture of recirculated flue gas and primary fresh air can be advantageously controlled by means of the two (primary) air valves 52 in such a way that an optimum operating point of the combustion in the biomass heating system 1 is reached or at least approximately reached.

Should secondary recirculation and primary recirculation be provided, both can advantageously be controlled independently. This means that the mass flow (kg/h) and the mixing ratio of the primary recirculation mixture and the mass flow (kg/h) and the mixing ratio of the secondary recirculation mixture can be set independently of each other.

This allows the combustion to be advantageously adjusted flexibly and optimized at the operating point, even taking into account a previously known false air intake. In other words, in particular, the use of two (primary recirculation only) or four (primary and secondary recirculation) independently adjustable air valves 52 results in providing a larger control range for the recirculation device 5 than usual.

During operation, the primary and optionally also the secondary air flow range in particular can be regulated fully automatically via a control system. This achieves optimized performance and combustion, reduces slag formation by falling below the ash melting points in the combustion chamber and ensures high efficiencies, very low particulate matter values with low NOx emissions; and this with different fuels and fuel qualities, as the recirculation device 5 is thus particularly suitable for hybrid firing with different fuels.

The recirculation device 4 thus provides for improved flue gas treatment.

(Flue Gas Condenser)

Further, a flue gas condenser may be provided on the biomass heating system 1 to provide condensing technology. A flue gas condenser is a special type of heat exchanger.

Depending on the composition of fuel and supply air, their both humidity and the content of chemically bound hydrogen atoms in the fuel, different amounts of water vapor and other condensable substances are formed in the flue gas during combustion. If this is cooled below the dew point in a flue gas condenser, water vapor and accompanying substances can condense and the heat of condensation released can be transferred to the heat transfer medium. As the latent heat content of the flue gas is thereby utilized, fuel use and CO2 emissions can be reduced as a result.

During the combustion of biological materials, which is usually incomplete (especially in the case of wood chip heating systems and pellet heating systems), gloss soot, fly ash, fly dust, wood tar or tar, and possibly unburned hydrocarbons are deposited when the flue gas cools down. These heavily contaminate the surfaces of the heat exchanger and usually lead to caking—which impedes or clogs the exhaust gas/flue gas or chimney draught. This is why, for example, wood-burning stoves and tiled stoves without flue gas condensation systems are operated with flue gas temperatures higher than 120° C., which is disadvantageous because it is energy inefficient. The pollutants and water vapor (whose condensation heat and residual energy content can account for around 70% of the calorific value) that are not separated as a result are adversely emitted into the environment.

In the case of a flue gas condenser for the biomass heating system 1 in hybrid technology, the task is thus to provide an optimized flue gas condenser with high efficiency that is nevertheless insensitive to fouling.

Figure 18:
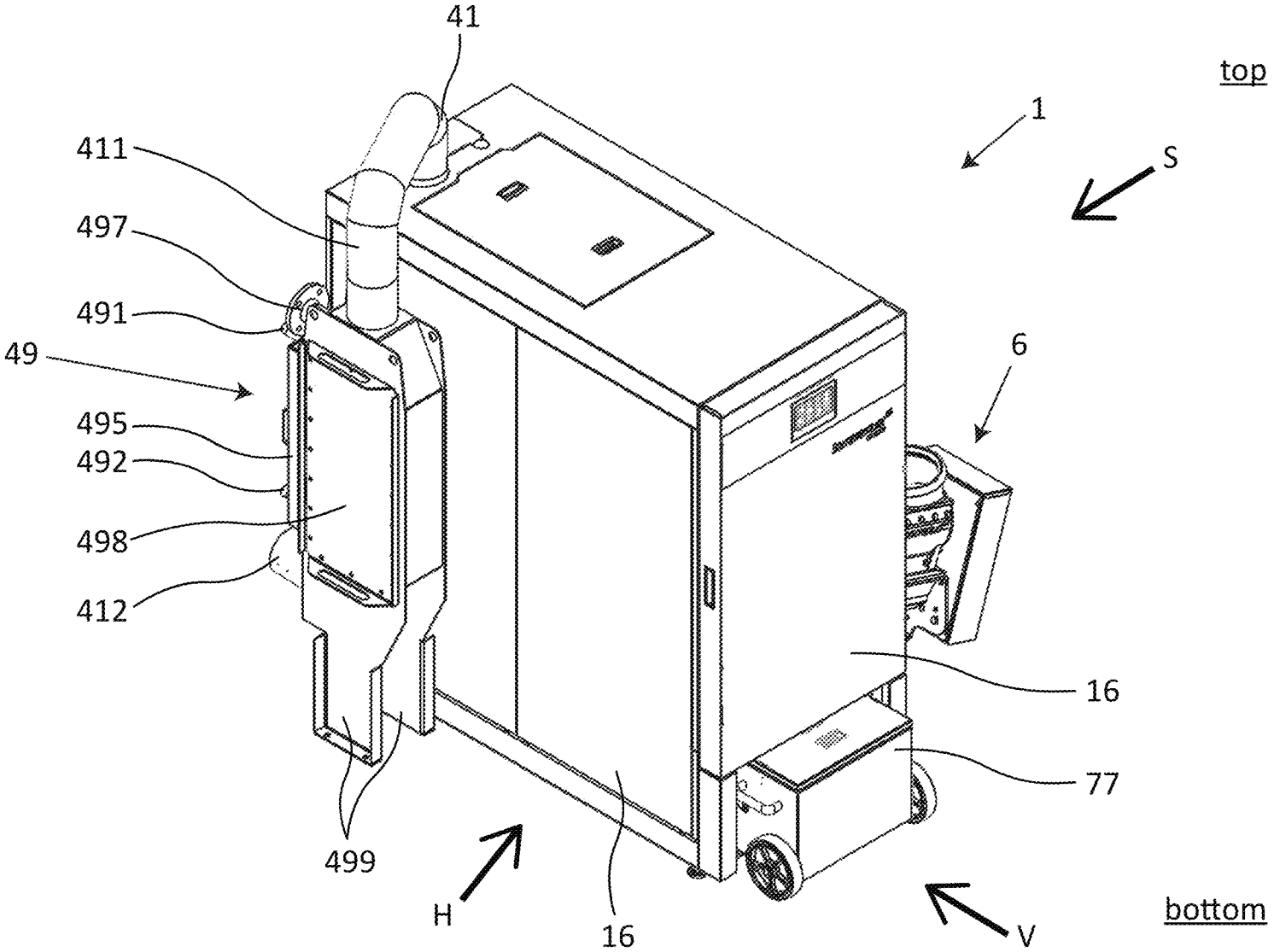
FIG. 18 shows a three-dimensional overview view of the biomass heating system of FIG. 1 with an additional outer casing/exterior cladding and an additional flue gas condenser.

FIG. 18 shows a three-dimensional overview view of the biomass heating system 1 of FIG. 1 with an additional outer cladding 16 (for example, an insulation 16) and an additional flue gas condenser 49. The flue gas condenser 49 is positioned adjacent to the boiler 11 by means of a mounting device 499 and is connected to the flue gas or exhaust gas outlet 41 of the boiler 11 via a flue gas or exhaust gas supply line 411. The flue gas flows through the flue gas condenser 49 and out of it through a flue gas outlet 412. The flue gas condenser 49 includes a side surface 498 having a presently closed maintenance opening.

Further, a flange 497 is provided with an opening to support a spray bar (not shown) projecting inwardly into the flue gas condenser 49. This spray bar protruding horizontally from the flange has downward (spray) nozzles and is connected to a water supply. When the water supply is activated, the interior of the exhaust gas condenser 49 can be cleaned.

In the flue gas condenser 49 of FIG. 18, a first fluid port 491/first fluid connection 491 and a second fluid port 492/second fluid connection 492 for a heat exchange medium are further provided on a head element 495 of the flue gas condenser 49. One of the connections is an inlet and the other is an outlet. Usually, the heat exchange medium is circulated in a circuit, making the heat absorbed by the heat exchange medium usable.

A condensate outlet 496 is provided on the underside of the flue gas condenser 49, through which the condensate generated inside the flue gas condenser 49 can drain.

Figure 19A:
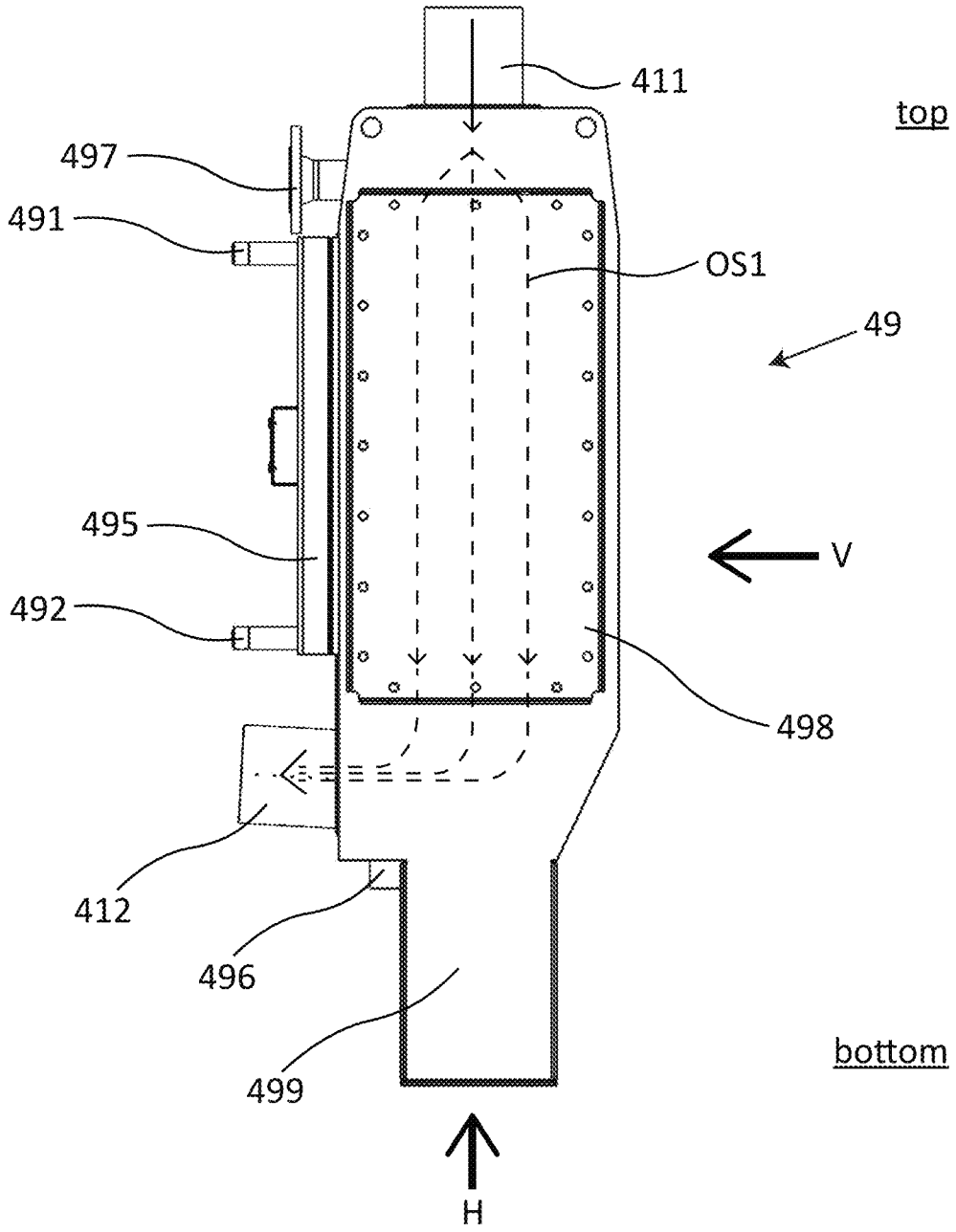
FIG. 19*a* shows the flue gas condenser 49 of FIG. 18 in a side view from the direction of arrow H of FIG. 18.
Figure 19B:
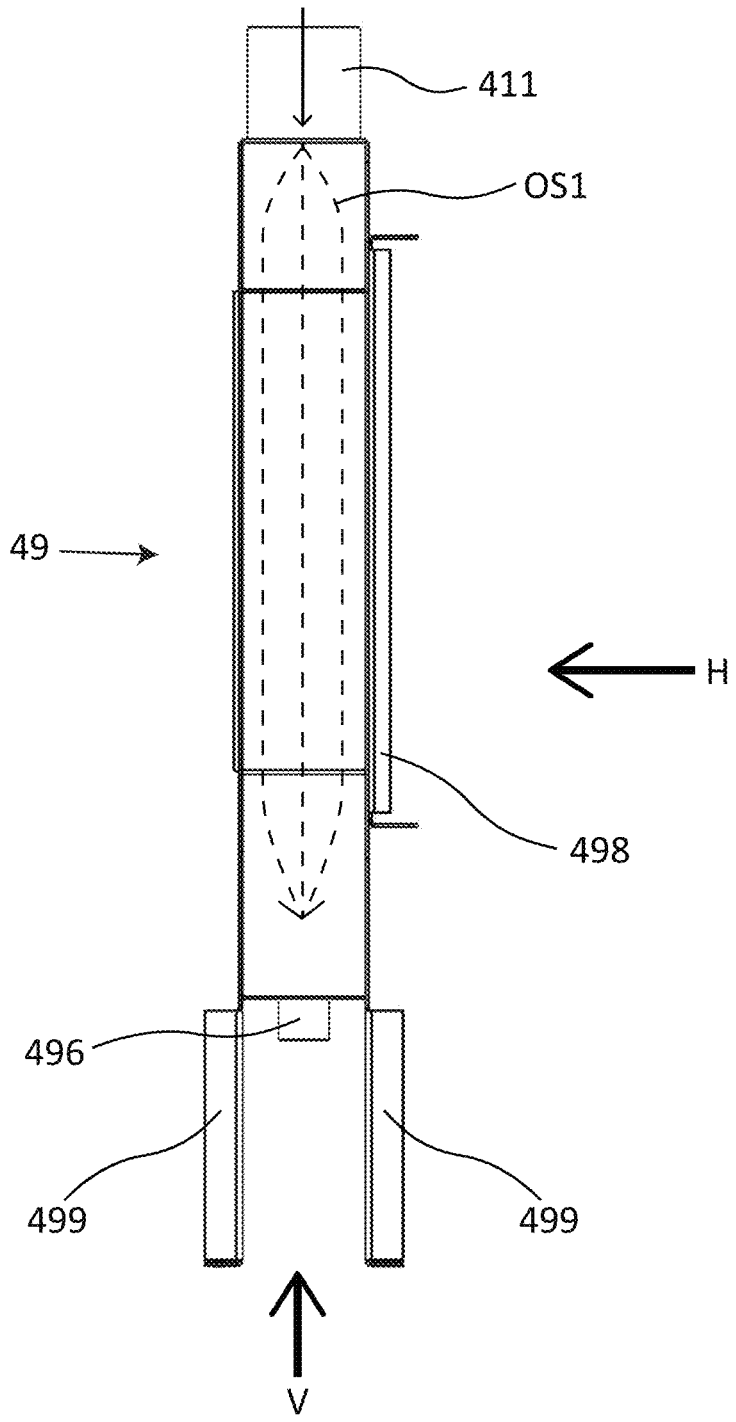
FIG. 19*b* shows the flue gas condenser 49 of FIG. 18 in a side view from the direction of arrow V of FIG. 18.

FIG. 19*a* shows the flue gas condenser 49 of FIG. 18 in a side view from the direction of arrow H of FIG. 18. FIG. 19*b* shows the flue gas condenser 49 of FIG. 18 in a side view from the direction of arrow V of FIG. 18.

The arrow OS1 schematically shows the flow or flow of the flue gas inside the flue gas condenser 49 largely from top to bottom, i.e., from the flue gas inlet 411 to the flue gas outlet 412. In this case, the flow of the flue gas is largely directed downward and, after entering the flue gas condenser 49, is distributed over its internal volume.

FIG. 20 shows an interior view of the flue gas condenser 49 of FIG. 19*a* and FIG. 18.

Inside the flue gas condenser 49, a plurality of heat exchanger tubes 493 are arranged transverse to the main flow direction. These U-shaped heat exchanger tubes 493 have the heat exchange medium flowing through them and have the flue gas flowing around them. In the process, heat exchange takes place. In particular, condensation of the flue gas can take place at the heat exchanger tubes 493, whereby components of the flue gas (in particular water) are separated in the flue gas condenser. The plurality of heat exchanger tubes 493 may also be referred to as heat exchanger tube bundles 493.

A condensate collection funnel 4961 is provided for the condensate in the lower part of the flue gas condenser 49, which collects the condensate and discharges it to the condensate outlet 496. From there, the condensate can be disposed of. The condensate collection funnel 4961 is also arranged to deflect the flow of flue gas in the lower portion of the flue gas condenser 49 laterally or horizontally toward the flue gas outlet 412.

The downward flow of the flue gas toward the condensate outlet 496 advantageously accelerates the discharge of the condensate.

The plurality of U-shaped heat exchanger tubes 493 is supported on one side by means of a tube support member 4931. The ends of the plurality of U-shaped heat exchanger tubes 493 are further attached, such as welded, to a tube sheet member 4932. The tube sheet member 4932 is a plate-like member having a plurality of apertures for the heat exchanger tubes 493. The tube sheet member 4932 forms an interior portion of the head member 495. The head element 495 includes a chamber-like flow guide between the first fluid port 491 and the second fluid port 492 such that the plurality of U-shaped heat exchanger tubes 493 are connected in series in groups, respectively. For example, a predetermined number of U-shaped heat exchanger tubes 493 may be fluidically connected in parallel to form a group of U-shaped heat exchanger tubes 493, and the groups may in turn be fluidically connected to each other in series. This flow guidance may be provided by, among other things, a head element flow guide 4951, comprising divider plates 4951, which divides a cavity in the head element 495 into individual fluidic sections. This is particularly clear from the synopsis of FIGS. 20 and 23.

Heat exchanger tubes 493 are provided in a 1-strand grouped configuration. This 1-flue design is easier to clean, since only one set of cleaning nozzles is required, and advantageously provides for a more homogeneous inflow and flow of the flue gas.

Heat exchange fluid flows through one of the fluid ports 491, 492 into the exhaust condenser 49, and subsequently, due to the divider plates 4951, alternately through the header element 495 and the U-shaped heat exchanger tubes 493, and then back out through the other of the fluid ports. In this process, the heat exchange medium flowing through the flue gas condenser 49 absorbs heat from the flue gas.

The flue gas condenser 49 forms a smooth tube heat exchanger with the heat exchanger tubes 493. In this case, the heat exchange medium is located in the heat exchange tubes 493 and the flue gas flows around the heat exchange tubes 493.

The heat exchanger tubes 493 may, for example, be made of the material 1.4462 or 1.4571. The stainless steel material 1.4462 (preferably X2CrNiMoN22-5-3) has proven to be more resistant and better than material 1.4462 (V4A). In detail, 1.4462 exhibits particularly high corrosion resistance (especially against stress corrosion cracking and chemical corrosion) and very good mechanical properties (e.g. strength), is suitable for use at temperatures from 100° C. to 250° C., is readily weldable and polishable. The reduced nickel content compared with conventional austenite also makes the use of steel 1.4462 advantageous from an economic point of view, as it is not significantly more expensive despite the better material properties.

An important factor in optimizing the efficiency of the heat exchange process is the optimization of the areas and their flow of the plurality of U-shaped heat exchanger tubes 493. This is explained in more detail below with reference to FIGS. 21 to 26.

FIG. 21 shows the flue gas condenser 49 from a top view looking into the opening for the flue gas supply line 411 of the flue gas condenser. It can be seen that the plurality of heat exchanger tubes 493 form a structure intersecting the flow of flue gas, in which the plurality of heat exchanger tubes 493 are vertically aligned with each other. Thus, the present flue gas condenser 49 has a cross flow concerning the flow of the heat exchange medium (for example, water) relative to the flow direction of the flue gas (OS1). Spaces (gaps) of a constant width are provided between the heat exchanger tubes 493.

Figure 22:
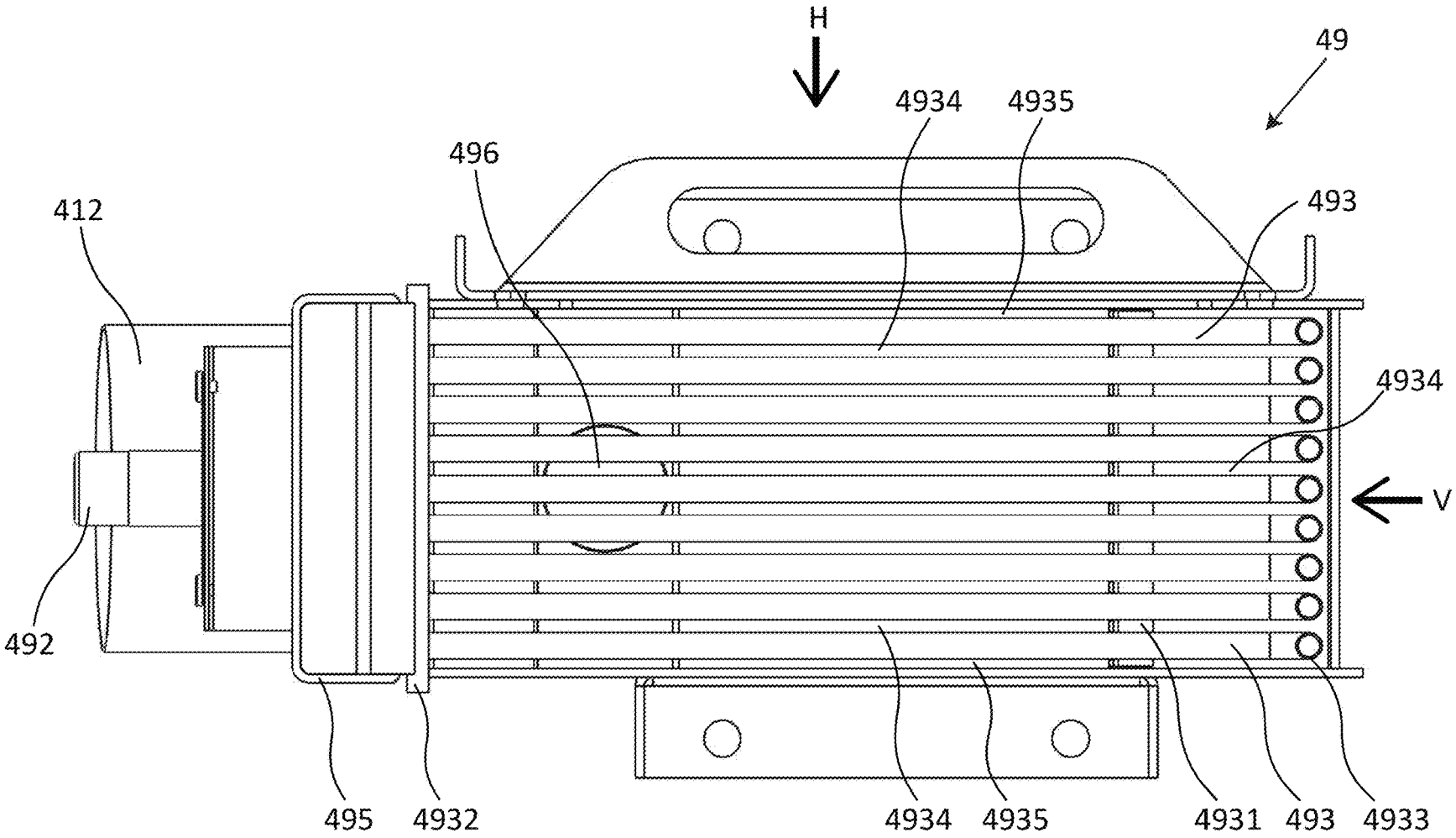
FIG. 22 shows the flue gas condenser of FIG. 18 from a horizontal sectional view from above.

FIG. 22 shows the flue gas condenser 49 of FIG. 18 from a horizontal sectional view from above. In this case, the heat exchanger tubes 493 are arranged over the entire cross-sectional area of the flue gas condenser 49 in such a way that first (horizontal) gaps 4934 between the heat exchanger tubes 493 with respect to each other and second (horizontal) gaps 4935 between the heat exchanger tubes 493 and the outer walls of the flue gas condenser 49 have an at least largely constant width. Minor exceptions to this may be present at the reversal points 4933 formed by the loops of the heat exchanger tubes 493, as there are inevitably varying and sometimes larger gaps here. A U-shaped heat exchanger tube 493 thus has two straight individual tubes with a reversal point 4933 between them.

As viewed from FIG. 22, the first spaces 4934 form a kind of vertically and rectilinearly extending "alley" between the heat exchanger tubes 493 through which the flue gas can flow vertically. This reduces the pressure drop, while the present design with smooth tubes can ensure efficient heat exchange.

Further, the first spaces 4934 between the heat exchanger tubes 493 and the second spaces 4935 between the heat exchanger tubes 493 and the outer walls of the flue gas condenser 49 may further be provided with a width such that the first spaces 4934 have a greater horizontal width than the second spaces 4935.

The protruding arrangement of the gaps 4934, 4935 advantageously leads to a uniform distribution of the flue gas flow and thus to a more homogeneous and efficient heat exchange.

Figure 23:
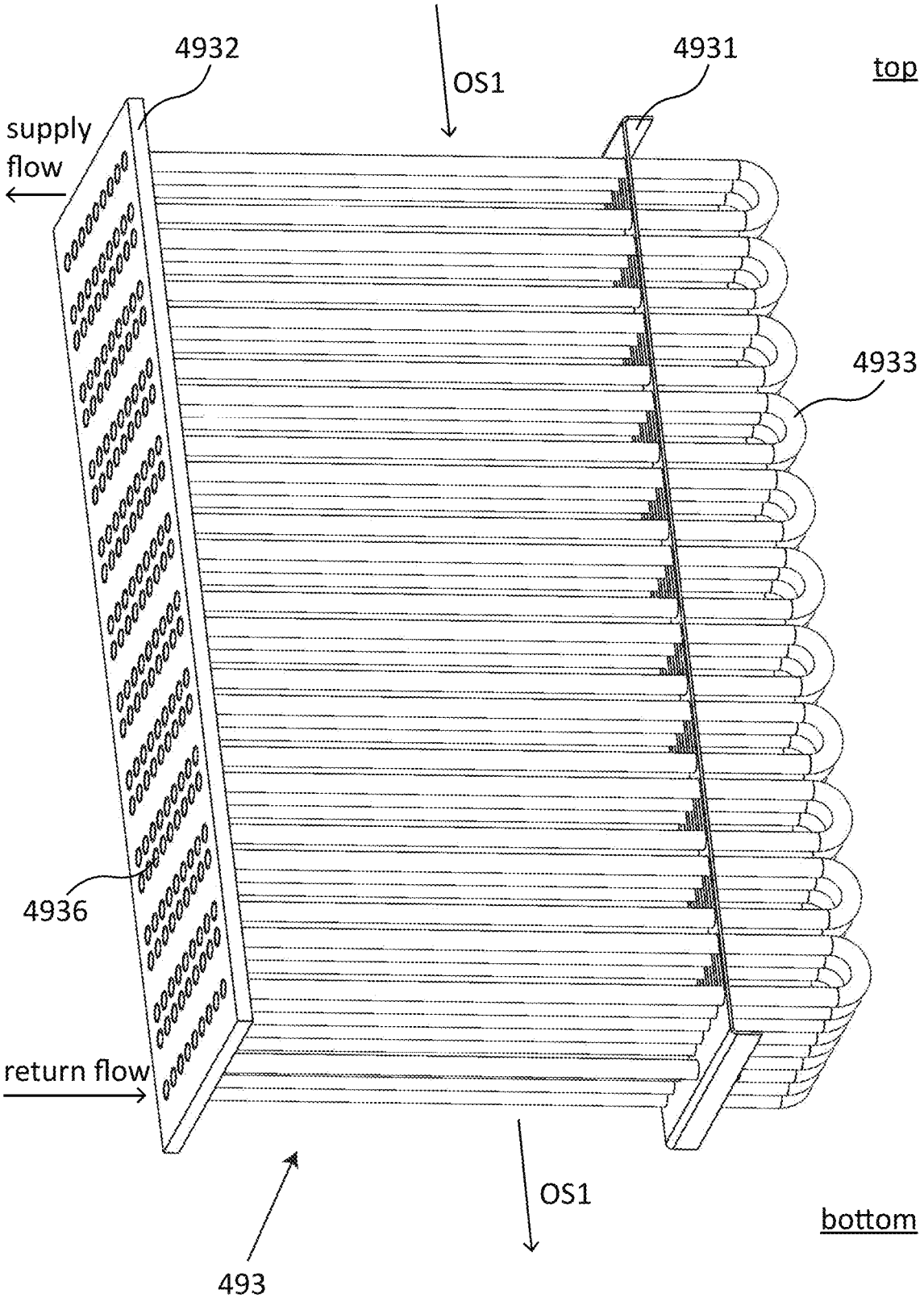
FIG. 23 shows a three-dimensional view of a plurality of heat exchanger tubes with the tube sheet member and the tube support member.

FIG. 23 shows a three-dimensional view of the plurality of heat exchanger tubes 493 with the tube sheet member 4932 and the tube support member 4931. The tube retaining member 4931 may be formed, for example, from a sheet of metal with punched openings for the U-shaped heat exchanger tubes 493. The tube support member 4931 is used to support the heat exchanger tubes 493 and reduce mechanical stress at the ends of the heat exchanger tubes 493 on the tube sheet member 4932. The plate-shaped tube sheet member 4932 is connected to the heat exchanger tubes 493 such that passages 4936 corresponding to the heat exchanger tubes 493 are provided in the tube sheet member 4932 and the heat exchange medium can flow through the tube sheet member 4932 accordingly.

The external dimensions of the plurality of heat exchanger tubes 493 (the tube bundle) and tube sheet element 4932 may be, for example, 642×187×421 mm, providing a very compact structure.

The heat exchanger tubes 493 are arranged vertically with their U-shape, whereby two individual tubes (or tube sections) are provided vertically one above the other for each U-shaped heat exchanger tube 493.

Figure 24:
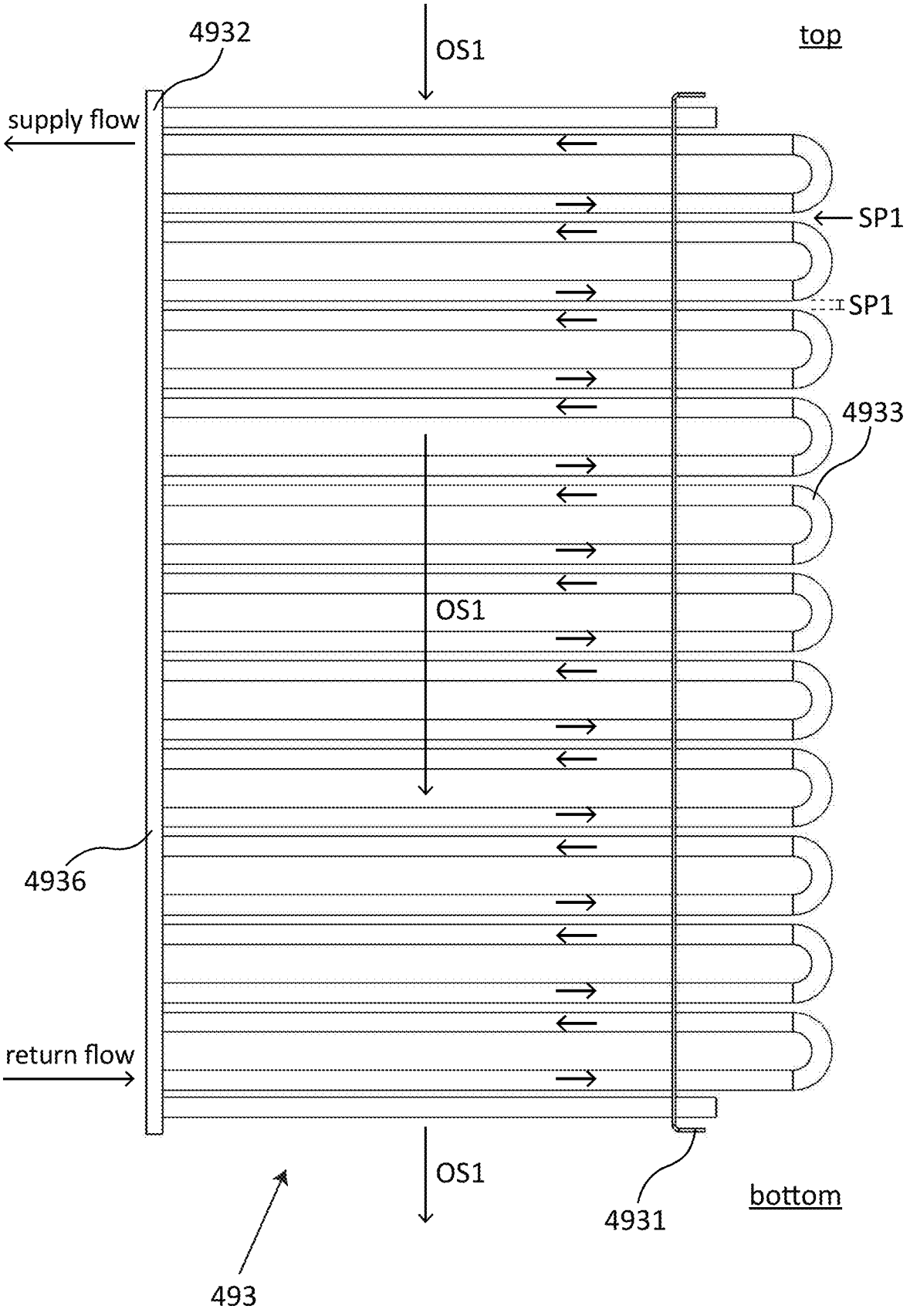
FIG. 24 shows a side view of the plurality of heat exchanger tubes of FIG. 23.

FIG. 24 shows a side view of the plurality of heat exchanger tubes 493 of FIG. 23. Preferably, the second fluid port/connection 492 may be the inlet for the heat exchange fluid, and it may be the first fluid port 491 that is the outlet for the heat exchange fluid. For this case, the flow of the heat exchanger medium is indicated in FIG. 24 by the arrows on and in the heat exchanger tubes 493. The three arrows marked OS1 schematically show the flow of the flue gas. The flow of the heat exchanger medium leads alternately from left to right and vice versa, and also meanders from bottom to top against the direction of flow. In this respect, the present flue gas condenser 49 has a cross-countercurrent configuration. This configuration has proven to be ideal for heat recovery. The flue gas condenser 49 is also advantageously a smooth tube condenser which can be easily cleaned.

Figure 25:
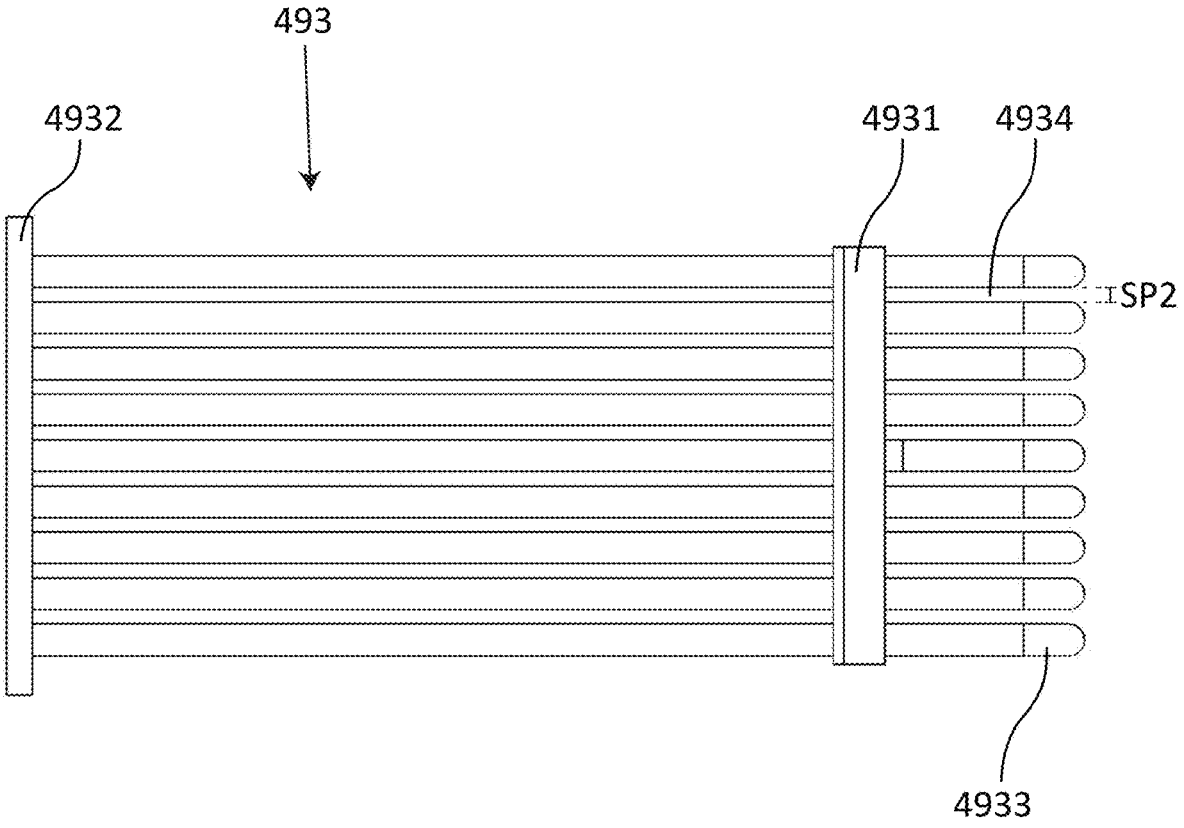
FIG. 25 shows a top view of the plurality of heat exchanger tubes of FIG. 23.

FIG. 25 shows a top view of the plurality of heat exchanger tubes 493 of FIG. 23 to illustrate the overall geometry of the plurality of heat exchanger tubes 493 of FIG. 23.

The flue gas also passes through the heat exchanger tubes 493 from above, i.e., from the viewpoint of FIG. 25, the passages for the flue gas can be seen. These passages are elongated gaps or alleys through which the flue gas must pass distributed and with a large surface coverage of the tubes 493.

In this context, the first interspaces/spaces 4934 may have a (for example, horizontal) width SP2 (a gap or lane width for the flue gas in the first direction), which may preferably be 6.0 mm+−2 mm. This width SP2 is thus much smaller than usual, which improves efficiency.

For example, the width SP2 can be equal to or smaller than the width SP1 (a minimum distance).

For example, the tube outer diameter of the heat exchanger tubes 493 may be 12.0 mm+−1 mm. The distance of the transverse pitch of the flue gas condenser 49 can thus be, for example, 12.0 mm+6 mm=18 mm+−1.5 mm.

The overall structure and in particular the width SP2 are advantageously dimensioned in such a way that high heat transfer rates and thus overall efficiencies (>107%) can be achieved with very low volume requirements. The width SP2 may advantageously be provided as an alley coincident with all of the plurality of heat exchanger tubes 493.

In the plurality of heat exchanger tubes 493 shown in FIG. 23, eleven (11) tube bundles are provided vertically and nine (9) tube bundles are provided horizontally, which has been found to be a good compromise between compactness of the structure, efficiency of the heat exchanger, pressure drop of the flue gas, pressure drop of the heat exchange medium, and complexity of the mechanical structure. Thus, for example, a total of 99 U-shaped heat exchanger tubes 493 may be provided.

The horizontal tube bundles of the heat exchanger tubes 493 are thus arranged in groups in a first direction (in this example, the horizontal direction) and parallel to each other. One such group is shown in FIG. 25.

The groups of horizontal tube bundles are also arranged parallel to one another in a second direction (for example vertically above one another), as shown by way of example in FIG. 24. The first and second directions can preferably be orthogonal to each other.

After calculations and practical tests, it has been found that the following ranges of the number of tubes vertically and horizontally can lead to the heat exchanger optimized in the above sense:

- 8 to 14, preferably 10 to 12, vertical U-shaped heat exchanger tubes 493, as well as
- 7 to 12, preferably 8 to 10, horizontal U-shaped heat exchanger tubes 493.

In terms of individual tubes, the following number ranges can be provided (by way of example):

16 to 28, preferably 20 to 24, vertical (single) tubes; and 7 to 12, preferably 8 to 10, horizontal (single) tubes.

A U-shaped heat exchanger tube 493 includes 2 individual tubes from the vertical view, and 1 individual tube from the horizontal view.

Figure 26:
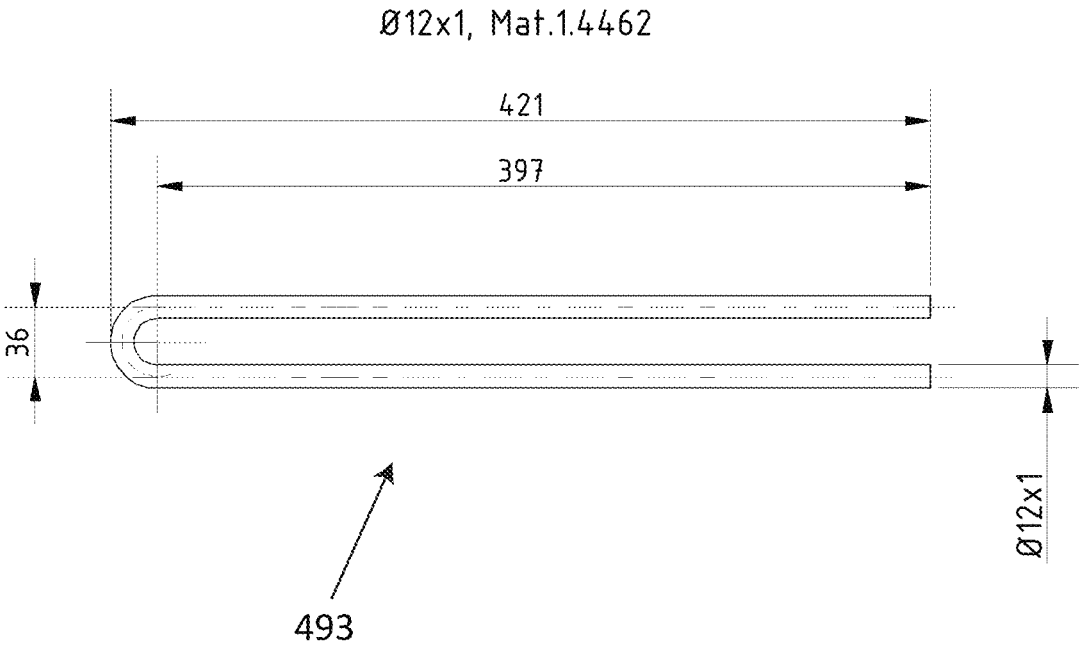
FIG. 26 shows a top view of the plurality of heat exchanger tubes of FIG. 23.

FIG. 26 shows a single (highlighted) exemplary U-shaped heat exchanger tube 493 of FIG. 23 and its sizing. However, the sizing of the heat exchanger tube 493 may also differ. For example, an alley width SP2 of 6 mm+−2 mm can also be maintained with a different dimensioning of the heat exchanger tube 493.

The centerline indicated on the left side of FIG. 26 represents the centerline of the U-shaped heat exchanger tube 493. Preferably, all centerlines of the plurality of U-shaped heat exchanger tubes 493 are parallel to each other.

Another advantage of the design is that a large number of the same or identical U-shaped heat exchanger tubes 493 can be mass produced. The individually fabricated heat exchanger tubes 493 are then welded to the tube sheet member 4932 before or after they are inserted into the tube support member 4931.

The rather small aisle width SP2 is made possible in particular because the biomass heating system 1 described above contributes only to very minor fouling of the heat exchanger tubes 493 due to its efficiency and "clean" combustion. This can be achieved in particular by an upstream electrostatic filter device 4. In addition, the flue gas condenser 49 may have automatic cleaning, for example by means of water spray nozzles. These water spray nozzles can be activated automatically by a control device, for example at regular intervals, to flush out or spray off the residues. The water for flushing out can then be discharged from the flue gas condenser 49 via the condensate outlet 496, allowing the condensate outlet 496 to serve a dual function. As a result, the flue gas condenser 49 can also be actively cleaned of contaminants, thus enabling the low aisle width as well.

The flue gas condenser 49 can thus be combined in particular with an electrostatic filter device 4 connected upstream in terms of flow. This makes it possible to achieve very low dust contents in the flue gas and, in turn, a very energy-efficient design with a gap width of 6+/−2 mm, preferably 5+−1 mm, between the heat exchanger bundles in cross-counterflow design as shell-and-tube heat exchangers.

With the configuration outlined above, it is possible, according to calculations, to keep the flue gas-side pressure drop lower than 100 Pa (more likely about 60 Pa), while a degree of mercury of mathematically about 14 Kelvin is achievable. The heat exchange capacity is designed for approx. 19.1 kW with the exemplary dimensioning shown above. In particular, and in contrast to the prior art, the present flue gas condenser 49 is designed for and suitable for biomass heating systems with a wide power range from 20 to 500 kW nominal boiler output.

Thus, flue gas condenser 49 provides for improved flue gas treatment.

The present flue gas condenser 49 with the low aisle width SP2 recovers in summary sensible and additionally in particular latent heat from the flue gas. As a result, the efficiency of the overall system can be increased considerably—up to 105% for pellets as fuel (M7) and up to more than 110% for wood chips as fuel (M30) (in each case based on the supplied fuel energy (calorific value).

(Transition Snail)

In the lower part of the biomass heating system 1 of FIGS. 2 and 3, an ash discharge device 7 is shown, which comprises an ash discharge screw 71 (a conveying screw) with a transition screw 73 in an ash discharge duct, which is operated, i.e. rotated, by a motor 72.

The ash discharge screw 71 of the ash removal system 7 serves to efficiently remove the combustion residues from the lower part of the boiler 11 into an ash container 74, which is exemplarily shown in FIG. 18. The transition screw 73 of the ash discharge screw 71 also serves to separate the individual flow areas of the boiler 11 (cf. arrows S1 and S 5), thus separating the combustion chamber 24 from the turning chamber 35. Here, no flue gas should return to the combustion in an uncontrolled manner after passing through the heat exchanger 3.

An exemplary task is to provide an ash discharge screw 71 that provides efficient separation for the flue gas in the boiler, while being low wear and low cost.

Figure 27A:
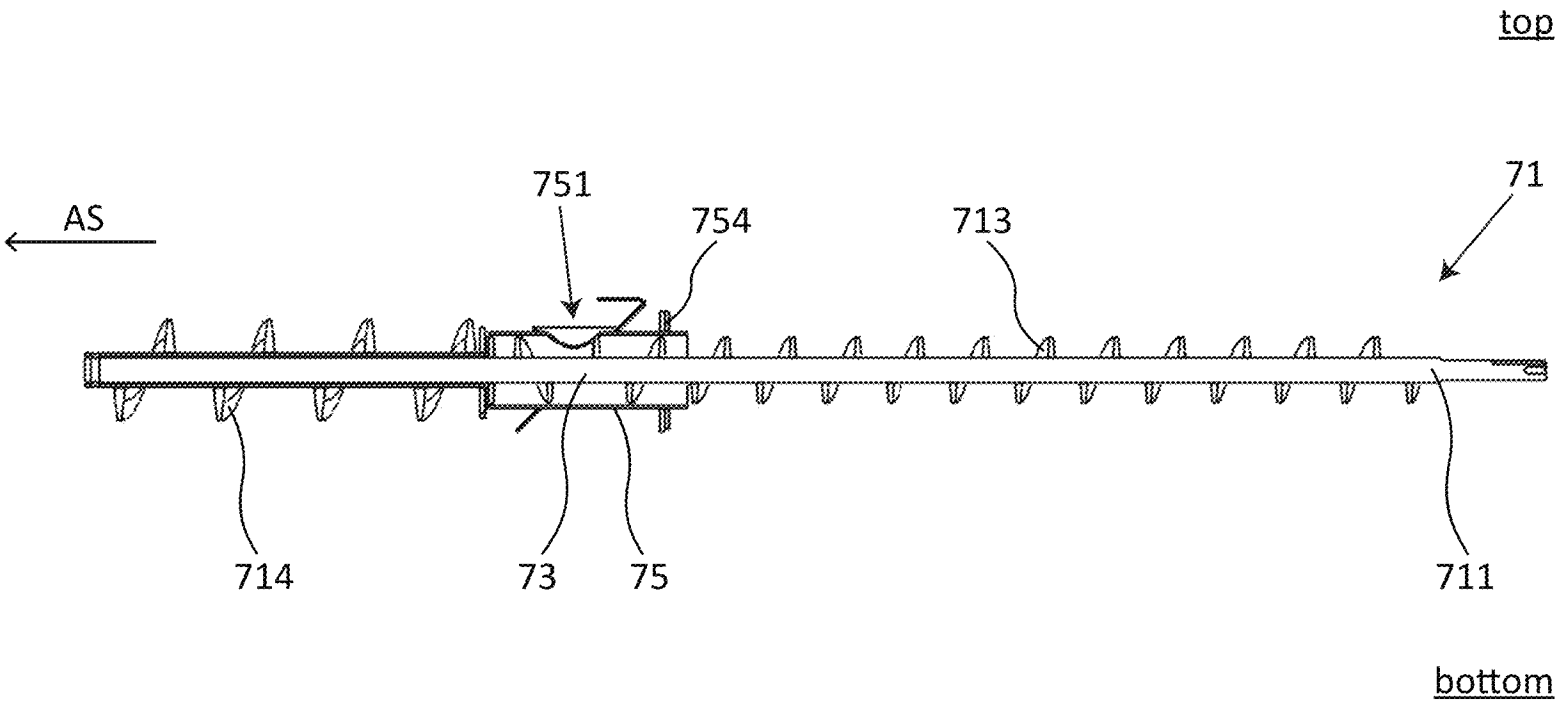
FIG. 27*a* shows a sectional view of an ash discharge screw with a transition screw, extracted from FIGS. 2 and 3.
Figure 27B:
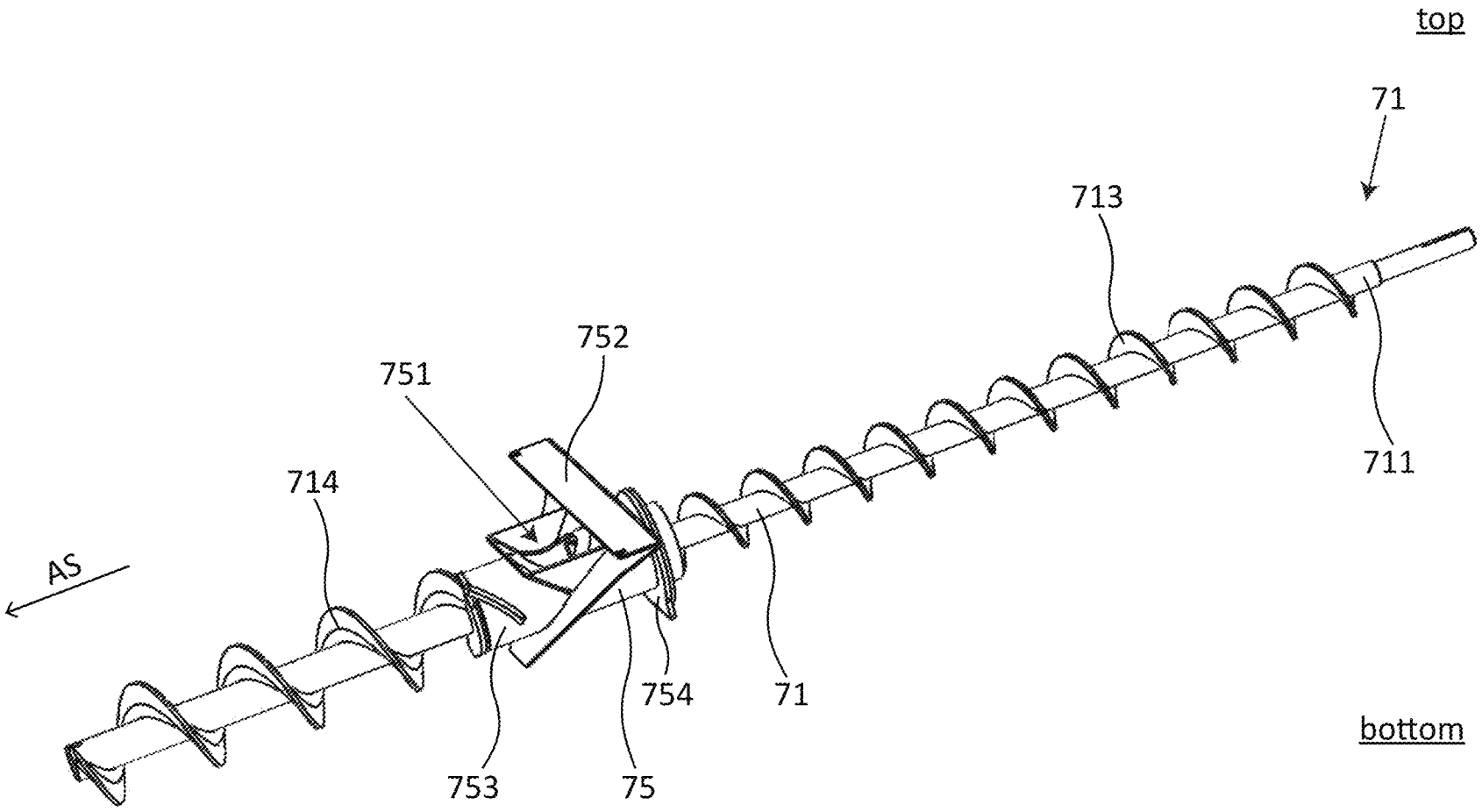
FIG. 27*b* shows a three-dimensional oblique view of the ash discharge screw of FIG. 27*a;*
Figure 28:
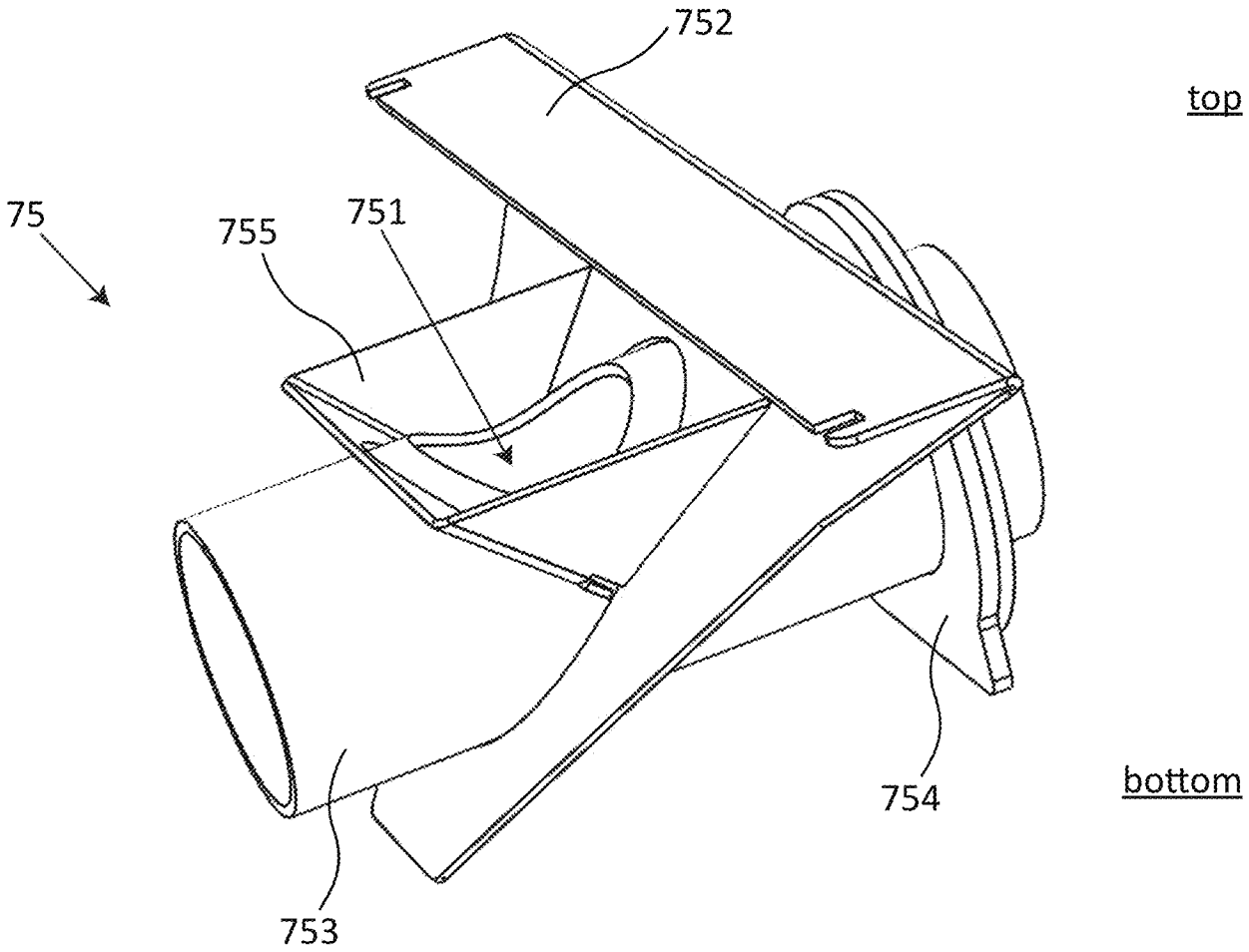
FIG. 28 shows a three-dimensional oblique view of a housing of the transition screw.
Figure 29:
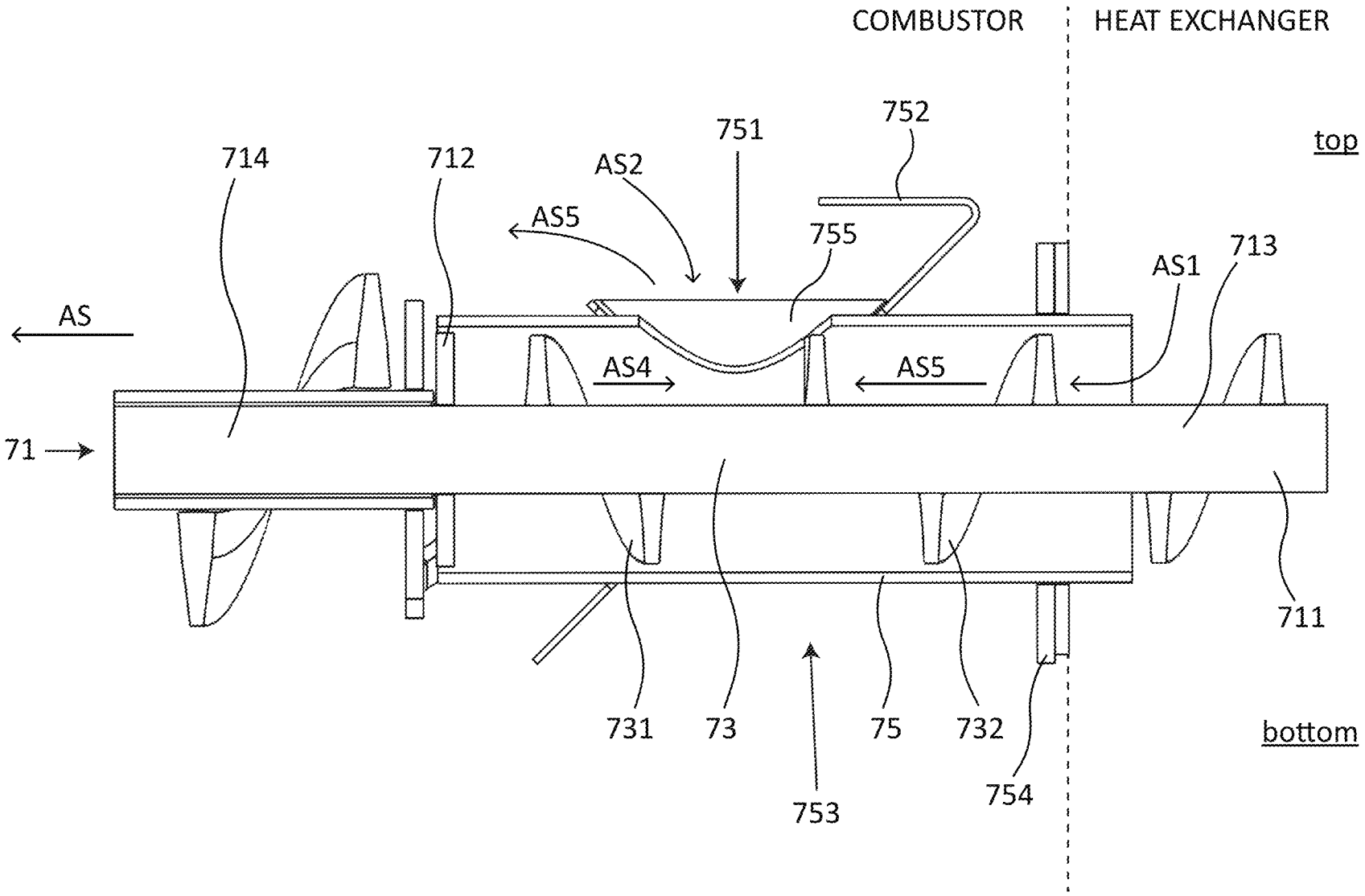
FIG. 29 shows a detailed view of the sectional view of the ash discharge screw with the transition screw of FIG. 27*a*.

FIG. 27*a* shows a sectional view of the ash discharge screw 71 with the transition screw 73, extracted from FIGS. 2 and 3. FIG. 27*b* shows a three-dimensional oblique view of the ash discharge screw 71 of FIG. 27*a*. FIG. 28 shows a three-dimensional oblique view of a housing 75 of the transition screw 73. FIG. 29 shows a detailed view of the ash discharge screw 71 with the transition screw 73 of FIG. 27*a*.

The ash discharge screw 71 is driven in rotation by the motor 72 (not shown in FIGS. 27*a*, 27*b*, 28 and 29) via its shaft 711 at its right end (or the rear end of the boiler 11) and serves to convey combustion residues, such as ash, to the left into the ash container 74. This general conveying direction is indicated by the arrow AS in FIGS. 27*a*, 27*b* and 29.

The ash discharge screw 71 of FIGS. 27*a*, 27*b*, 28 and 29 further includes a section of transition screw 73. Transition screw 73 is the section of the ash discharge screw 71 located in the transition screw housing 75.

In detail, the ash discharge screw 71 has three sections:

1) a burner section 714 or a portion 714 of the ash discharge screw 71 located in the burner area (shown on the left in FIGS. 27*a*, 27*b* and 29),
2) a heat exchanger section 713 or a part 713 of the ash discharge screw 71 located in the heat exchanger section (shown on the right in FIGS. 27*a*, 27*b* and 29), and
3) between these two sections, the section of the transition screw 73 or the transition screw 73 in the transition screw housing 75.

The pitch directions, or the handedness, of the heat exchanger section 713 and the burner section 714 coincide, i.e. both sections are provided either clockwise or counter-clockwise. Consequently, when the motor 72 (not shown in FIGS. 27*a*, 27*b*, 28 and 29) rotates the ash discharge screw 71, the conveying direction for the combustion residues in the heat exchanger section 713 and in the burner section 714 is the same in each case. However, the transition screw 73 is provided in part deviating therefrom. This will be explained in more detail later with reference to FIGS. 28 and 29.

The ash discharge screw 71 of FIGS. 27*a*, 27*b*, 28 and 29 has a larger diameter to the left of the transition screw 73 than to the right of the transition screw. For this purpose, for example, a screw part with a larger diameter can be provided or plugged onto the screw shaft 711 provided for all three sections of the ash discharge screw 71 together or also in one piece or in several pieces (can be plugged together). By means of the diameter differences, the removal of the combustion residues is optimized, since more combustion residues are produced in combustion chamber 24.

The transition screw housing 75 of FIGS. 27*a*, 27*b*, 28 and 29 has an opening 751 at its top. The transition screw housing 75 further includes a boundary plate 752, a cylindrical main body portion 75, a mounting and separating member 754, and a funnel member 755.

The fastening and separating member 754 supports the cylindrical main body section 753 while separating the two flow areas of the boiler 11 at the outer portion of the housing 75. The two areas are indicated in FIG. 29 by the terms "burner" and "heat exchanger", and the dashed line between them is intended to show schematically the separation of the two areas. Alternatively, a fastening element and a separating element can each be provided separately from one another. Just as alternatively, no partition member may be provided, for example, when the main body portion 753 is provided fully integrated into a partition wall of the vessel 11. In any case, the main body section 753 is arranged in the boiler 11 such that it separates two flow areas for flue gas and/or fresh air, but creates a connection with respect to the ash discharge.

The cylindrical main body section 753 receives the transition screw 73. Thereby, the transition worm 73 can freely rotate in the main body section 753. Accordingly, the inner diameter of the main body section 753 is arranged to correspond to the (maximum) outer diameter of the transition screw 73 plus a distance dimension. The distance dimension is set up in such a way that this allows free rotation of the transition screw 73, but at the same time an excessive clearance is avoided.

Further, a centering disk 712 is provided on the screw shaft 711 to center and optionally support the shaft 711 in the main body section 753. In addition, the centering disk 712 may provide a closure for the interior volume of the main body section 753.

The hopper member 755 is provided such that it encloses the opening 751 provided above. The hopper member 755 tapers its horizontal cross-sectional area downwardly toward the opening 751. In other words, the hopper member 755 is provided opening upwardly around the opening 751 (around).

The transition screw 73 further has two subsections, each of which has an opposite pitch direction or handedness. In other words, the transition auger 73 has two subsections 731, 732, one of which has a leftward rising auger and the other of which has a rightward rising auger.

In detail, the pitch of the heat exchanger section 713 of the ash discharge screw 71 may be continued unchanged in the right subsection 732 as it transitions to the transition screw 73. Presently, in subsection 732, a rightward rising auger is provided. Conversely, a leftward rising auger is provided in the left subsection 731.

More generally, the transition auger 73 has two subsections with augers 731, 732 of opposite handedness. Thus, the transition screw 73 has an integrated counter-rotation 731.

The construction outlined above accomplishes the following:

Combustion residues from the space under the heat exchanger 3 or from the turning chamber 35 and possibly from the optional filter device 4 are conveyed by the rotation of the screw of the heat exchanger section 713 into the main body section 753 formed by the housing 73. This is shown schematically in FIG. 29 by the arrow AS1.

These combustion residues AS1 and also combustion residues falling into the hopper from the combustion chamber 24, which is shown schematically in FIG. 29 with the arrow AS2, thus reach approximately the center of the transition screw 73 and beyond it into the left subsection 731 of the transition screw 73 (cf. arrow AS3). However, due to the opposite gearability of the screw of the subsection 731, the combustion residues are again driven in the opposite direction, which is schematically represented by the arrow AS4.

Thus, the combustion residues are combined between the two subsections 731, 732 of the transition screw 73. Thus, the subsections with the augers 731, 732 are arranged such that combustion residues are driven toward each other as the axis 711 rotates along it.

In other words, the mating flight 731 of the transition screw 73 provides for consolidation (and compaction) of the combustion residues inside the transition screw housing 75.

Due to the limited volume, the combustion residues condense below the opening 751 and form a plug which is mobile in its individual components (for example, with its ash particles) but still dense. As time passes and the volume increases, the combustion residues are forced or expelled upward toward the opening 751. In this respect, a plug of moving solids is formed in the transition screw housing 75 to seal against gas. However, this plug allows material removal.

The boundary plate 752 deflects these combustion residues laterally, as indicated schematically by the arrow AS5 in FIG. 29. These combustion residues, which are pushed out of the housing 75, subsequently fall on the left side onto or into the burner section of the heat discharge screw 71 and are thus finally conveyed out of the boiler 11 (cf. arrow AS).

As a result, the flow areas "burner" and "heat exchanger" are separated from each other with regard to flue gas or fresh air flows, while nevertheless a connection is provided with regard to the combustion residues and a discharge of the combustion residues can take place.

In the state of the art, it is common either for two separate ash discharge screws to be provided for the individual flow areas in the boiler, with disadvantageous additional expense, or for the axis of the ash discharge screw to be guided through a sealing intermediate wall of the boiler via a transition piece and by means of a plain bearing. The plain bearing must be designed in such a way that it seals at least to a large extent. The plain bearing is disadvantageously susceptible to wear as it is exposed to foreign bodies in the fuel, slag, embers, water and high temperatures. Such a plain bearing thus incurs considerable costs in production, in integration into the boiler, and also in maintenance.

The design described above completely avoids such a sliding bearing, and is also simple (hence inexpensive) and efficient.

In addition, flue gas handling is improved by avoiding faulty airflow during flue gas recirculation, as a good seal is provided with respect to the flue gas against potential backflow into combustion chamber 24.

To ensure initial filling of the transition screw housing 75, initial commissioning of the biomass heating system 1 may be performed at the factory. In this process, an initial heating process takes place, during which a sufficient volume of combustion residue is produced for filling, whereby it is still irrelevant here that the sealing function is not yet guaranteed.

(Flue Gas Recirculation of a Further Embodiment)

Figure 30:
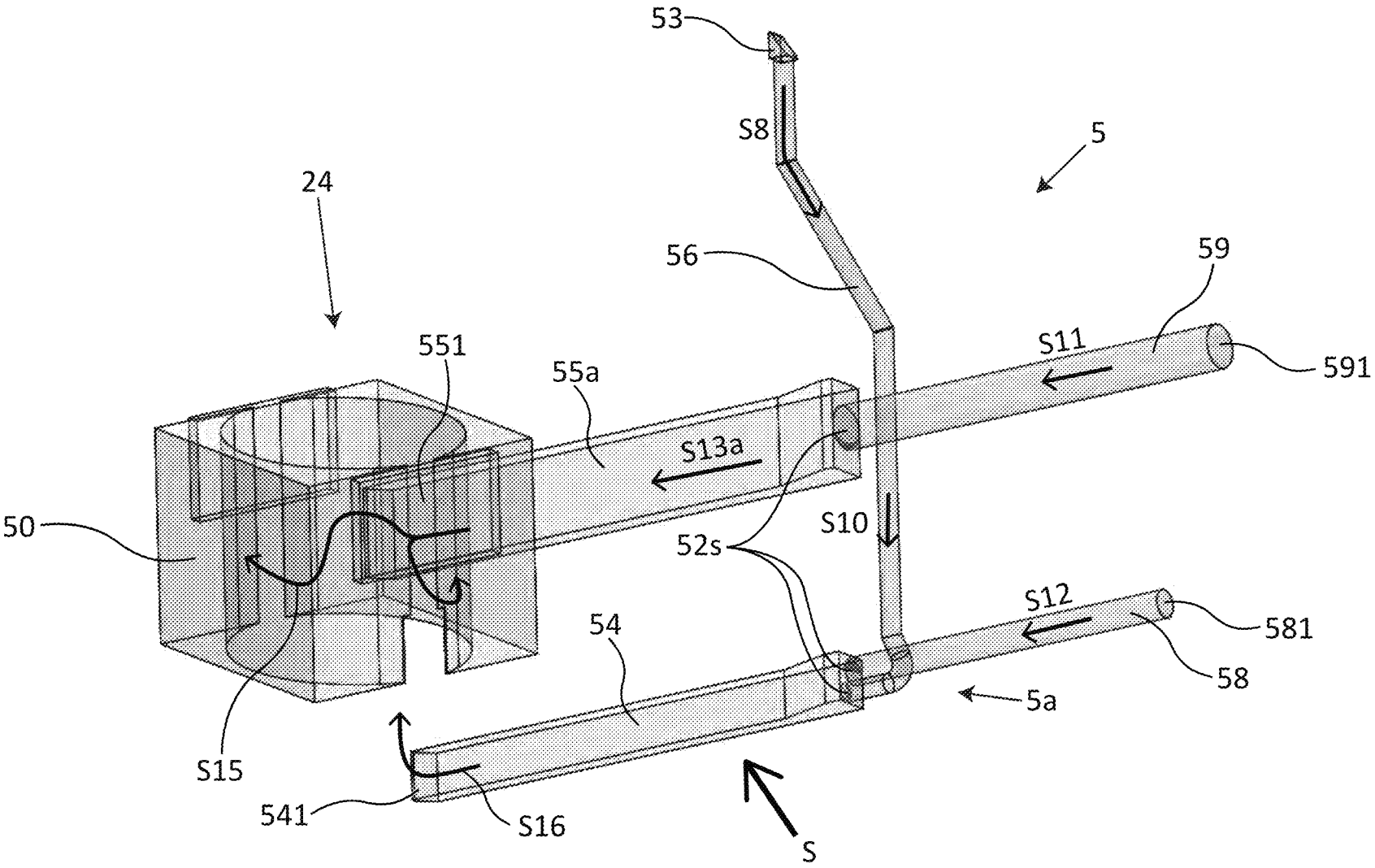
FIG. 30 shows a highlighted semi-transparent oblique view of a recirculation device of a further embodiment.

FIG. 30 shows a highlighted semi-transparent oblique view of a recirculation device of a further embodiment.

In this further embodiment, the secondary air supply does not include recirculation as in the embodiment of FIG. 13, but rather a simple controlled or regulated fresh air supply. In this respect, this further embodiment is simpler and less expensive to manufacture, and yet can still provide many of the above advantages of the embodiment of FIG. 13. In particular, as practical tests have shown, the efficiency targets set could also be achieved with this embodiment.

Corresponding reference signs of FIG. 30 disclose the same teachings of FIG. 13 in essence, which is why only the differences between the two embodiments are discussed in essence to avoid repetition.

The rotary vane valves of the embodiment of FIG. 13 have been replaced by sliding vane valves in the further embodiment of FIG. 13. Further, in the further embodiment of FIG. 30, no secondary mixing of rezi and fresh air takes place, but only the supply (amount) of fresh air to the recirculation nozzles 291 is controlled or regulated. In this case, the secondary mixing duct 55 was retained as secondary tempering duct 55*a*, fulfilling the function of tempering the fresh air. Here, the secondary tempering duct 55*a* is provided along the wall of the boiler 11, whereby the fresh air supplied by the secondary air duct 59 is preheated by the heat of the boiler 11 before the secondary air is introduced into the combustion chamber 24 (see arrow S13*a*). Accordingly, the secondary temperature control duct 55*a* is provided with a rectangular cross-section having a greater (vertical) height than (horizontal) thickness, whereby the secondary temperature control duct 55*a* "hugs" the boiler wall, and the area for heat exchange is kept large. Preheated secondary air increases combustion efficiency. For details of the design of the secondary tempering duct 55*a*, please also refer to the comments on the secondary mixing duct 55.

The arrow S15 shows the secondary air flow passes through the secondary passage 551 into the annular duct 50 around the combustion chamber bricks 29 and through the recirculation nozzles 291 into the combustion chamber 24. This not only further advantageously heats the secondary air, but also advantageously cools the combustion chamber bricks 29, which, for example, reduces slag formation on the combustion chamber bricks (cf. the above explanations on the minimum temperature for slag formation).

Arrows S8 and S10 indicate only the flow of flue gas downstream of heat exchanger 3 (or optional filter device 4) to primary mixing unit 5*a*, which is of simpler and less expensive design in this embodiment.

Figure 31:
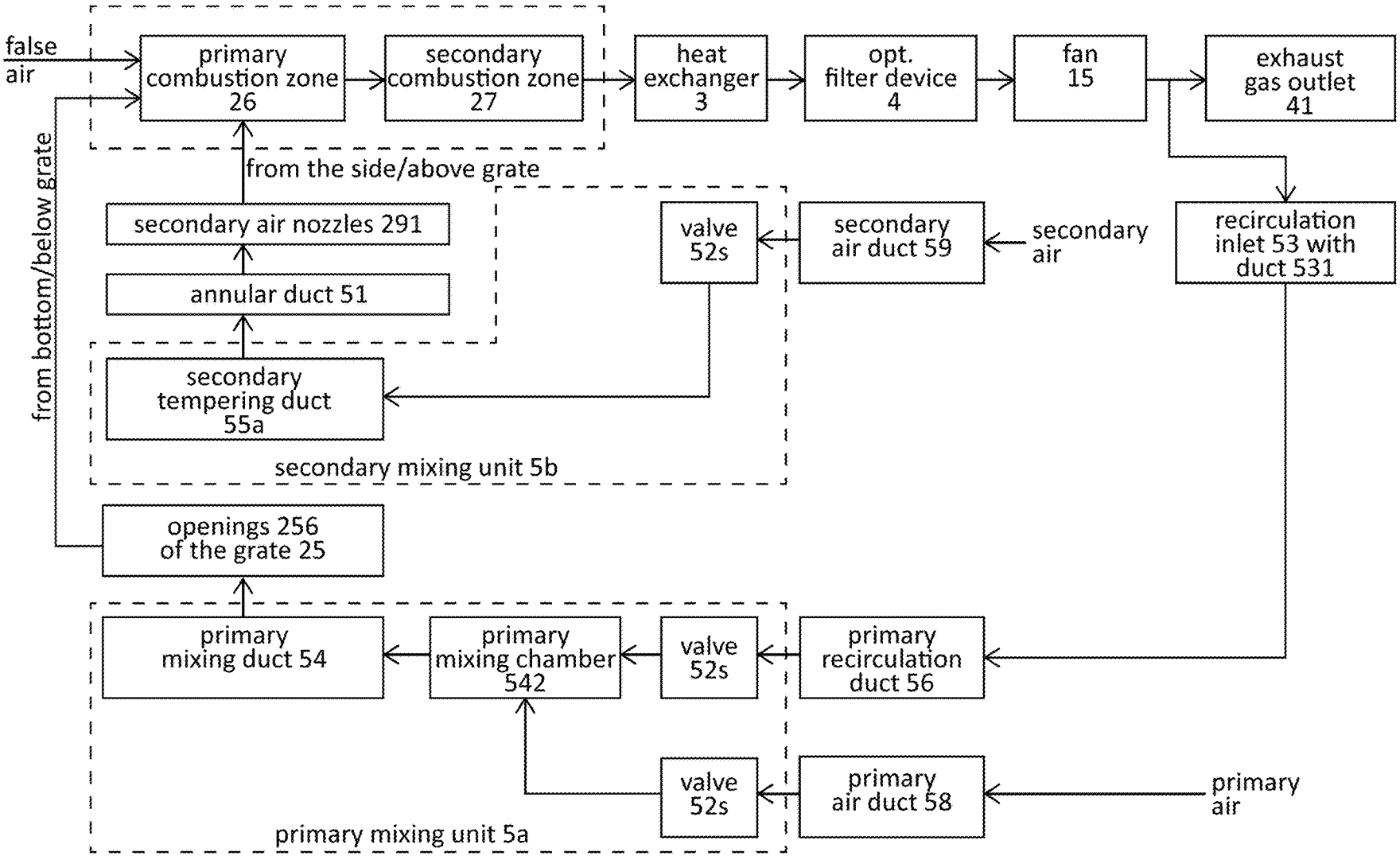
FIG. 31 shows a schematic block diagram revealing the flow pattern in the respective individual components of a biomass heating system and the recirculation device of FIG. 31 according to a further embodiment.

FIG. 31 shows a schematic block diagram revealing the flow pattern in the respective individual components of a biomass heating system and the recirculation device of FIG. 30 according to the further embodiment.

Identical reference signs of FIG. 31 disclose in essence the same teachings of FIG. 15, which is why only the differences are discussed in essence to avoid repetition.

There is a lack of secondary air mixing of fresh air and rezi gas. In this respect, no secondary mixing chamber 552 and no one valve 52 are provided for the rezi gas. Likewise, the recirculation inlet duct divider 532 is omitted. Although the secondary mixing duct 55 may be mechanically identical to the embodiment of FIG. 15, it is functionally not a duct section for mixing fresh air and rezi gas, but only serves more (this is still the same as the embodiment of FIG. 15) to pre-temper the fresh air before it is introduced into the combustion chamber 24.

In the further embodiment, moreover, the secondary air supply may be dispensed with completely, in which case the biomass heating system 1 may be provided with only primary recirculation.

OTHER EMBODIMENTS

The invention admits other design principles in addition to the embodiments and aspects explained. Thus, individual features of the various embodiments and aspects can also be combined with each other as desired, as long as this is apparent to the person skilled in the art as being executable.

The recirculation device 5 with a primary recirculation and a secondary recirculation is described here. However, in its basic configuration, the recirculation device 5 may also have only primary recirculation and no secondary recirculation. Accordingly, in this basic configuration of the recirculation device, the components required for secondary recirculation can be completely omitted, for example, the recirculation inlet duct divider 532, the secondary recirculation duct 57 and an associated secondary mixing unit 5*b*, which will be explained later, as well as the recirculation nozzles 291 can be omitted.

Again, alternatively, only primary recirculation can be provided in such a way that, although the secondary mixing unit 5*b* and the associated ducts are omitted, and the mixture of the primary recirculation is not only fed under the rotating grate 25, but this is also fed (for example via a further duct) to the recirculation nozzles 291 provided in this variant. This variant is mechanically simpler and thus less expensive, but still features the recirculation nozzles 291 to swirl the flow in the combustion chamber 24.

At the input of the flue gas recirculation device 5, an air flow sensor, a vacuum box, a temperature sensor, an exhaust gas sensor and/or a lambda sensor may be provided.

Further, instead of only three rotating grate elements 252, 253 and 254, two, four or more rotating grate elements may be provided. For example, five rotating grate elements could be arranged with the same symmetry and functionality as the presented three rotating grate elements. In addition, the rotating grate elements can also be shaped or formed differently from one another. More rotating grate elements have the advantage of increasing the crushing function.

It should be noted that other dimensions or combinations of dimensions can also be provided.

Instead of convex sides of the rotating grate elements 252 and 254, concave sides thereof may also be provided, and the sides of the rotating grate element 253 may have a complementary convex shape in sequence. This is functionally approximately equivalent.

Fuels other than wood chips or pellets can be used as fuels for the biomass heating system.

The biomass heating system disclosed herein can also be fired exclusively with one type of a fuel, for example, only with pellets.

The combustion chamber bricks 29 may also be provided without the recirculation nozzles 291. This may apply in particular to the case where secondary recirculation is not provided.

The rotational flow or vortex flow in the combustion chamber 24 may be provided in a clockwise or counter-clockwise direction.

The combustion chamber ceiling 204 may also be provided to slope in sections, such as in a stepped manner.

The secondary (re)circulation can also only be supplied with secondary air or fresh air, and in this respect does not recirculate the flue gas, but merely supplies fresh air.

The secondary air nozzles 291 are not limited to purely cylindrical holes in the combustion chamber bricks 291. These can also be in the form of frustoconical openings or waisted openings.

The dimensions and sizes given are only to be understood as examples, and can be modified.

Presently, the recirculation device 5 is described in the embodiment of FIG. 12 with a primary recirculation and a secondary recirculation. However, in its basic configuration, the recirculation device 5 may also have only primary recirculation and no secondary recirculation. Accordingly, in this basic configuration of the recirculation device, the components required for secondary recirculation can be completely omitted, for example, the recirculation inlet duct divider 532, the secondary recirculation duct 57 and an associated secondary mixing unit 5*b*, which will be explained, and the recirculation nozzles 291 can be omitted.

Again, alternatively, only primary recirculation can be provided in such a way that, although the secondary mixing unit 5*b* and the associated ducts are omitted, and the mixture of the primary recirculation is not only fed under the rotating grate 25, but this is also fed (for example via a further duct) to the recirculation nozzles 291 provided in this variant. This variant is mechanically simpler and thus less expensive, but still features the recirculation nozzles 291 to create eddy current or swirl flow in the combustion chamber 24.

At the input of the flue gas recirculation device 5, an air flow sensor, a vacuum box, a temperature sensor, an exhaust gas sensor and/or a lambda sensor may be provided.

In the case of the transition screw 73, the counter-rotation can also be provided on the other side of that of the ash discharge screw 71 (mirror-symmetrical).

The embodiments disclosed herein have been provided for the purpose of describing and understanding the technical matters disclosed and are not intended to limit the scope of the present disclosure. Therefore, this should be construed to mean that the scope of the present disclosure includes any modification or other various embodiments based on the technical spirit of the present disclosure.

LIST OF REFERENCE NUMERALS

1 Biomass heating system
11 Boiler
12 Boiler foot
13 Boiler housing
14 Water circulation device
15 Blower
16 Exterior cladding
2 combustion device
21 first maintenance opening for the combustion device
22 Rotary mechanism holder
23 Rotating mechanism
24 Combustion chamber
25 Rotating grate
26 Primary combustion zone of the combustion chamber
27 Secondary combustion zone or radiation part of the combustion chamber
28 Fuel bed
29 Combustion chamber bricks
A1 first horizontal section line
A2 first vertical section line
201 Ignition device
202 Combustion chamber slope
203 Combustion chamber nozzle
204 Combustion chamber ceiling
211 Insulation material e.g. vermiculite
231 Drive or motor(s) of the rotating mechanism
251 Bottom plate or Base plate of the rotating grate
252 First rotating grate element
253 Second rotating grate element
254 Third rotating grate element
255 Transition element
256 Openings
257 Grate lips
258 Combustion area
260 Support surfaces of the combustion chamber bricks
261 Groove
262 Lead/Ledge
263 Ring
264 Retaining stones/Mounting blocks
265 Slope of the mounting blocks
291 Secondary air or recirculation nozzles
3 Heat exchanger
31 Maintenance opening for heat exchanger
32 Boiler tubes
33 Boiler tube inlet

34 Turning chamber entry/inlet
35 Turning chamber
36 Spring turbulator
37 Belt or spiral turbulator
38 Heat exchange medium
331 Insulation at boiler tube inlet
4 Filter device
41 Exhaust gas outlet
42 Electrode supply line
43 Electrode holder
44 Filter inlet
45 Electrode
46 Electrode insulation
47 Filter outlet
48 Cage
49 Flue gas condenser
411 Flue gas supply line to the flue gas condenser
412 Flue gas outlet from the flue gas condenser
481 Cage mount
491 First fluid connection
491 Second fluid connection
493 Heat exchanger tube
4931 Tube holding element
4932 Tubular floor element
4933 Loops/reversal points
4934 first spaces between heat exchanger tubes relative to each other
4935 second intermediate spaces of the heat exchanger tubes/ducts to the Outer wall of the flue gas condenser
4936 Passages
495 Head element
4951 Head element flow guide
496 Condensate discharge
4961 Condensate collection funnel
497 Flange
498 Side surface with maintenance opening
499 Support device for the flue gas condenser
5 Recirculation device
50 Ring duct around combustion chamber bricks
52 Air valve
52*s* Gate valve
53 Recirculation inlet
54 Primary mixing duct
55 Secondary mixing duct
55*a* Secondary tempering duct
56 Primary recirculation duct
57 Secondary recirculation duct
58 Primary air duct
59 Secondary air duct
5*a* Primary mixing unit
5*b* Secondary mixing unit
521 Valve actuator
522 Valve actuating axes
523 Valve leaf
524 Valve body
525 Valve antechamber
526 Valve aperture
527 Valve body
528 Valve area
531 Recirculation inlet duct
532 Recirculation inlet duct divider
541 Primary passage
542 Primary mixing chamber
543 Primary mixing chamber outlet
544 Primary receive valve insertion
545 Primary air valve inlet
546 Primary mixing chamber housing
551 Secondary passage
552 Secondary mixing chamber
553 Secondary mixing chamber outlet
554 Secondary recurrent valve insertion
555 Secondary air valve inlet
556 Secondary mixing chamber housing
581 Primary air inlet
582 Primary air sensor
591 Secondary air inlet
592 Secondary air sensor
6 Fuel supply
61 Rotary valve
62 Fuel supply axis
63 Translation mechanics/mechanism
64 Fuel supply duct
65 Fuel supply opening/port
66 Drive motor
67 Fuel screw conveyor
7 Ash removal/Ash discharge
71 Ash discharge screw conveyor
711 Screw axis
712 Centering disk
713 Heat exchanger section
714 Burner section
72 Ash removal motor with mechanics
73 Transition screw
731 right subsection—scroll rising to the left
732 left subsection-right rising scroll
74 Ash container
75 Transition screw housing
751 Opening of the transition screw housing
752 Boundary plate
753 Main body section of housing
754 Fastening and separating element
755 Funnel element
81 Bearing axles
82 Rotation axis of the fuel level flap
83 Fuel level flap
831 Main area
832 Central axis
833 Surface parallel
834 Openings
84 Bearing notch/Support notch
85 Sensor flange
86 Glow bed height measuring mechanism
9 Cleaning device
91 Cleaning drive
92 Cleaning waves
93 Shaft holder
94 Projection
95 Turbulator holders/brackets
951 Pivot bearing mounting
952 Projections
953 Culverts
954 Recesses
955 Pivot bearing linkage
96 two-arm hammer/striker
97 Stop head
E Direction of fuel insertion
S* Flow arrows

The invention claimed is:

1. A biomass heating system for combusting fuel in the form of pellets and/or wood chips, comprising:

a boiler with a combustion device;

a heat exchanger with an inlet and an outlet;

wherein the combustion device possesses a combustion chamber having a primary combustion zone and a secondary combustion zone arranged downstream thereof;

wherein the secondary combustion zone of the combustion chamber is fluidically connected to the inlet of the heat exchanger; and wherein the primary combustion zone is laterally enclosed by a plurality of combustion chamber bricks wherein, the biomass heating system possesses the following:

a recirculation device for recirculating flue gas generated by the combustion of the fuel in the combustion device wherein the recirculation device possesses the following:

a recirculation inlet that is provided downstream of the outlet of the heat exchanger and fluidly connected to the outlet of the heat exchanger;

a primary air duct for the supply of primary air;

a primary mixing unit with a primary mixing chamber and a primary mixing duct, wherein the primary mixing chamber is provided downstream of the recirculation inlet and the primary air duct and fluidly connected with both of the recirculation inlet and the primary air duct; and at least two air valves are provided at an input side on the primary mixing chamber;

a primary passage into the primary combustion zone which is provided downstream of the primary mixing duct and fluidly connected to the primary combustion zone;

wherein the primary mixing unit is arranged in such a way that it can mix the flue gas from the recirculation inlet with the primary air from the primary air duct by means of the at least two air valves, and wherein the primary mixing duct has a minimum length of 700 mm from beginning to end and is arranged adjacent to the heat exchanger, wherein the primary mixing duct is configured to preheat the mixture of flue gas and primary air upstream of the primary combustion zone, wherein the primary mixing chamber and the primary mixing duct are axially unaligned, and wherein the primary mixing chamber is configured to deflect a gas flow that enters the primary mixing chamber before the gas flow enters the primary mixing duct.

2. The biomass heating system according to claim 1, wherein the primary mixing duct is directly connected to a primary mixing chamber outlet of the primary mixing chamber, and the primary mixing duct is provided downstream relative to the primary mixing chamber.

3. The biomass heating system according to claim 1, wherein the primary mixing duct runs in a straight line.

4. The biomass heating system according to claim 1, wherein the air valves of the primary mixing chamber are rotary slide valves that each possess a valve body with at least one sickle-shaped valve wing and with at least one corresponding sickle-shaped valve passage opening into the primary mixing chamber.

5. The biomass heating system according to claim 1, wherein the primary mixing chamber possesses a primary mixing chamber outlet on an outlet side;

the primary mixing chamber possesses at least two valve passage openings on an inlet side; and the primary mixing chamber is arranged such that the at least two valve passage openings and the primary mixing chamber outlet are not opposite each other through the primary mixing chamber, so that flows entering the primary mixing chamber through the at least two valve passage openings are deflected or diverted in the primary mixing chamber.

6. The biomass heating system according to claim 1, wherein the recirculation device further possesses the following:

a secondary air duct for the supply of secondary air;

a secondary mixing unit with a secondary mixing chamber and a secondary mixing duct, wherein the secondary mixing chamber is provided downstream of the recirculation inlet and to the secondary air duct and is fluidly connected to both of the recirculation inlet and the secondary air duct; and at least two air valves that are provided on an inlet side of the secondary mixing chamber; and secondary air nozzles which are provided in the combustion chamber bricks and which are directed laterally into the primary combustion zone, and which are provided downstream of and fluidically connected to the secondary mixing duct;

wherein the secondary mixing unit is arranged in such a way that it can mix the flue gas from the recirculation inlet with the secondary air from the secondary mixing duct by means of the at least two air valves of the secondary mixing chamber.

* * * * *